US008927187B2

(12) United States Patent
Murai et al.

(10) Patent No.: US 8,927,187 B2
(45) **Date of Patent: *Jan. 6, 2015**

(54) CYAN TONER CONTAINING COMPOUND HAVING AZO SKELETON

(71) Applicant: Canon Kabushiki Kaisha, Tokyo (JP)

(72) Inventors: Yasuaki Murai, Kawasaki (JP); Takayuki Toyoda, Yokohama (JP); Waka Hasegawa, Kawasaki (JP); Yuki Hasegawa, Yokohama (JP); Masashi Kawamura, Yokohama (JP); Taiki Watanabe, Akishima (JP); Masanori Seki, Yokohama (JP); Chiaki Nishiura, Kawasaki (JP); Ayano Mashida, Kawasaki (JP); Masashi Hirose, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/777,888

(22) Filed: Feb. 26, 2013

(65) Prior Publication Data

US 2013/0224646 A1 Aug. 29, 2013

(30) Foreign Application Priority Data

Feb. 29, 2012 (JP) ..... 2012-043077

(51) Int. Cl.

| | |
|---|---|
| ***G03G 9/09*** | (2006.01) |
| ***G03G 9/097*** | (2006.01) |
| ***G03G 9/08*** | (2006.01) |
| ***G03G 9/087*** | (2006.01) |

(52) U.S. Cl.

CPC ..... *G03G 9/0918* (2013.01); *G03G 9/09783* (2013.01); *G03G 9/09758* (2013.01); *G03G 9/0806* (2013.01); *G03G 9/08768* (2013.01)

USPC ..... 430/108.22; 430/108.21

(58) Field of Classification Search

CPC ..... G03G 9/08768; G03G 9/0918; G03G 9/09758; G03G 9/09783

USPC ..... 430/108.21, 108.22

See application file for complete search history.

(56) References Cited

U.S. PATENT DOCUMENTS

| | | | | |
|---|---|---|---|---|
| 8,475,992 | B2 * | 7/2013 | Morris et al. | 430/137.1 |
| 2008/0318144 | A1 | 12/2008 | Watanabe | |
| 2013/0224644 | A1 * | 8/2013 | Hasegawa et al. | 430/108.22 |
| 2013/0224645 | A1 * | 8/2013 | Toyoda et al. | 430/108.22 |

FOREIGN PATENT DOCUMENTS

| | | | |
|---|---|---|---|
| CN | 1432568 | A | 7/2003 |
| CN | 101430513 | A | 5/2009 |
| CN | 101689032 | A | 3/2010 |
| EP | 1341050 | A2 | 9/2003 |
| JP | 3-113462 | A | 5/1991 |
| JP | 2003-277643 | A | 10/2003 |
| JP | 4510687 | B2 | 7/2010 |
| WO | WO 2012026378 | A1 * | 3/2012 |

OTHER PUBLICATIONS

Diamond, Arthur S & David Weiss (eds.) Handbook of Imaging Materials, 2nd ed.. New York: Marcel-Dekker, Inc. (Nov. 2001) pp. 173-191.*

* cited by examiner

*Primary Examiner* — Christopher Rodee

(74) *Attorney, Agent, or Firm* — Canon U.S.A. Inc., IP Division

(57) ABSTRACT

A cyan toner comprising toner particles, each of which contains a binder resin, a compound in which a polymer portion is bound to an azo skeleton structure, and a phthalocyanine pigment serving as a colorant. The polymer portion of the compound has a monomer unit represented by formula (2) and is bound to a structure represented by formula (1);

Formula (1)

Formula (2)

10 Claims, 4 Drawing Sheets

CYAN TONER CONTAINING COMPOUND HAVING AZO SKELETON

BACKGROUND OF THE INVENTION

1. Field of the Invention

The present invention relates to a toner containing, as a dispersant of a phthalocyanine pigment, a compound having an azo skeleton, the toner being used in electrophotography, electrostatic recording, electrostatic printing, or toner-jet recording.

2. Description of the Related Art

Insufficient dispersibility of a pigment in toner particles causes a decrease in the coloring power of the toner particles. To solve this problem, various techniques for dispersing a pigment have been developed.

Regarding a technique for dispersing a phthalocyanine pigment in a toner, for example, Japanese Patent Laid-Open No. 03-113462 discloses that a polymer containing sodium styrenesulfonate as a monomer unit is used as a dispersant. As another example, a method has also been proposed in which dispersibility of a phthalocyanine pigment is improved by allowing metal-containing phthalocyanine and a polymer having a substituent that can be coordinated with the metal-containing phthalocyanine (hereinafter abbreviated as "coordinating polymer") to coexist.

For example, Japanese Patent Laid-Open No. 2003-277643 discloses that a 4-vinyl pyridine/styrene copolymer is used as the coordinating polymer. Japanese Patent No. 4510687 discloses that a copolymer of styrene and a monomer having an amide group is used as the coordinating polymer.

SUMMARY OF THE INVENTION

The dispersant of a phthalocyanine pigment described in Japanese Patent Laid-Open No. 03-113462 contains sodium styrenesulfonate, which has high affinity for water. Therefore, in a method for producing a toner in water, such as a suspension polymerization method, the dispersant tends to be unevenly located on the surface of the toner. As a result, chargeability of the toner is affected by degradation of dispersibility and a change in the surface state of the toner, which may result in a problem of an image defect called "fogging" in which the toner is developed in a margin of an image.

In the methods for improving dispersibility of a phthalocyanine pigment described in Japanese Patent Laid-Open No. 2003-277643 and Japanese Patent No. 4510687, the dispersibility is exhibited by a coordinate bond between the metal-containing phthalocyanine and the coordinating polymer. Therefore, in order to maintain the dispersibility, it is necessary to incorporate a large amount of coordinating polymer.

The present invention provides a cyan toner which has a high coloring power and in which dispersibility of a cyan pigment in a binder resin is improved. The present invention also provides a cyan toner in which "fogging" is suppressed and which has a high transfer efficiency.

Specifically, the present invention provides a toner comprising toner particles, each of which contains a binder resin, a compound and a phthalocyanine pigment, the compound having a structure, a polymer portion of which has a monomer unit represented by formula (2) and is bound to a structure represented by formula (1);

Formula (1)

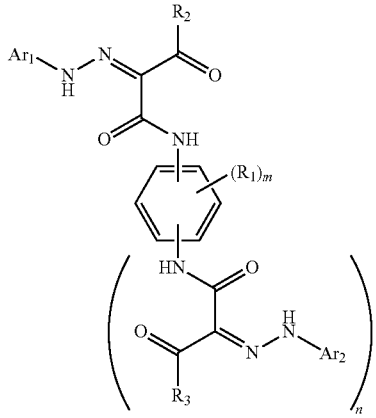

In formula (1), at least one of $R_2$, $R_3$, $Ar_1$, and $Ar_2$ is bound to the polymer portion directly or through a linking group, wherein each $R_1$ independently represents a hydrogen atom, a halogen atom, an alkyl group, an alkoxy group, a trifluoromethyl group, a cyano group, or a hydroxyl group, $R_2$ and $R_3$ not bound to the polymer portion independently represent a monovalent group selected from the group consisting of an alkyl group, a phenyl group, an $OR_4$ group, and an $NR_5R_6$ group, $R_4$ to $R_6$ independently represent a hydrogen atom, an alkyl group, a phenyl group, or an aralkyl group, $Ar_1$ and $Ar_2$ not bound to the polymer portion independently represent an aryl group, wherein any one of $R_2$ and $R_3$ bound to the polymer portion independently represents a divalent group, a hydrogen atom of which is removed from the corresponding monovalent group of any one of $R_2$ and $R_3$; any one of $Ar_1$ and $Ar_2$ bound to the polymer portion independently represents a divalent group, a hydrogen atom of which is removed from the corresponding aryl group of any one of $Ar_1$ and $Ar_2$, m represents an integer of 3 or 4, n represents an integer of 1 or 2, and n+m is 5.

Formula (2)

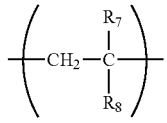

In formula (2), $R_7$ represents a hydrogen atom or an alkyl group, and $R_8$ represents a phenyl group, a carboxyl group, a carboxylic acid ester group, or a carboxylic acid amide group.

Further features of the present invention will become apparent from the following description of exemplary embodiments with reference to the attached drawings.

DESCRIPTION OF THE EMBODIMENTS

Figure 1:
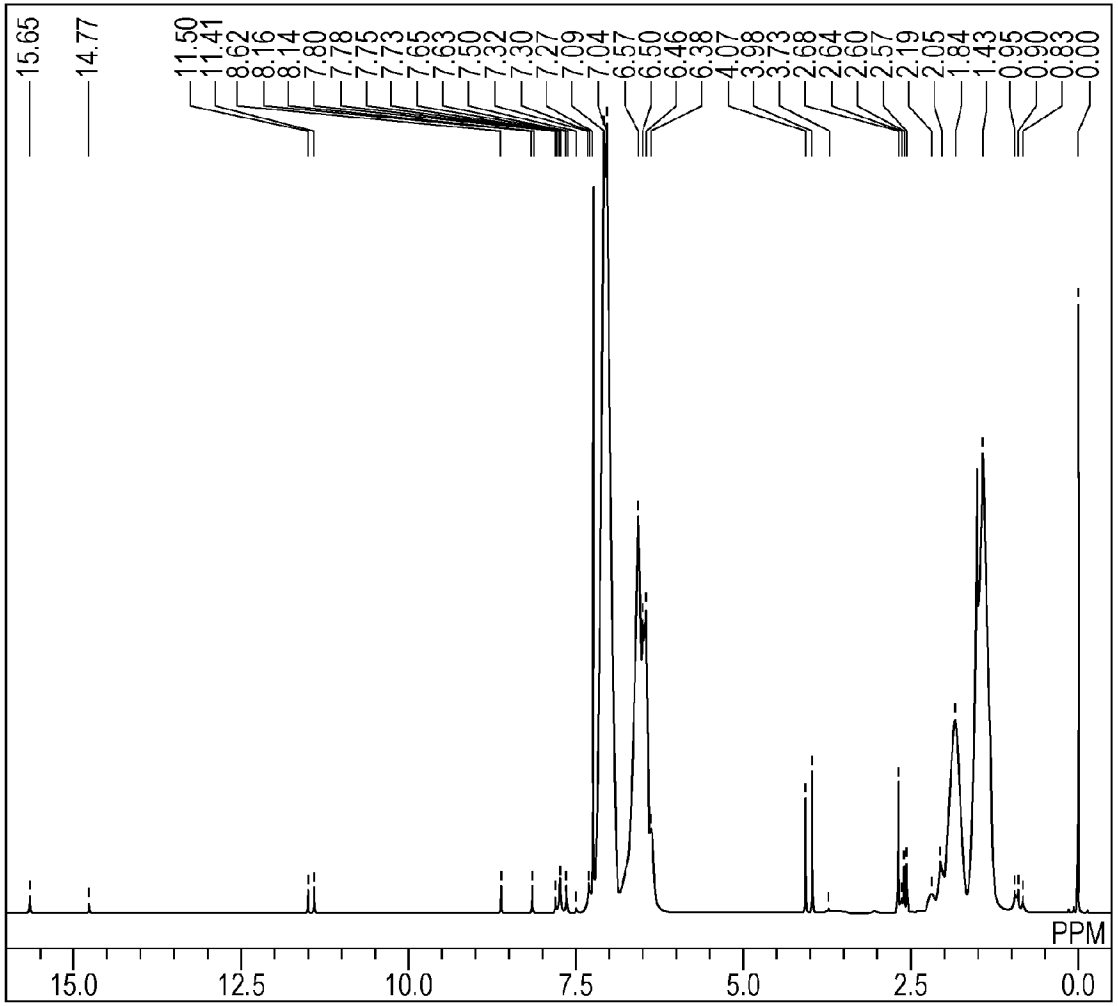
FIG. 1 is a $^1H$ NMR spectrum chart of compound (44) having an azo skeleton structure in $CDCl_3$ at room temperature at 400 MHz.

Embodiments of the present invention will now be described in detail.

A toner of the present invention comprises toner particles, each of which contains a phthalocyanine, a binder resin and a compound having a structure, a polymer portion of which has a monomer unit represented by formula (2) and is bound to a structure represented by formula (1) directly or through a linking group.

Formula (1)

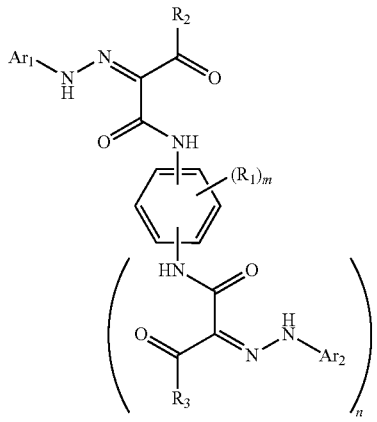

In formula (1), at least one of $R_2$, $R_3$, $Ar_1$, and $Ar_2$ is bound to the polymer portion directly or through a linking group, wherein each $R_2$ independently represents a hydrogen atom, a halogen atom, an alkyl group, an alkoxy group, a trifluoromethyl group, a cyano group, or a hydroxyl group, $R_2$ and $R_3$ not bound to the polymer portion independently represent a monovalent group selected from the group consisting of an alkyl group, a phenyl group, an $OR_4$ group, and an $NR_5R_6$ group, $R_4$ to $R_6$ independently represent a hydrogen atom, an alkyl group, a phenyl group, or an aralkyl group, $Ar_1$ and $Ar_2$ not bound to the polymer portion independently represent an aryl group, wherein any one of $R_2$ and $R_3$ bound to the polymer portion independently represents a divalent group, a hydrogen atom of which is removed from the corresponding monovalent group of any one of $R_2$ and $R_3$; any one of $Ar_1$ and $Ar_2$ bound to the polymer portion independently represents a divalent group, a hydrogen atom of which is removed from the corresponding aryl group of any one of $Ar_1$ and $Ar_2$, m represents an integer of 3 or 4, n represents an integer of 1 or 2, and n+m is 5.

Formula (2)

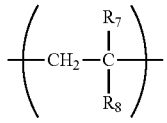

In formula (2), $R_7$ represents a hydrogen atom or an alkyl group, and $R_8$ represents a phenyl group, a carboxyl group, a carboxylic acid ester group, or a carboxylic acid amide group.

The present invention provides a cyan toner containing, as a pigment dispersant, a compound in which a structure represented by formula (1) above is bound to a polymer portion. The compound has high affinity for water-insoluble solvents, polymerizable monomers, and binder resins for a toner and high affinity for phthalocyanine pigments. Therefore, a phthalocyanine pigment is satisfactorily dispersed in a binder resin by using the compound as a pigment dispersant, and thus a cyan toner having a high coloring power is provided. Furthermore, "fogging" is suppressed by adding the compound to a cyan toner, a cyan toner having a high transfer efficiency is provided.

The structure represented by formula (1) is also referred to as "azo skeleton structure". Furthermore, a compound in which the azo skeleton structure is bonded to a polymer portion having a monomer unit represented by formula (2) is also referred to as "compound having an azo skeleton structure". In addition, only the polymer portion which has the monomer unit represented by formula (2) and to which the azo skeleton structure is not bonded is also simply referred to as "polymer portion".

The present invention will now be described in detail.

First, a compound having an azo skeleton structure will be described. The compound having an azo skeleton structure is constituted by an azo skeleton structure represented by formula (1) above, which has high affinity for phthalocyanine pigments, and a polymer portion having a monomer unit represented by formula (2) above, which has high affinity for water-insoluble solvents.

First, the azo skeleton structure will be described in detail.

Examples of the halogen atom represented by $R_1$ in formula (1) include a fluorine atom, a chlorine atom, a bromine atom, and an iodine atom.

Examples of the alkyl group represented by $R_1$ in formula (1) include linear, branched, or cyclic alkyl groups such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

Examples of the alkoxy group represented by $R_1$ in formula (1) include linear or branched alkoxy groups such as a methoxy group, an ethoxy group, a n-propoxy group, a n-butoxy group, and an isopropoxy group.

$R_1$ in formula (1) can be appropriately selected from the substituents listed above, a trifluoromethyl group, a cyano group, a hydroxyl group, and a hydrogen atom. In view of the affinity for phthalocyanine pigments, $R_1$ may be a hydrogen atom.

Regarding the substitution positions of the acylacetamide groups in formula (1), in the case where m is 4 and n is 1, the acylacetamide groups are located at the o-position, the m-position, or the p-position. The affinity for phthalocyanine pigments does not depend on the difference in these substitution positions but is the same among the o-position, the m-position, and the p-position. In the case where m is 3 and n is 2, the acylacetamide groups are located at the 1,2,3-positions, the 1,2,4-positions, or the 1,3,5-positions. The affinity for phthalocyanine pigments does not depend on the difference in these substitution positions but is the same among the 1,2,3-positions, the 1,2,4-positions, and the 1,3,5-positions.

Examples of the alkyl groups represented by $R_2$ and $R_3$ in formula (1) include linear, branched, or cyclic alkyl groups such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

The substituents represented by $R_2$ and $R_3$ in formula (1) may be further substituted with a substituent as long as the affinity for phthalocyanine pigments is not significantly impaired. In this case, the substituents represented by $R_2$ and $R_3$ may each be independently substituted with, for example, a halogen atom, a nitro group, an amino group, a hydroxyl group, a cyano group, or a trifluoromethyl group.

Examples of the alkyl groups represented by $R_4$ to $R_6$ in formula (1) include linear, branched, or cyclic alkyl groups such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

Examples of the aralkyl group represented by $R_4$ to $R_6$ in formula (1) include a benzyl group and a phenethyl group.

$R_4$ to $R_6$ in formula (1) can be appropriately selected from the substituents listed above, a hydrogen atom, and a phenyl group.

$Ar_1$ and $Ar_2$ in formula (1) each independently represent an aryl group, and examples of the aryl group include a phenyl group and a naphthyl group. These substituents may be further substituted with a substituent as long as the affinity for phthalocyanine pigments is not significantly impaired. In this case, the substituents represented by $Ar_1$ and $Ar_2$ may each be independently substituted with, for example, an alkyl group, an alkoxy group, a halogen atom, a hydroxyl group, a cyano group, a trifluoromethyl group, a carboxyl group, a carboxylic acid ester group, and a carboxylic acid amide group.

At least one of $R_2$, $R_3$, $Ar_1$, and $Ar_2$ in formula (1) is bound to the polymer portion directly or through a linking group. It is preferably bound to the polymer portion through a linking group. Any one of $R_2$ and $R_3$ bound to the polymer portion independently represents a divalent group, a hydrogen atom of which is removed from the corresponding monovalent group of any one of $R_2$ and $R_3$. Any one of $Ar_1$ and $Ar_2$ bound to the polymer portion independently represents a divalent group, a hydrogen atom of which is removed from the corresponding aryl group of any one of $Ar_1$ and $Ar_2$. In view of the affinity for phthalocyanine pigments, the structure represented by formula (1) may be represented by a structure represented by formula (3) below. Specifically, $Ar_1$ and $Ar_2$ in formula (1) may each be a phenyl group, and at least one hydrogen atom of the phenyl groups may be substituted with a linking group so as to bind to the polymer portion.

Formula (3)

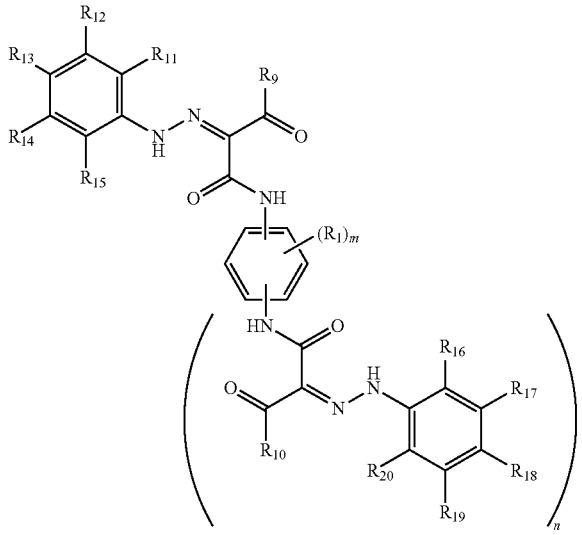

In formula (3), each $R_1$ independently represents the same as $R_1$s in formula (1). $R_9$ and $R_{10}$ independently represent an alkyl group, a phenyl group, an $OR_4$ group, or an $NR_5R_6$ group; $R_4$ to $R_6$ independently represents the same as $R_4$ to $R_6$ in formula (1)). $R_{11}$ to $R_{20}$ independently represent a linking group or a monovalent group selected from the consisting of a hydrogen atom, a $COOR_{21}$ group, a $CONR_{22}R_{23}$ group, an $NHCOR_{24}$ group, and an $OR_{25}$ group. $R_{22}$ to $R_{25}$ each independently represent a hydrogen atom, an alkyl group, an aryl group, or an aralkyl group. However, at least one of $R_{11}$ to $R_{20}$ is the linking group that binds to the polymer portion, m represents an integer of 3 or 4, n represents an integer of 1 or 2, and n+m is 5.

In formula (3), each of $R_{11}$ to $R_{20}$ can be selected from a hydrogen atom, a $COOR_{21}$ group, a $CONR_{22}R_{23}$ group, an $NHCOR_{24}$ group, and an $OR_{25}$ group. In view of the affinity for phthalocyanine pigments, at least one of $R_{11}$ to $R_{20}$ may be a $COOR_{21}$ group or a $CONR_{22}R_{23}$ group.

Examples of the alkyl group represented by $R_{21}$ to $R_{25}$ in formula (3) include linear, branched, or cyclic alkyl groups such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

Examples of the aryl group represented by $R_{21}$ to $R_{25}$ in formula (3) include a phenyl group and a naphthyl group.

Examples of the aralkyl group represented by $R_{21}$ to $R_{25}$ in formula (3) include a benzyl group and a phenethyl group.

$R_{21}$ to $R_{25}$ in formula (3) can be appropriately selected from the substituents listed above and a hydrogen atom. In view of the affinity for phthalocyanine pigments, $R_{21}$ may be a methyl group, $R_{22}$ may be a hydrogen atom, and $R_{23}$ may be a methyl group or a hydrogen atom.

Examples of the alkyl group represented by $R_9$ and $R_{10}$ in formula (3) include linear, branched, or cyclic alkyl groups such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

The substituents represented by $R_9$ and $R_{10}$ in formula (3) may be further substituted with a substituent as long as the affinity for phthalocyanine pigments is not significantly impaired. In this case, the substituents represented by $R_9$ and $R_{10}$ may each be independently substituted with, for example, a halogen atom, a nitro group, an amino group, a hydroxyl group, a cyano group, or a trifluoromethyl group.

$R_9$ and $R_{10}$ in formula (3) can be appropriately selected from the substituents listed above. In view of the affinity for phthalocyanine pigments, $R_9$ and $R_{10}$ may each be a methyl group.

The structure represented by formula (3) may be any of structures represented by formulae (4) to (7) below in view of the affinity for phthalocyanine pigments. Specifically, the structure represented by formula (3) may have a structure in which an azo skeleton structure and a polymer portion are bonded through a linking group L, the structure being represented by any of formulae (4) to (7) below.

Formula (4)

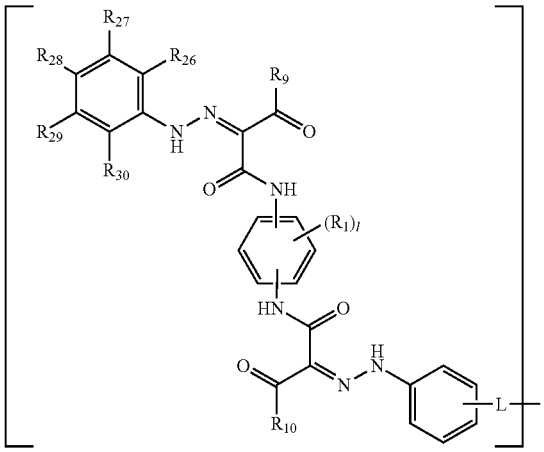

In formula (4), each $R_1$ independently represents the same as $R_1$ in formula (1), $R_9$ and $R_{10}$ represent the same as $R_9$ and $R_{10}$ in formula (3), $R_{26}$ to $R_{30}$ independently represent a hydrogen atom, a $COOR_{21}$ group, a $CONR_{22}R_{23}$ group, an $NHCOR_{24}$ group, or an $OR_{25}$ group; $R_{21}$ to $R_{25}$ represent the same as $R_{21}$ to $R_{25}$ in formula (3), l is 4, and L represents a divalent linking group that binds to the polymer portion.

Formula (5)

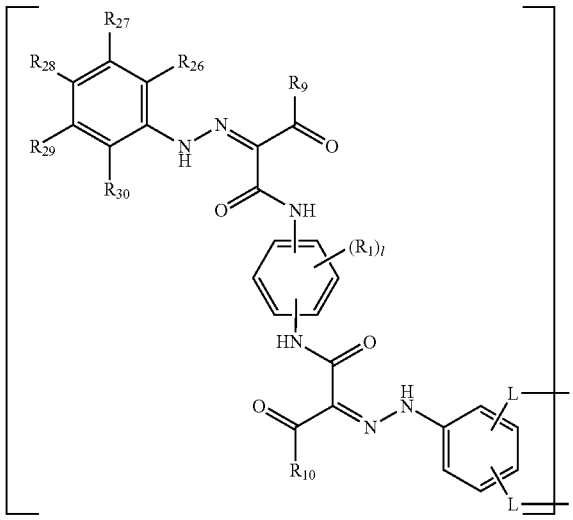

In formula (5), each $R_1$ independently represents the same as $R_1$ in formula (1), $R_9$ and $R_{10}$ represent the same as $R_9$ and $R_{10}$ in formula (3), $R_{26}$ to $R_{30}$ independently represent a hydrogen atom, a $COOR_{21}$ group, a $CONR_{22}R_{23}$ group, an $NHCOR_{24}$ group, or an $OR_{25}$ group; $R_{21}$ to $R_{25}$ represent the same as $R_{21}$ to $R_{25}$ in formula (3), l is 4, and each L represents a divalent linking group that binds to the polymer portion.

Formula (6)

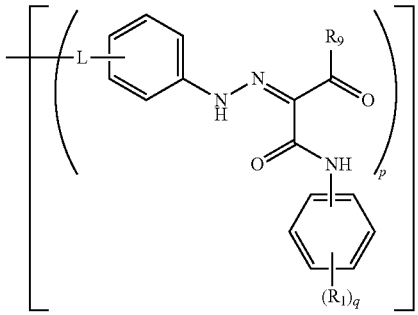

In formula (6), each $R_1$ independently represents the same as $R_1$ in formula (1), $R_9$ represents the same as $R_9$ in formula (3), p represents an integer of 2 or 3, q represents an integer of 3 or 4, p+q is 6, and L represents a divalent linking group that binds to the polymer portion.

Formula (7)

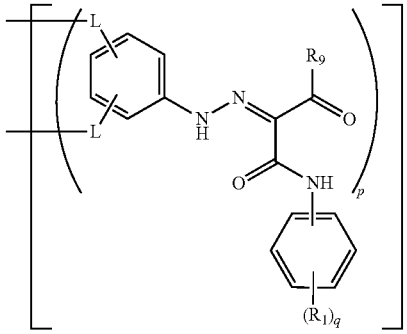

In formula (7), each $R_1$ independently represents the same as $R_1$ in formula (1), $R_9$ represents the same as $R_9$ in formula (3), p represents an integer of 2 or 3, q represents an integer of 3 or 4, p+q is 6, and each L represents a divalent linking group that binds to the polymer portion.

L in formulae (4) to (7) is a divalent linking group and binds the azo skeleton structure to the polymer portion.

In the structures represented by formulae (4) and (6), the azo skeleton structure is bound to the polymer portion through L at one position. In the structures represented by formulas (5) and (7), the azo skeleton structure is bound to the polymer portion through Ls at two positions.

L in formulae (4) to (7) may be any divalent linking group. However, L may have a carboxylic acid ester bond, a carboxylic acid amide bond, or a sulfonic acid ester bond because a reaction that forms any of these linking groups is easily conducted as a reaction for binding the azo skeleton structure to the polymer portion.

Regarding the substitution position of L in formulae (4) to (7), at least one L may be located at the m-position or the p-position with respect to a hydrazo group in view of the affinity for phthalocyanine pigments.

Each of $R_{26}$ to $R_{30}$ in formula (4) or (5) can be selected from a hydrogen atom, a $COOR_{21}$ group, a $CONR_{22}R_{23}$ group, an $NHCOR_{24}$ group, and an $OR_{25}$ group. In view of the affinity for phthalocyanine pigments, at least one of $R_{26}$ to $R_{30}$ may be a $COOR_{21}$ group or a $CONR_{22}R_{23}$ group.

Next, the polymer portion will be described in detail.

Examples of the alkyl group represented by $R_7$ in formula (2) above include linear, branched, or cyclic alkyl groups such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

$R_7$ in formula (2) can be appropriately selected from the substituents listed above and a hydrogen atom. In view of polymerizability of the monomer unit, $R_7$ may be a hydrogen atom or a methyl group.

Examples of the carboxylic acid ester group represented by $R_8$ in formula (2) include, but are not particularly limited to, linear or branched ester groups such as a methyl ester group, an ethyl ester group, a n-propyl ester group, an isopropyl ester group, a n-butyl ester group, an isobutyl ester group, a sec-butyl ester group, a tert-butyl ester group, an octyl ester group, a nonyl ester group, a decyl ester group, an undecyl ester group, a dodecyl ester group, a hexadecyl ester group, an octadecyl ester group, an eicosyl ester group, a docosyl ester group, a 2-ethylhexyl ester group, a phenyl ester group, and a 2-hydroxyethyl ester group.

Examples of the carboxylic acid amide group represented by $R_8$ in formula (2) include linear or branched amide groups such as an N-methylamide group, an N,N-dimethylamide group, an N-ethylamide group, an N,N-diethylamide group, an N-isopropylamide group, an N,N-diisopropylamide group, an N-n-butyramide group, an N,N-di-n-butyramide group, N-isobutyramide group, N,N-diisobutyramide group, N-sec-butyramide group, an N,N-di-sec-butyramide group, an N-tert-butyramide group, an N-octylamide group, an N,N-dioctylamide group, an N-nonylamide group, an N,N-dinonylamide group, an N-decylamide group, an N,N-didecylamide group, an N-undecylamide group, an N,N-diundecylamide group, an N-dodecylamide group, an N,N-didodecylamide group, an N-hexadecylamide group, an N-octadecylamide group, an N-phenylamide group, an N-(2-ethylhexyl)amide group, and an N,N-di(2-ethylhexyl)amide group.

The substituent represented by $R_8$ in formula (2) may be further substituted with a substituent, and the substituent is not particularly limited as long as polymerizability of the monomer unit is not impaired and solubility of the compound having an azo skeleton structure is not significantly decreased. In this case, the substituent represented by $R_8$ may be substituted with, for example, an alkoxy group such as a methoxy group or an ethoxy group; an amino group such as an N-methylamino group or an N,N-dimethylamino group; an acyl group such as an acetyl group; or a halogen atom such as a fluorine atom or a chlorine atom.

$R_8$ in formula (2) can be appropriately selected from the substituents listed above, a phenyl group, and a carboxyl group. In view of dispersibility and compatibility of the compound having an azo skeleton structure to the binder resin of the toner, $R_8$ in formula (2) may be a phenyl group, a carboxylic acid ester group, or a carboxylic acid amide group.

The affinity for a dispersion medium can be controlled by changing the ratio of the monomer unit of the polymer portion, the monomer unit being represented by formula (2). In the case where the dispersion medium is a nonpolar solvent such as styrene, the ratio of the monomer unit in which $R_8$ in formula (2) is a phenyl group may be increased in view of the affinity for the dispersion medium. In the case where the dispersion medium is a solvent having a certain degree of polarity, such as an acrylic acid ester, the ratio of the monomer unit in which $R_8$ in formula (2) is a carboxyl group, a carboxylic acid ester group, or a carboxylic acid amide group may be increased in view of the affinity for the dispersion medium.

Regarding a molecular weight of the polymer portion, the polymer portion preferably has a number-average molecular weight of 500 or more from the standpoint of improving dispersibility of a phthalocyanine pigment. With an increase in the molecular weight, the effect of improving dispersibility of a phthalocyanine pigment increases. However, when the molecular weight is excessively high, the affinity for water-insoluble solvents tends to decrease. Accordingly, the number-average molecular weight of the polymer portion is preferably 200,000 or less. In addition, in view of the ease of production, the number-average molecular weight of the polymer portion is more preferably in the range of 2,000 to 50,000.

As disclosed in PCT Japanese Translation Patent Publication No. 2003-531001, regarding a polyoxyalkylene carbonyl-based dispersant, dispersibility is improved by introducing a branched aliphatic chain into an end of the molecule of the dispersant. Regarding the polymer portion of the present invention, by synthesizing a telechelic polymer portion by, for example, atom transfer radical polymerization (ATRP) described below, a branched aliphatic chain can be introduced into an end of the portion. Thus, dispersibility may be improved by this method.

The substitution positions of an azo skeleton structure in the compound having the azo skeleton structure may be randomly located or unevenly located at an end so that one or a plurality of blocks are formed.

When the number of substitutions of the azo skeleton structure in the compound having the azo skeleton structure is large, a high affinity for phthalocyanine pigments is obtained. However, when the number of substitutions of the azo skeleton structure is excessively large, the affinity for water-insoluble solvents is decreased. Accordingly, the number of substitutions of the azo skeleton structure is preferably in the range of 0.2 to 10, and more preferably 0.2 to 5 relative to 100 monomers that form the polymer portion.

Regarding the azo skeleton structure represented by formula (1) above, tautomers represented by, for example, formulae (9) and (10) below are present, as described below. These tautomers are also within the scope of right of the present invention.

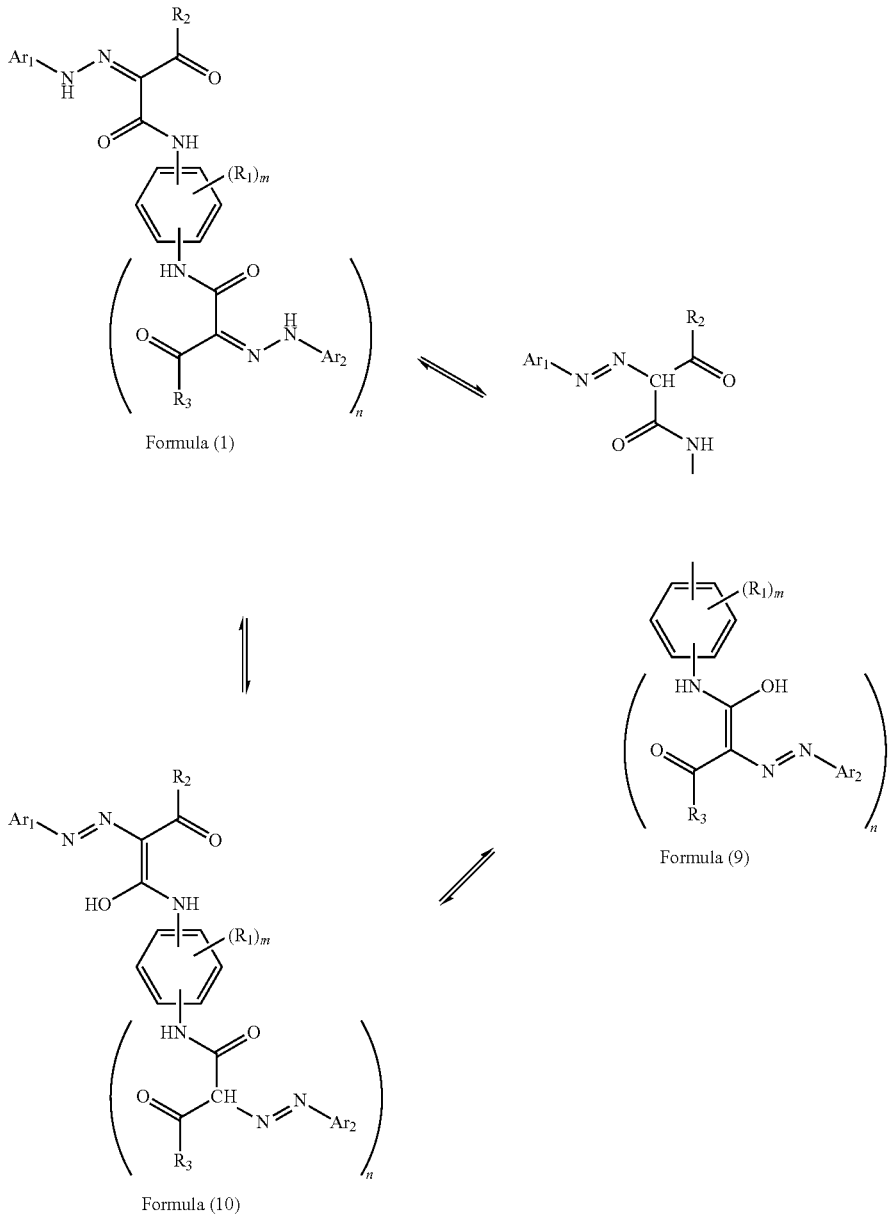

$R_1$ to $R_3$, $Ar_1$, $Ar_2$, m, and n in formulae (9) and (10) are respectively the same as $R_1$ to $R_3$, $Ar_1$, $Ar_2$, m, and n in formula (1).

Examples of the method for synthesizing a compound having an azo skeleton structure include methods described in (i) to (iv) below.

First, method (i) will now be described in detail with reference to an example of the scheme shown below. In method (i), an azo skeleton structure and a polymer portion are respectively synthesized in advance, and these are bound by a condensation reaction or the like to synthesize a compound having an azo skeleton structure.

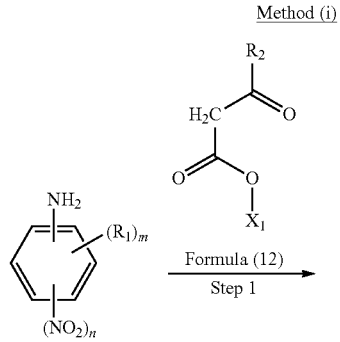

-continued

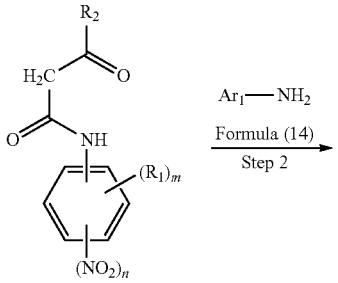

Formula (13)

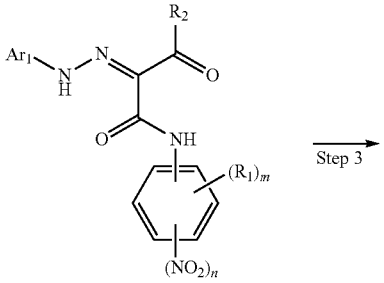

Formula (15)

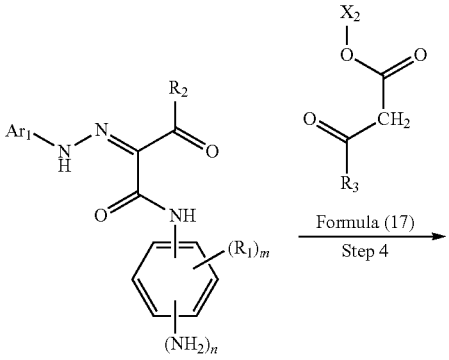

Formula (16)

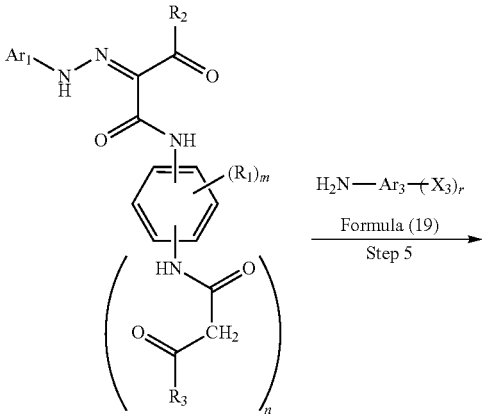

Formula (18)

-continued

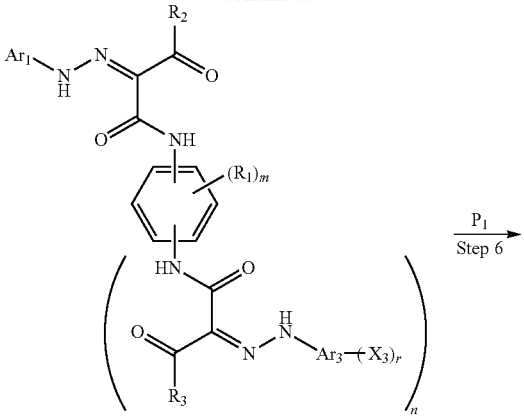

Formula (20)

Compound having azo skeleton structure $R_1$ to $R_3$, $Ar_1$, m, and n in formulae (11) to (20) are respectively the same as $R_1$ to $R_3$, $Ar_1$, m, and n in formula (1). $Ar_3$ in formulae (19) and (20) represents an arylene group. $X_1$ in formula (12) and $X_2$ in formula (17) each represents a leaving group. $P_1$ represents a polymer portion having the monomer unit represented by formula (2) above. $X_3$ in formulae (19) and (20) represents a substituent that reacts with $P_1$ to form the divalent linking group L, and r represents an integer of 1 or 2.

In the scheme exemplified above, the compound having an azo skeleton structure can be synthesized by step 1 of amidating a nitroaniline derivative represented by formula (11) and an acetoacetic acid analogue represented by formula (12) to synthesize an intermediate product (13), which is an acylacetanilide analogue; step 2 of conducting diazo coupling of the intermediate product (13) with an aniline derivative (14) to synthesize an azo compound (15); step 3 of reducing a nitro group in the azo compound (15) to synthesize an intermediate product (16), which is an aniline analogue; step 4 of amidating the intermediate product (16) and an acetoacetic acid analogue represented by formula (17) to synthesize an intermediate product (18), which is an acylacetanilide analogue; step 5 of conducting diazo coupling of the intermediate product (18) with an aniline derivative (19) to synthesize an azo compound (20); and step 6 of binding the azo skeleton to the polymer portion $P_1$ by a condensation reaction or the like.

First, step 1 will be described. In step 1, a known method can be employed (for example, Datta E. Ponde, and four other authors, "The Journal of Organic Chemistry", (US), American Chemical Society, 1998, Vol. 63, No. 4, pp. 1058-1063). In the case where $R_2$ in formula (13) is a methyl group, the synthesis can be conducted by a method using diketene instead of using the raw material (12) (for example, Kiran Kumar Solingapuram Sai, and two other authors, "The Journal of Organic Chemistry", (US), American Chemical Society, 2007, Vol. 72, No. 25, pp. 9761-9764).

The nitroaniline derivative (11) and the acetoacetic acid analogue (12) are each commercially available as various types of compounds, and easily available. Alternatively, these can be easily synthesized by known methods.

Although this step may be performed without using a solvent, the step may be performed in the presence of a solvent in order to prevent a rapid progress of the reaction. The solvent is not particularly limited as long as the solvent does not inhibit the reaction. Examples thereof include alcohols such as methanol, ethanol, and propanol; esters such as methyl acetate, ethyl acetate, and propyl acetate; ethers such as diethyl ether, tetrahydrofuran, and dioxane; hydrocarbons such as benzene, toluene, xylene, hexane, and heptane; halogenated hydrocarbons such as dichloromethane, dichloroethane, and chloroform; amides such as N,N-dimethylformamide, N-methylpyrrolidone, and N,N-dimethylimidazolidinone; nitriles such as acetonitrile and propionitrile; acids such as formic acid, acetic acid, and propionic acid; and water. These solvents may be used as a mixture of two or more solvents, and the mixing ratio when the solvents are mixed can be appropriately determined in accordance with the solubility of the compounds used. The amount of solvent used can be appropriately determined. However, the amount of solvent is preferably in the range of 1.0 to 20 times the mass of the compound represented by formula (11) in view of the reaction rate.

This step is usually performed in the temperature range of 0° C. to 250° C., and usually completed within 24 hours.

Next, step 2 will be described. In step 2, a known method can be employed. Specifically, for example, the following method may be employed. First, the aniline derivative (14) is allowed to react with a diazotizing agent such as sodium nitrite or nitrosylsulfuric acid in a methanol solvent in the presence of an inorganic acid such as hydrochloric acid or sulfuric acid to synthesize a corresponding diazonium salt. The diazonium salt is further coupled with the intermediate product (13) to synthesize the azo compound (15).

The aniline derivative (14) is commercially available as various types of compounds, and easily available. Alternatively, the aniline derivative (14) can be easily synthesized by a known method.

Although this step may be performed without using a solvent, the step may be performed in the presence of a solvent in order to prevent a rapid progress of the reaction. The solvent is not particularly limited as long as the solvent does not inhibit the reaction. Examples thereof include alcohols such as methanol, ethanol, and propanol; esters such as methyl acetate, ethyl acetate, and propyl acetate; ethers such as diethyl ether, tetrahydrofuran, and dioxane; hydrocarbons such as benzene, toluene, xylene, hexane, and heptane; halogenated hydrocarbons such as dichloromethane, dichloroethane, and chloroform; amides such as N,N-dimethylformamide, N-methylpyrrolidone, and N,N-dimethylimidazolidinone; nitriles such as acetonitrile and propionitrile; acids such as formic acid, acetic acid, and propionic acid; and water. These solvents may be used as a mixture of two or more solvents, and the mixing ratio when the solvents are mixed can be appropriately determined in accordance with the solubility of the compounds used. The amount of solvent used can be appropriately determined. However, the amount of solvent is preferably in the range of 1.0 to 20 times the mass of the compound represented by formula (14) in view of the reaction rate.

This step is usually performed in the temperature range of −50° C. to 100° C., and usually completed within 24 hours.

Next, step 3 will be described. In step 3, a known method can be employed (as a method of using a metal compound or the like, for example, a method described in "Jikken Kagaku Kouza (Experimental Chemistry Course)", published by Maruzen Co., Ltd., First edition, Vol. 17-2, pp. 162-179 can be employed, and as a method of catalytic hydrogenation, for example, a method described in "Jikken Kagaku Kouza (Experimental Chemistry Course)", published by Maruzen Co., Ltd., First edition, Vol. 15, pp. 390-448, or International Publication No. 2009/060886 pamphlet can be employed).

Although this step may be performed without using a solvent, the step may be performed in the presence of a solvent in order to prevent a rapid progress of the reaction. The solvent is not particularly limited as long as the solvent does not inhibit the reaction. Examples thereof include alcohols such as methanol, ethanol, and propanol; esters such as methyl acetate, ethyl acetate, and propyl acetate; ethers such as diethyl ether, tetrahydrofuran, and dioxane; hydrocarbons such as benzene, toluene, xylene, hexane, and heptane; and amides such as N,N-dimethylformamide, N-methylpyrrolidone, and N,N-dimethylimidazolidinone. These solvents may be used as a mixture of two or more solvents, and the mixing ratio when the solvents are mixed can be appropriately determined. The amount of solvent used can be appropriately determined in accordance with the solubility of the compound used. However, the amount of solvent is preferably in the range of 1.0 to 20 times the mass of the compound represented by formula (15) in view of the reaction rate.

This step is usually performed in the temperature range of 0° C. to 250° C., and usually completed within 24 hours.

Next, step 4 will be described. In step 4, the intermediate product (18), which is an acylacetanilide analogue, can be synthesized by a method similar to the method used in step 1 described above.

Next, step 5 will be described. In step 5, the azo compound (20) can be synthesized by a method similar to the method used in step 2 described above.

The aniline derivative (19) is commercially available as various types of compounds, and easily available. Alternatively, the aniline derivative (19) can be easily synthesized by a known method.

Next, a method for synthesizing the polymer portion $P_1$ used in step 6 will be described. In the synthesis of the polymer portion $P_1$, a known polymerization method can be employed (for example, Krzysztof Matyjaszewski, and one other author, "Chemical Reviews", (US), American Chemical Society, 2001, Vol. 101, pp. 2921-2990).

Specific examples of the polymerization method include radical polymerization, cationic polymerization, and anionic polymerization. In view of the ease of production, radical polymerization may be used.

Radical polymerization can be conducted by the use of a radical polymerization initiator; irradiation with radiation, a laser beam, or the like; the use of a photopolymerization initiator in combination with irradiation with light; heating; or the like.

The radical polymerization initiator is not particularly limited as long as it generates a radical and can initiate a polymerization reaction, and is selected from compounds that generate a radical by an action of heat, light, radiation, a redox reaction, or the like. Examples of the radical polymerization initiator include azo compounds, organic peroxides, inorganic peroxides, organometallic compounds, and photopolymerization initiators. More specifically, examples thereof include azo polymerization initiators such as 2,2'-azobis(isobutyronitrile), 2,2'-azobis(2-methylbutyronitrile), 2,2'-azobis(4-methoxy-2,4-dimethylvaleronitrile), and 2,2'-azobis(2,4-dimethylvaleronitrile); organic peroxide polymerization initiators such as benzoyl peroxide, di-tert-butyl peroxide, tert-butylperoxyisopropyl carbonate, tert-hexyl peroxybenzoate, and tert-butyl peroxybenzoate; inorganic peroxide polymerization initiators such as potassium persulfate and ammonium persulfate; and redox initiators such as hydrogen peroxide-ferrous compound, benzoyl peroxide (BPO)-dimethylaniline, and cerium (IV) salt-alcohol. Examples of the photopolymerization initiators include benzophenones, benzoin ethers, acetophenones, and thioxanthones. These radical polymerization initiators may be used in combination of two or more initiators.

The amount of polymerization initiator used is preferably controlled in the range of 0.1 to 20 parts by mass relative to 100 parts by mass of a monomer so as to provide a copolymer having a target molecular weight distribution.

The polymer portion represented by $P_1$ can be produced by any one of methods of solution polymerization, suspension polymerization, emulsion polymerization, dispersion polymerization, precipitation polymerization, bulk polymerization, and the like, and the method is not particularly limited. However, solution polymerization in a solvent that can dissolve components used in the production is suitably used. Specific examples of the solvent that can be used include polar organic solvents such as alcohols, e.g., methanol, ethanol, and 2-propanol, ketones, e.g., acetone and methyl ethyl ketone, ethers, e.g., tetrahydrofuran and diethyl ether, ethylene glycol monoalkyl ethers and acetates thereof, propylene glycol monoalkyl ethers and acetates thereof, and diethylene glycol monoalkyl ethers; and in some cases, nonpolar solvents such as toluene and xylene. These solvents may be used alone or as a mixture thereof. Among these, solvents having a boiling point in the range of 100° C. to 180° C. are preferably used alone or as a mixture thereof.

A suitable polymerization temperature range varies depending on the type of initiator used, and is not particularly limited. Specifically, the polymerization is usually performed in the range of −30° C. to 200° C., and preferably in the range of 40° C. to 180° C.

The molecular-weight distribution and the molecular structure of the polymer portion represented by $P_1$ can be controlled by known methods. Specifically, the polymer portion represented by $P_1$ having a controlled molecular-weight distribution and a controlled molecular structure can be produced by, for example, a method in which an addition-cleavage-type chain transfer agent is used (refer to, Japanese Patent Nos. 4254292 and 3721617); a nitroxide-mediated polymerization (NMP) method in which dissociation and bonding of an amine-oxide radical is used (for example, Craig J. Hawker, and two other authors, "Chemical Reviews", (US), American Chemical Society, 2001, Vol. 101, pp. 3661-3688); an atom transfer radical polymerization (ATRP) method in which polymerization is conducted in the presence of a metal catalyst and a ligand using a halogen compound as a polymerization initiator (for example, Masami Kamigaito, and two other authors, "Chemical Reviews", (US), American Chemical Society, 2001, Vol. 101, pp. 3689-3746); a reversible addition-fragmentation chain transfer (RAFT) method in which a dithiocarboxylic acid ester, a xanthate compound, or the like is used as a polymerization initiator (for example, PCT Japanese Translation Patent Publication No. 2000-515181); a macromolecular design via interchange of xanthate (MADIX) method (for example, International Publication No. 99/05099 pamphlet); or a degenerative transfer (DT) method (for example, Atsushi Goto, and six other authors, "Journal of The American Chemical Society", (US), American Chemical Society, 2003, Vol. 125, pp. 8720-8721).

Next, step 6 will be described. In step 6, a known method can be employed. Specifically, for example, by using a polymer portion $P_1$ having a carboxyl group and an azo compound (20) in which $X_3$ is a substituent having a hydroxyl group, it is possible to synthesize a compound having an azo skeleton structure in which the linking group L has a carboxylic acid ester bond. By using a polymer portion $P_1$ having a hydroxyl group and an azo compound (20) in which $X_3$ is a substituent having a sulfonic acid group, it is possible to synthesize a compound having an azo skeleton structure in which the linking group L has a sulfonic acid ester bond. Furthermore, by using a polymer portion $P_1$ having a carboxyl group and an azo compound (20) in which $X_3$ is a substituent having an amino group, it is possible to synthesize a compound having an azo skeleton structure in which the linking group L has a carboxylic acid amide bond. Specific examples of the method include a method in which a dehydration-condensation agent such as 1-ethyl-3-(3-dimethylaminopropyl)carbodiimide hydrochloride is used (for example, Melvin S. Newman, and one other author, "The Journal of Organic Chemistry", (US), American Chemical Society, 1961, Vol. 26, No. 7, pp. 2525-2528) and a Schotten-Baumann method (for example, Norman O. V. Sonntag, "Chemical Reviews", (US), American Chemical Society, 1953, Vol. 52, No. 2, pp. 237-416).

Although this step may be performed without using a solvent, the step may be performed in the presence of a solvent in order to prevent a rapid progress of the reaction. The solvent is not particularly limited as long as the solvent does not inhibit the reaction. Examples thereof include ethers such as diethyl ether, tetrahydrofuran, and dioxane; hydrocarbons such as benzene, toluene, xylene, hexane, and heptane; halogenated hydrocarbons such as dichloromethane, dichloroethane, and chloroform; amides such as N,N-dimethylformamide, N-methylpyrrolidone, and N,N-dimethylimidazolidinone; and nitriles such as acetonitrile and propionitrile. These solvents may be used as a mixture of two or more solvents, and the mixing ratio when the solvents are mixed can be appropriately determined in accordance with the solubility of the compounds used. The amount of solvent used can be appropriately determined. However, the amount of solvent is preferably in the range of 1.0 to 20 times the mass of the compound represented by formula (20) in view of the reaction rate.

This step is usually performed in the temperature range of 0° C. to 250° C., and usually completed within 24 hours.

Next, method (ii) will now be described in detail with reference to an example of the scheme shown below. In method (ii), an azo compound having a polymerizable functional group is synthesized in advance and the azo compound is copolymerized with a polymerizable monomer that forms a monomer unit represented by formula (2) above to synthesize the compound having the azo skeleton structure.

Method (ii)

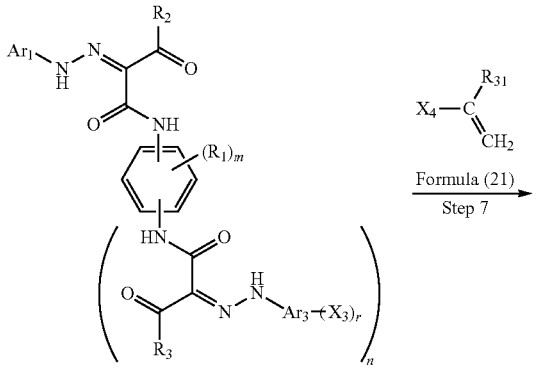

Formula (20)

-continued

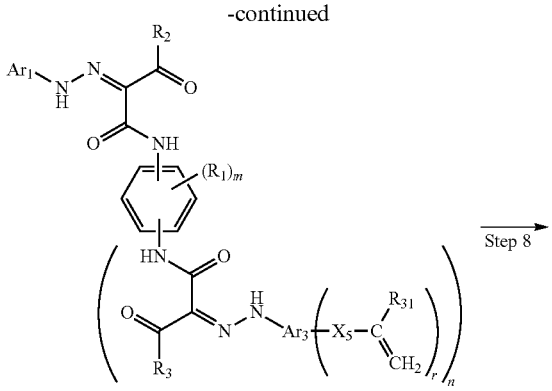

Method (iii)

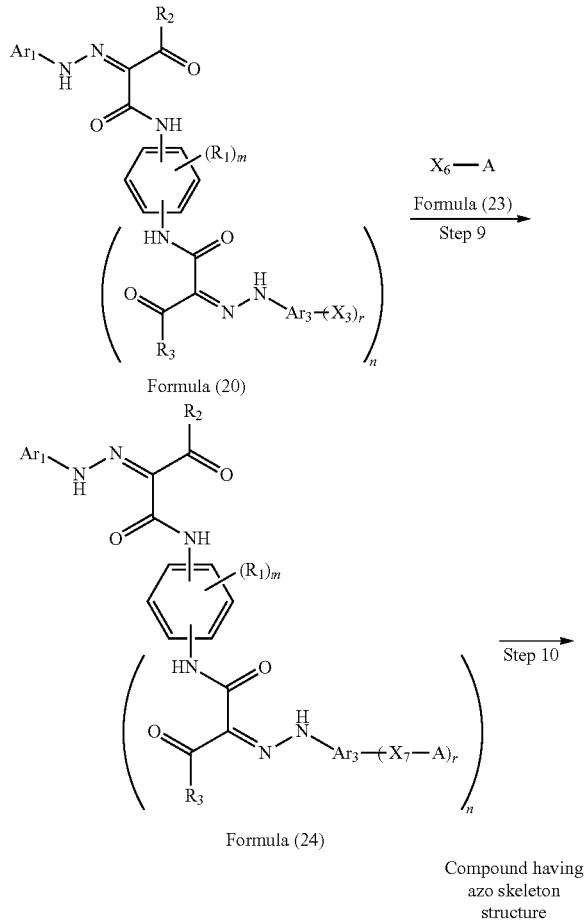

$R_1$ to $R_3$, $Ar_1$, $Ar_3$, $X_3$, m, n, and r in formula (20) are respectively the same as $R_1$ to $R_3$, $Ar_1$, $Ar_3$, $X_3$, m, n, and r in formula (20) in the scheme of method (i) described above. In formula (21), $R_{31}$ represents a hydrogen atom or an alkyl group and $X_4$ represents a substituent that reacts with $X_3$ in formula (20) to form $X_5$ in formula (22). $R_1$ to $R_3$, $R_{31}$, $Ar_1$, $Ar_2$, m, n, and r in formula (22) are the same as those in formulae (20) and (21), and $X_5$ represents the divalent linking group L formed by a reaction between $X_3$ in formula (20) and $X_4$ in formula (21).

In the scheme exemplified above, the compound having an azo skeleton structure is synthesized by step 7 of allowing an azo compound (20) to react with a vinyl group-containing compound represented by formula (21) to synthesize an azo compound (22) having a polymerizable functional group; and step 8 of copolymerizing the azo compound (22) having a polymerizable functional group with a polymerizable monomer that forms a monomer unit represented by formula (2) above.

First, step 7 will be described. In step 7, the azo compound (22) having a polymerizable functional group can be synthesized by a method similar to the method used in step 6 of method (i).

The vinyl group-containing compound (21) is commercially available as various types of compounds, and easily available. Alternatively, the vinyl group-containing compound (21) can be easily synthesized by a known method.

Next, step 8 will be described. In step 8, the azo compound represented by formula (22) is copolymerized with the polymerizable monomer that forms a monomer unit represented by formula (2) above using the method for synthesizing the polymer portion $P_1$ of method (i). Thus, the compound having an azo skeleton structure can be synthesized.

Next, method (iii) will now be described in detail with reference to an example of the scheme shown below. In method (iii), an azo compound having a halogen atom is synthesized in advance, and a polymerizable monomer that forms the monomer unit represented by formula (2) above is polymerized using the azo compound as a polymerization initiator to synthesize the compound having an azo skeleton structure.

$R_1$ to $R_3$, $Ar_1$, $Ar_3$, $X_3$, m, n, and r in formula (20) are respectively the same as $R_1$ to $R_3$, $Ar_1$, $Ar_3$, $X_3$, m, n, and r in formula (20) in the scheme of method (i) described above. In formula (23), $X_6$ represents a substituent that reacts with $X_3$ in formula (20) to form $X_7$ in formula (24), and A represents a chlorine atom, a bromine atom, or an iodine atom. $R_1$ to $R_3$, $Ar_1$, $Ar_3$, m, n, and r in formula (24) are the same as those in formula (20), and $X_7$ represents the divalent linking group L formed by a reaction between $X_3$ in formula (20) and $X_6$ in formula (23).

In the scheme exemplified above, the compound having an azo skeleton structure is synthesized by step 9 of allowing an azo compound (20) to react with a halogen atom-containing compound represented by formula (23) to synthesize an azo compound (24) having a halogen atom; and step 10 of polymerizing a polymerizable monomer that forms the monomer unit represented by formula (2) using, as a polymerization initiator, the azo compound (24) having a halogen atom.

First, step 9 will be described. In step 9, the azo compound (24) having a halogen atom can be synthesized by a method similar to the method used in step 6 of method (i). Specifically, for example, by using a halogen atom-containing compound (23) having a carboxyl group and an azo compound (20) in which $X_3$ is a substituent having a hydroxyl group, it is possible to synthesize a halogen atom-containing azo skeleton structure (i.e., azo compound) (24) in which the linking group L has a structure having a carboxylic acid ester bond. By using a halogen atom-containing compound (23) having a hydroxyl group and an azo compound (20) in which $X_3$ is a substituent having a sulfonic acid group, it is possible to synthesize a halogen atom-containing azo skeleton structure (24) in which the linking group L has a structure having a sulfonic acid ester bond. Furthermore, by using a halogen atom-containing compound (23) having a carboxyl group and an azo compound (20) in which $X_3$ is a substituent having an amino group, it is possible to synthesize a halogen atom-containing azo skeleton structure (24) in which the linking group L has a structure having a carboxylic acid amide bond.

Examples of the halogen atom-containing compound (23) having a carboxyl group include chloroacetic acid, α-chloropropionic acid, α-chlorobutyric acid, α-chloroisobutyric acid, α-chlorovaleric acid, α-chloroisovaleric acid, α-chlorocaproic acid, α-chlorophenylacetic acid, α-chlorodiphenylacetic acid, α-chloro-α-phenylpropionic acid, α-chloro-β-phenylpropionic acid, bromoacetic acid, α-bromopropionic acid, α-bromobutyric acid, α-bromoisobutyric acid, α-bromovaleric acid, α-bromoisovaleric acid, α-bromocaproic acid, α-bromophenylacetic acid, α-bromodiphenylacetic acid, α-bromo-α-phenylpropionic acid, α-bromo-β-phenylpropionic acid, iodoacetic acid, α-iodopropionic acid, α-iodobutyric acid, α-iodoisobutyric acid, α-iodovaleric acid, α-iodoisovaleric acid, α-iodocaproic acid, α-iodophenylacetic acid, α-iododiphenylacetic acid, α-iodo-α-phenylpropionic acid, α-iodo-β-phenylpropionic acid, β-chlorobutyric acid, β-bromoisobutyric acid, iodomethyl methyl benzoic acid, and 1-chloroethyl benzoic acid. Halides and anhydrides of these acids may also be used in the present invention.

Examples of the halogen atom-containing compound (23) having a hydroxyl group include 1-chloroethanol, 1-bromoethanol, 1-iodoethanol, 1-chloropropanol, 2-bromopropanol, 2-chloro-2-propanol, 2-bromo-2-methylpropanol, 2-phenyl-1-bromoethanol, and 2-phenyl-2-iodoethanol.

Next, step 10 will be described. In step 10, a polymerizable monomer that forms the monomer unit represented by formula (2) is polymerized by the ATRP method in method (i) in the presence of a metal catalyst and a ligand using the halogen atom-containing azo skeleton structure (24) as a polymerization initiator. Thus, the compound having an azo skeleton structure can be synthesized.

The metal catalyst used in the ATRP method is not particularly limited, but may be at least one transition metal selected from groups 7 to 11 in the periodic table. In redox catalysts (redox conjugate complexes) in which a low-valent complex and a high-valent complex are reversibly changed, specific examples of a low-valent metal include metals selected from the group consisting of $Cu^+$, $Ni^0$, $Ni^+$, $Ni^{2+}$, $Pd^0$, $Pd^+$, $Pt^0$, $Pt^{2+}$, $Rh^+$, $Rh^{2+}$, $Rh^{3+}$, $Co^+$, $Co^{2+}$, $Ir^0$, $Ir^+$, $Ir^{2+}$, $Ir^{3+}$, $Fe^{2+}$, $Ru^{2+}$, $Ru^{3+}$, $Ru^{4+}$, $Ru^{5+}$, $Os^{2+}$, $Os^{3+}$, $Re^{2+}$, $Re^{3+}$, $Re^{4+}$, $Re^{6+}$, $Mn^{2+}$, and $Mn^{3+}$. Among these, $Cu^+$, $Ru^{2+}$, $Fe^{2+}$, and $Ni^{2+}$ are preferable, and $Cu^+$ is particularly preferable from the standpoint that the material can be easily available. As a monovalent copper compound, for example, cuprous chloride, cuprous bromide, cuprous iodide, and cuprous cyanide can be suitably used.

Organic ligands are usually used as the ligand in the ATRP method. Specific examples thereof include 2,2'-bipyridyl and derivatives thereof, 1,10-phenanthroline and derivatives thereof, N,N,N',N'-tetramethylethylenediamine, N,N,N',N'',N''-pentamethyldiethylenetriamine, tris[2-(dimethylamino)ethyl]amine, triphenylphosphine, and tributylphosphine. In view of the ease of production, aliphatic polyamines such as N,N,N',N'',N''-pentamethyldiethylenetriamine are particularly suitable.

Next, method (iv) will now be described in detail with reference to an example of the scheme shown below. In method (iv), a polymer portion having at least one monomer unit among monomer units represented by formula (2) above, the monomer units being bonded to an aryl group having an amino group, and an intermediate product, which is an acylacetanilide analogue, are respectively synthesized in advance, and these compounds are subjected to diazo coupling to synthesize a compound having an azo skeleton structure.

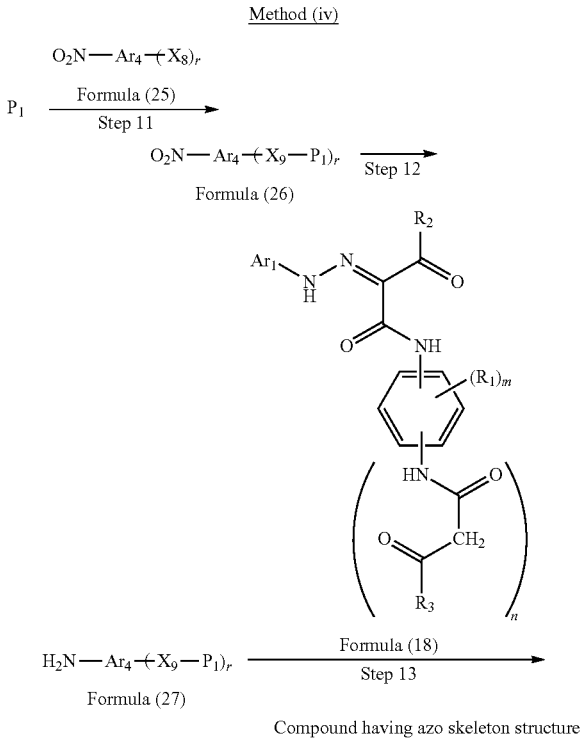

$P_1$ is the same as $P_1$ in the scheme of method (i). $R_1$ to $R_3$, $Ar_1$, m, and n in formula (18) are respectively the same as $R_1$ to $R_3$, $Ar_1$, m, and n in formula (18) in the scheme of method (i) described above. $Ar_4$ in formulae (25) to (27) represents an arylene group. $X_8$ in formula (25) represents a substituent that reacts with $P_1$ to form $X_9$ in formula (26), and r represents 1 or 2. $X_9$ in formulae (26) and (27) represents the divalent linking group L formed by a reaction between $X_8$ in formula (25) and $P_1$.

In the scheme exemplified above, the compound having an azo skeleton structure is synthesized by step 11 of introducing a nitro group-containing arylene group (25) into a polymer portion $P_1$ to synthesize a polymer portion (26) having a nitro group-containing arylene group; step 12 of reducing the polymer portion (26) having a nitro group-containing arylene group to synthesize a polymer portion (27) having an amino group-containing arylene group; and step 13 of conducting diazo coupling of the polymer portion (27) having an amino group-containing arylene group with an intermediate product (18), which is an acylacetanilide analogue.

First, step 11 will be described. In step 11, the polymer portion (26) having a nitro group-containing arylene group can be synthesized by a method similar to the method used in step 6 of method (i). Specifically, for example, by allowing a polymer portion $P_1$ having a carboxyl group to react with a nitro group-containing arylene group (25) in which $X_8$ is a substituent having a hydroxyl group, it is possible to synthesize a polymer portion (26) which has a nitro group-containing arylene group and in which the linking group has a carboxylic acid ester bond. By allowing a polymer portion $P_1$ having a hydroxyl group to react with a nitro group-containing arylene group (25) in which $X_8$ is a substituent having a sulfonic acid group, it is possible to synthesize a polymer portion (26) which has a nitro group-containing arylene group and in which the linking group has a sulfonic acid ester bond. Furthermore, by allowing a polymer portion $P_1$ having a carboxyl group to react with a nitro group-containing arylene group (25) in which $X_8$ is a substituent having an amino group, it is possible to synthesize a polymer portion (26) which has a nitro group-containing arylene group and in which the linking group has a carboxylic acid amide bond.

The compound represented by formula (25) is commercially available as various types of compounds, and easily available. Alternatively, the compound represented by formula (25) can be easily synthesized by a known method.

Next, step 12 will be described. In step 12, the polymer portion (27) having an amino group-containing arylene group can be synthesized by a method similar to the method used in step 3 of method (i).

Next, step 13 will be described. In step 13, the compound having an azo skeleton structure can be synthesized by a method similar to the method used in step 2 of method (i).

The compounds each having an azo skeleton structure, the compounds being obtained in the steps of the synthesis methods exemplified above, and the compounds represented by formulae (13), (15), (16), (18), (20), (22), (24), (26), and (27) can be purified by common methods for isolation and purification of organic compounds. Examples of the isolation and purification methods include a recrystallization method and a reprecipitation method that use an organic solvent, and column chromatography using silica gel or the like. These compounds can be obtained in high purities by purifying the compounds using these methods alone or in combination of two or more methods.

Identification and measurement of the purity of the compounds represented by formulae (13), (15), (16), (18), (20), (22), and (24), the compounds being obtained in the steps of the synthesis methods exemplified above, are conducted by nuclear magnetic resonance (NMR) spectrometry (ECA-400, manufactured by JEOL Ltd.), electrospray ionization time-of flight mass spectroscopy (ESI-TOF MS) (LC/MSD TOF, manufactured by Agilent Technologies, Inc.), and high-performance liquid chromatography (HPLC) (LC-20A, manufactured by Shimadzu Corporation).

Identification and measurement of the molecular weight of the compounds each having an azo skeleton structure, the compounds being obtained by the synthesis methods exemplified above, and the compounds represented by formulae (26) and (27) are conducted by size exclusion chromatography (SEC) (HLC8220GPC, manufactured by Tosoh Corporation), nuclear magnetic resonance spectrometry (ECA-400, manufactured by JEOL Ltd.), and a measurement of the acid value according to JIS K-0070 (automatic titrator COM-2500, manufactured by Hiranuma Sangyo Corporation).

Next, a binder resin in a toner of the present invention will be described.

Examples of the binder resin in a toner of the present invention include styrene-methacrylic acid copolymers, styrene-acrylic acid copolymers, polyester resins, epoxy resins, and styrene-butadiene copolymers, all of which are commonly used therefor. In a method of obtaining toner particles directly by a polymerization method, a monomer for forming the toner particles is used. Specifically, monomers that are suitably used are styrene monomers such as styrene, α-methylstyrene, α-ethylstyrene, o-methylstyrene, m-methylstyrene, p-methylstyrene, o-ethylstyrene, m-ethylstyrene, and p-ethylstyrene; methacrylate monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylamide; acrylate monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylamide; and olefin monomers such as butadiene, isoprene, and cyclohexene. These monomers are used alone, or suitably mixed and used so that the theoretical glass transition temperature (Tg) is in the range of 40° C. to 75° C. (refer to "Polymer Handbook" edited by J. Brandrup and E. H. Immergut, (US), Third edition, John Wiley & Sons, 1989, pp. 209-277). When the theoretical glass transition temperature is lower than 40° C., problems tend to occur in terms of storage stability and durability of the toner. In contrast, when the theoretical glass transition temperature exceeds 75° C., transparency decreases in the formation of full-color images using the toner.

Regarding the binder resin in the toner of the present invention, the distribution of additives such as a colorant, a charge control agent, and a wax in the toner can be controlled by using a polar resin such as a polyester resin or a polycarbonate resin in combination with a nonpolar resin such as polystyrene. For example, in the case where toner particles are produced directly by a suspension polymerization method or the like, the polar resin is added during the polymerization reaction ranging from a dispersion step to a polymerization step. The polar resin is added in accordance with the balance between the polarity of the monomer unit composition to be formed into toner particles and the polarity of an aqueous medium. As a result, the polar resin concentration can be controlled so as to continuously vary from a surface of a toner particle to the center thereof, for example, to form a thin layer of the polar resin on the surface of the toner particle. In this case, by using a polar resin that interacts with the compound having an azo skeleton structure, a colorant, and a charge control agent, the presence state of the colorant in the toner particles can be made to be a desirable form.

A phthalocyanine pigment represented by formula (8) below can be suitably used as the colorant in the toner of the present invention.

Formula (8)

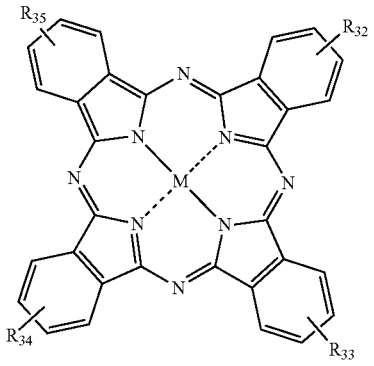

In formula (8), $R_{32}$ to $R_{35}$ each independently represent hydrogen, an alkyl group, or a sulfonic acid group or a salt thereof, and M represents a metal or a hydrogen atom.

Examples of the phthalocyanine pigment represented by formula (8) include C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 15:5, C. I. Pigment Blue 15:6, C. I. Pigment Blue 16, C. I. Pigment Blue 17, C. I. Pigment Blue 17:1, C. I. Pigment Blue 68, C. I. Pigment Blue 70, C. I. Pigment Blue 75, C. I. Pigment Blue 76, and C. I. Pigment Blue 79. In particular, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 15:5, and C. I. Pigment Blue 15:6, all of which are represented by formula (28) below, are suitable because the dispersion effect achieved by the compound having an azo skeleton structure is high.

Formula (28)

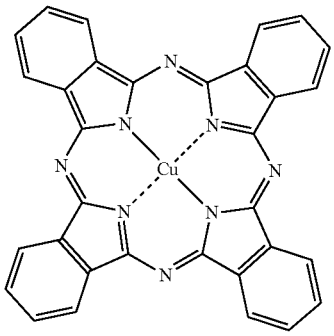

The above phthalocyanine pigments may be used alone or as a mixture of two or more pigments. In the case where two or more phthalocyanine pigments are mixed, it is sufficient that at least one type of phthalocyanine pigment is contained.

These may be crude pigments or prepared pigment compositions as long as the effect achieved by the compound having an azo skeleton structure is not significantly impaired.

A mass composition ratio of the phthalocyanine pigment to the compound having an azo skeleton structure in the toner of the present invention is preferably in the range of 100:0.1 to 100:100.

The above phthalocyanine pigment is used as a colorant in the toner of the present invention. However, for the purpose of adjusting the color tone, other colorants may be used in combination as long as the dispersibility of the phthalocyanine pigment is not impaired.

Existing cyan colorants can be used in combination. Examples of the cyan colorants that can be used in combination include C. I. Pigment Blue 1, C. I. Pigment Blue 1:2, C. I. Pigment Blue 1:3, C. I. Pigment Blue 2, C. I. Pigment Blue 2:1, C. I. Pigment Blue 2:2, C. I. Pigment Blue 3, C. I. Pigment Blue 4, C. I. Pigment Blue 5, C. I. Pigment Blue 6, C. I. Pigment Blue 7, C. I. Pigment Blue 8, C. I. Pigment Blue 9, C. I. Pigment Blue 9:1, C. I. Pigment Blue 10, C. I. Pigment Blue 10:1, C. I. Pigment Blue 11, C. I. Pigment Blue 12, C. I. Pigment Blue 13, C. I. Pigment Blue 14, C. I. Pigment Blue 18, C. I. Pigment Blue 19, C. I. Pigment Blue 20, C. I. Pigment Blue 21, C. I. Pigment Blue 22, C. I. Pigment Blue 23, C. I. Pigment Blue 24, C. I. Pigment Blue 24:1, C. I. Pigment Blue 25, C. I. Pigment Blue 26, C. I. Pigment Blue 27, C. I. Pigment Blue 28, C. I. Pigment Blue 29, C. I. Pigment Blue 30, C. I. Pigment Blue 31, C. I. Pigment Blue 32, C. I. Pigment Blue 33, C. I. Pigment Blue 34, C. I. Pigment Blue 35, C. I. Pigment Blue 36, C. I. Pigment Blue 36:1, C. I. Pigment Blue 52, C. I. Pigment Blue 53, C. I. Pigment Blue 56, C. I. Pigment Blue 56:1, C. I. Pigment Blue 57, C. I. Pigment Blue 58, C. I. Pigment Blue 59, C. I. Pigment Blue 60, C. I. Pigment Blue 61, C. I. Pigment Blue 61:1, C. I. Pigment Blue 62, C. I. Pigment Blue 63, C. I. Pigment Blue 64, C. I. Pigment Blue 65, C. I. Pigment Blue 66, C. I. Pigment Blue 67, C. I. Pigment Blue 69, C. I. Pigment Blue 71, C. I. Pigment Blue 72, C. I. Pigment Blue 73, C. I. Pigment Blue 74, C. I. Pigment Blue 77, C. I. Pigment Blue 78, C. I. Pigment Blue 80, C. I. Pigment Blue 81, C. I. Pigment Blue 82, C. I. Pigment Blue 83, and C. I. Pigment Blue 84.

In order to adjust the color tone, colorants other than cyan colorants may be used. For example, the color purity of cyan can be improved by mixing C. I. Pigment Green 7 with C. I. Pigment Blue 15:3.

The amounts of colorants used vary depending on the types of the colorants. However, the total amount of colorants is 0.1 to 60 parts by mass, and preferably 0.5 to 50 parts by mass relative to 100 parts by mass of the binder resin.

Furthermore, in the present invention, a cross-linking agent may be used in the synthesis of the binder resin in order to increase the mechanical strength of toner particles and to control the molecular weight of molecules that constitute the toner particles.

Regarding the cross-linking agent used in the toner particles of the present invention, examples of a bifunctional cross-linking agent include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, or #600, dipropylene glycol diacrylate, polypropylene glycol diacrylate, polyester-type diacrylates, and compounds having a structure in which any of these diacrylates is replaced with a corresponding dimethacrylate.

Examples of a polyfunctional cross-linking agent include pentaerythritol triacrylate, trimethylolethane triacrylate, trimethylolpropane triacrylate, tetramethylolmethane tetraacrylate, oligoester acrylates and methacrylates thereof, 2,2-bis(4-methacryloxyphenyl)propane, diallyl phthalate, triallyl cyanurate, triallyl isocyanurate, and triallyl trimellitate.

The cross-linking agent is preferably used in an amount in the range of 0.05 to 10 parts by mass, and more preferably in the range of 0.1 to 5 parts by mass relative to 100 parts by mass of the monomer from the standpoint of a fixing property and an offset resistance property of the toner.

Furthermore, in the present invention, a wax component may be used in the synthesis of the binder resin in order to prevent toner particles from adhering to a fixing member.

Specific examples of the wax component that can be used in the present invention include petroleum wax such as paraffin wax, microcrystalline wax, and petrolatum, and derivatives thereof; montan wax and derivatives thereof; hydrocarbon waxes produced by a Fischer-Tropsch process and derivatives thereof; polyolefin waxes typified by polyethylene, and derivatives thereof; and natural waxes such as carnauba wax and candelilla wax, and derivatives thereof. These derivatives include oxides, block copolymers with vinyl monomers, and graft-modified products. Examples of the wax component further include alcohols such as higher aliphatic alcohols, fatty acids such as stearic acid and palmitic acid, fatty acid amides, fatty acid esters, hardened castor oil and derivatives thereof, vegetable waxes, and animal waxes. These may be used alone or in combination.

The total content of the wax component is preferably 2.5 to 15.0 parts by mass, and more preferably 3.0 to 10.0 parts by mass relative to 100 parts by mass of the binder resin. When the content of the wax component is less than 2.5 parts by mass, it becomes difficult to perform oil-less fixing. When the content of the wax component exceeds 15.0 parts by mass, the amount of wax component in the toner particles is excessively large. Consequently, a large amount of excess wax component is present on the surfaces of toner particles, which may degrade desired charging properties.

In the toner according to the present invention, a charge control agent may be mixed as required. Accordingly, the amount of triboelectrification can be optimally controlled in accordance with a developing system.

As the charge control agent, known charge control agents can be used. In particular, a charge control agent that enables high-speed charging and stably maintains a constant amount of charge is suitably used. Furthermore, in the case where toner particles are produced by a direct polymerization method, a charge control agent that exhibits a low polymerization-inhibiting property and contains substantially no soluble substance in an aqueous dispersion medium is suitably used.

Examples of the charge control agent that controls a toner to a negatively chargeable one include polymers and copolymers having a sulfonic acid group, a sulfonate group, or a sulfonic acid ester group; salicylic acid derivatives and metal complexes thereof; monoazo metal compounds; acetylacetone metal compounds; aromatic oxycarboxylic acids; aromatic mono- and poly-carboxylic acids and metal salts thereof, anhydrides thereof, and esters thereof; phenol derivatives such as bisphenol; urea derivatives; metal-containing naphthoic acid compounds; boron compounds; quaternary ammonium salts; calixarenes; and resin-based charge control agents. Examples of the charge control agent that controls a toner to a positively chargeable one include nigrosine and nigrosines modified with fatty acid metal salts or the like; guanidine compounds; imidazole compounds; tributylbenzylammonium-1-hydroxy-4-naphthosulfonate; quaternary ammonium salts such as tetrabutylammonium tetrafluoroborate, onium salts, such as phosphonium salts, being analogues thereof, and lake pigments thereof; triphenylmethane dyes and lake pigments thereof (the laking agent includes phosphotungstic acid, phosphomolybdic acid, phosphotungstomolybdic acid, tannic acid, lauric acid, gallic acid, ferricyanides, ferrocyanides, etc.); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-based charge control agents. These may be used alone or in combination of two or more compounds.

In the toner of the present invention, an inorganic fine powder may be added as a fluidizing agent to the toner particles. Examples of the inorganic fine powder include fine powders of silica, titanium oxide, alumina, and double oxides thereof, and surface-treated powders thereof.

Examples of a method for producing toner particles constituting the toner of the present invention includes a pulverization method, a suspension polymerization method, a suspension granulation method, and an emulsion polymerization method, all of which are commonly used. From the standpoint of the environmental load on production and the controllability of the particle diameter, the toner particles may be obtained by a method including granulation in an aqueous medium, such as the suspension polymerization method and the suspension granulation method among the above production methods.

In the method for producing a toner of the present invention, the compound having an azo skeleton structure and the phthalocyanine pigment are mixed in advance to prepare a pigment composition, thereby improving dispersibility of the phthalocyanine pigment.

The pigment composition can be produced by a wet method or a dry method. Considering that the azo compound having an azo skeleton structure has high affinity for water-insoluble solvents, the pigment composition may be produced by a wet method, by which a homogeneous pigment composition can be easily produced. Specifically, a pigment composition can be obtained, for example, as follows. A compound having an azo skeleton structure and a resin, as required, are dissolved in a dispersion medium, and a pigment powder is gradually added thereto while stirring to be sufficiently mixed with the dispersion medium. Furthermore, a mechanical shearing force is applied to the mixture by a dispersing device, such as a kneader, a roll mill, a ball mill, a paint shaker, a dissolver, an attritor, a sand mill, or a high-speed mill. Thus, the phthalocyanine pigment can be stably finely dispersed in the form of homogeneous fine particles.

The dispersion medium that can be used in the pigment composition is not particularly limited. However, in order to obtain a high effect of dispersing a pigment by the compound having an azo skeleton structure, the dispersion medium may be a water-insoluble solvent. Specific examples of the water-insoluble solvent include esters such as methyl acetate, ethyl acetate, and propyl acetate; hydrocarbons such as hexane, octane, petroleum ether, cyclohexane, benzene, toluene, and xylene; and halogenated hydrocarbons such as carbon tetrachloride, trichloroethylene, and tetrabromoethane.

The dispersion medium that can be used in the pigment composition may be a polymerizable monomer. Specific examples thereof include styrene, α-methylstyrene, α-ethylstyrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, ethylene, propylene, butylene, isobutylene, vinyl chloride, vinylidene chloride, vinyl bromide, vinyl iodide, vinyl acetate, vinyl propionate, vinyl benzoate, methacrylic acid, methyl methacrylate, ethyl methacrylate, propyl methacrylate, butyl methacrylate, n-octyl methacrylate, dodecyl methacrylate, 2-ethylhexyl methacrylate, stearyl methacrylate, behenyl methacrylate, phenyl methacrylate, dimethylaminoethyl methacrylate, diethylaminoethyl methacrylate, acrylic acid, methyl acrylate, ethyl acrylate, n-butyl acrylate, isobutyl acrylate, propyl acrylate, n-octyl acrylate, dodecyl acrylate, 2-ethylhexyl acrylate, stearyl acrylate, behenyl acrylate, 2-chloroethyl acrylate, phenyl acrylate, vinyl methyl ether, vinyl ethyl ether, vinyl isobutyl ether, vinyl methyl ketone, vinyl hexyl ketone, methyl isopropenyl ketone, vinylnaphthalene, acrylonitrile, methacrylonitrile, and acrylamide. These dispersion media may be used as a mixture of two or more compounds.

The resin that can be used in the pigment composition may be a resin that can be used as the binder resin of the toner of the present invention. Specific examples thereof include styrene-methacrylic acid copolymers, styrene-acrylic acid copolymers, polyester resins, epoxy resins, and styrene-butadiene copolymers. Furthermore, the pigment composition can be isolated by a known method such as filtration, decantation, or centrifugal separation. The solvent may be removed by washing.

In producing the pigment composition, auxiliary agents may be further added to the pigment composition. Specific examples of the auxiliary agent include surfactants, dispersants, fillers, standardizers, resins, waxes, defoaming agents, antistatic agents, dustproof agents, extenders, shading colorants, preservatives, drying retarders, rheology control additives, humectants, antioxidants, UV absorbers, photostabilizers, and combinations thereof. The compound having an azo skeleton structure may be added in advance in the production of a crude pigment.

Toner particles produced by a suspension polymerization method of the present invention are obtained, for example, as described below. The pigment composition, a polymerizable monomer, a wax component, a polymerization initiator, etc. are mixed to prepare a polymerizable monomer composition. Next, the polymerizable monomer composition is dispersed in an aqueous medium to granulate particles of the polymerizable monomer composition. Subsequently, the polymerizable monomer in the particles of the polymerizable monomer composition is polymerized in an aqueous medium to obtain toner particles.

The polymerizable monomer composition in the above step may be prepared by dispersing the pigment composition in a first polymerizable monomer to prepare a dispersion liquid, and mixing the dispersion liquid with a second polymerizable monomer. Specifically, the pigment composition is sufficiently dispersed in the first polymerizable monomer, and the resulting dispersion liquid is then mixed with the second polymerizable monomer together with other toner materials, whereby the phthalocyanine pigment can be present in the toner particles in a more satisfactorily dispersed state.

The polymerization initiator used in the suspension polymerization method may be a known polymerization initiator. Examples thereof include azo compounds, organic peroxides, inorganic peroxides, organometallic compounds, and photopolymerization initiators. More specifically, examples thereof include azo polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis (isobutyrate); organic peroxide polymerization initiators such as benzoyl peroxide, di-tert-butyl peroxide, tert-butylperoxyisopropyl monocarbonate, tert-hexylperoxybenzoate, and tert-butylperoxybenzoate; inorganic peroxide polymerization initiators such as potassium persulfate and ammonium persulfate; and redox initiators such as hydrogen peroxide-ferrous compound, BPO-dimethylaniline, and cerium (IV) salt-alcohol. Examples of the photopolymerization initiators include acetophenones, benzoin ethers, and ketals. These polymerization initiators may be used alone or in combination of two or more initiators.

The concentration of the polymerization initiator is preferably in the range of 0.1 to 20 parts by mass, and more preferably in the range of 0.1 to 10 parts by mass relative to 100 parts by mass of the polymerizable monomer. The type of polymerization initiator used somewhat varies depending on the polymerization method. However, the polymerization initiator is selected in consideration of the 10-hour half-life temperature. These polymerization initiators may be used alone or as a mixture.

The aqueous medium used in the suspension polymerization method may contain a dispersion stabilizer. Known inorganic and organic dispersion stabilizers can be used as the dispersion stabilizer. Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methylcellulose, methylhydroxypropylcellulose, ethylcellulose, sodium salt of carboxymethylcellulose, and starch. Surfactants such as nonionic surfactants, anionic surfactants, and cationic surfactants may also be used. Examples of the surfactants include sodium dodecyl sulfate, sodium tetradecyl sulfate, sodium pentadecyl sulfate, sodium octyl sulfate, sodium oleate, sodium laurate, potassium stearate, and calcium oleate.

Among the dispersion stabilizers, hardly water-soluble inorganic dispersion stabilizers that are soluble in acids may be used in the present invention. In the present invention, when an aqueous dispersion medium is prepared using a hardly water-soluble inorganic dispersion stabilizer, the dispersion stabilizer is preferably used in an amount in the range of 0.2 to 2.0 parts by mass relative to 100 parts by mass of the polymerizable monomer in view of droplet stability of the polymerizable monomer composition in the aqueous medium. In the present invention, the aqueous medium is preferably prepared using 300 to 3,000 parts by mass of water relative to 100 parts by mass of the polymerizable monomer composition.

In the present invention, when an aqueous medium containing the hardly water-soluble inorganic dispersion stabilizer dispersed therein is prepared, a commercially available dispersion stabilizer may be dispersed without further treatment. However, in order to obtain dispersion stabilizer particles having a small, uniform particle diameter, the hardly water-soluble inorganic dispersion stabilizer may be produced in water while stirring at a high speed. For example, in the case where calcium phosphate is used as a dispersion stabilizer, an aqueous solution of sodium phosphate and an aqueous solution of calcium chloride may be mixed while stirring at a high speed to form fine particles of calcium phosphate. Thus, a suitable dispersion stabilizer can be obtained.

The toner particles of the present invention can also be suitably produced by a suspension granulation method. The production process of a suspension granulation method does not include a heating step. Therefore, it is possible to suppress compatibilization of a resin and a wax component that occurs when a low-melting point wax is used and to prevent a decrease in the glass transition temperature of the toner, the decrease being due to the compatibilization. Furthermore, in the suspension granulation method, a toner material serving as a binder resin can be selected from a wide range of resins. Thus, a polyester resin, which is generally believed to be advantageous in terms of fixing property, can be easily used as a main component. Therefore, this suspension granulation method is advantageous in producing a toner having a resin composition which cannot be produced by the suspension polymerization method.

Toner particles produced by the suspension granulation method can be obtained, for example, as described below. First, the pigment composition, a binder resin, a wax component, etc. are mixed in a solvent to prepare a solvent composition. Next, the solvent composition is dispersed in an aqueous medium to granulate particles of the solvent composition. Thus, a toner particle suspension liquid is prepared. The suspension liquid is heated or depressurized to remove the solvent. Thus, toner particles can be obtained.

The solvent composition in the above step may be prepared by dispersing the pigment composition in a first solvent to prepare a dispersion liquid, and mixing the dispersion liquid with a second solvent. Specifically, the pigment composition is sufficiently dispersed in the first solvent, and the resulting dispersion liquid is then mixed with the second solvent together with other toner materials, whereby the phthalocyanine pigment can be present in the toner particles in a more satisfactorily dispersed state.

Examples of a solvent that can be used in the suspension granulation method include hydrocarbons such as toluene, xylene, and hexane; halogenated hydrocarbons such as methylene chloride, chloroform, dichloroethane, trichloroethane, and carbon tetrachloride; alcohols such as methanol, ethanol, butanol, and isopropyl alcohol; polyhydric alcohols such as ethylene glycol, propylene glycol, diethylene glycol, and triethylene glycol; cellosolves such as methyl cellosolve and ethyl cellosolve; ketones such as acetone, methyl ethyl ketone, and methyl isobutyl ketone; ethers such as benzyl alcohol ethyl ether, benzyl alcohol isopropyl ether, and tetrahydrofuran; and esters such as methyl acetate, ethyl acetate, and butyl acetate. These may be used alone or as a mixture of two or more solvents. Among these, in order to easily remove a solvent in the toner particle suspension liquid, a solvent which has a low boiling point and which can sufficiently dissolve the binder resin is suitably used.

The amount of solvent used is preferably in the range of 50 to 5,000 parts by mass, and more preferably in the range of 120 to 1,000 parts by mass relative to 100 parts by mass of the binder resin.

The aqueous medium used in the suspension granulation method may contain a dispersion stabilizer. Known inorganic and organic dispersion stabilizers can be used as the dispersion stabilizer. Examples of the inorganic dispersion stabilizer include calcium phosphate, calcium carbonate, aluminum hydroxide, calcium sulfate, and barium carbonate. Examples of the organic dispersion stabilizer include water-soluble polymers such as polyvinyl alcohol, methylcellulose, hydroxyethylcellulose, ethylcellulose, sodium salt of carboxymethylcellulose, sodium polyacrylate, and sodium polymethacrylate; and surfactants such as anionic surfactants, e.g., sodium dodecylbenzenesulfonate, sodium octadecyl sulfate, sodium oleate, sodium laurate, and potassium stearate, cationic surfactants, e.g., laurylamine acetate, stearylamine acetate, and lauryltrimethylammonium chloride, and amphoteric surfactants, e.g., lauryldimethylamine oxide, and nonionic surfactants, e.g., polyoxyethylene alkyl ethers, polyoxyethylene alkyl phenyl ethers, and polyoxyethylene alkylamines.

The amount of dispersion stabilizer used is preferably in the range of 0.01 to 20 parts by mass relative to 100 parts by mass of the binder resin in view of droplet stability of the solvent composition in the aqueous medium.

In the present invention, the toner preferably has a weight-average particle diameter (hereinafter referred to as "D4") of 3.00 to 15.0 μm, and more preferably 4.00 to 12.0 μm. When the weight-average particle diameter is within the above range, an image with a high definition can be easily obtained while maintaining charging stability.

A ratio (hereinafter referred to as "D4/D1") of D4 to the number-average particle diameter (hereinafter referred to as "D1") of the toner is 1.35 or less, and preferably 1.30 or less from the standpoint that fogging can be suppressed and the transfer efficiency can be improved while maintaining a high resolution.

A method for adjusting D4 and D1 of the toner of the present invention varies depending on the method for producing toner particles. For example, in the case of the suspension polymerization method, D4 and D1 can be adjusted by controlling the concentration of the dispersion stabilizer used in the preparation of an aqueous dispersion medium, the stirring speed in the reaction, the stirring time in the reaction, or the like.

The toner of the present invention may be either a magnetic toner or a nonmagnetic toner. When the toner is used as a magnetic toner, toner particles constituting the toner of the present invention may be mixed with a magnetic material. Examples of the magnetic material include iron oxides such as magnetite, maghemite, and ferrite; iron oxides containing other metal oxides; metals such as Fe, Co, and Ni; alloys of any of these metals with a metal such as Al, Co, Cu, Pb, Mg, Ni, Sn, Zn, Sb, Be, Bi, Cd, Ca, Mn, Se, Ti, W, and V; and mixtures thereof. The magnetic material particularly suitable for the present invention is a fine powder of triiron tetroxide or γ-iron sesquioxide.

The magnetic material has an average particle diameter of 0.1 to 2 μm (preferably 0.1 to 0.3 μm). As for magnetic properties of the magnetic material at the application of 795.8 kA/m, the magnetic material preferably has a coercive force of 1.6 to 12 kA/m, a saturation magnetization of 5 to 200 $Am^2/kg$ (preferably 50 to 100 $Am^2/kg$), and a residual magnetization of 2 to 20 $Am^2/kg$ from the standpoint of the developability of the toner.

The amount of magnetic material added is 10 to 200 parts by mass, and preferably 20 to 150 parts by mass relative to 100 parts by mass of the binder resin.

EXAMPLES

The present invention will now be described in more detail by way of Examples and Comparative Examples. However, the present invention is not limited to the Examples as long as the present invention does not exceed the gist thereof. In the description below, "parts" and "%" are on a mass basis unless otherwise specified.

Measurement methods used in production examples will be described below.

(1) Measurement of Molecular Weight

The molecular weight of a compound having a polymer portion and an azo skeleton structure (also referred to as "azo skeleton unit") in the present invention was calculated by size exclusion chromatography (SEC) in terms of polystyrene. The measurement of the molecular weight by SEC was conducted as described below.

A sample was added to an eluate described below so that the sample concentration was 1.0% by mass to prepare a solution. The solution was allowed to stand at room temperature for 24 hours and then filtered with a solvent-resistant membrane filter having a pore diameter of 0.2 μm to prepare a sample solution. The sample solution was measured under the following conditions.

Apparatus: High-speed gel permeation chromatography (GPC) apparatus (HLC-8220GPC) (manufactured by Tosoh Corporation)

Column: Two series of TSKgel α-M (manufactured by Tosoh Corporation)

Eluate: Tetrahydrofuran (THF)

Flow rate: 1.0 mL/min

Oven temperature: 40° C.

Amount of injected sample: 0.025 mL

For the calculation of the molecular weight of a sample, a molecular-weight calibration curve prepared by using standard polystyrene resins (TSK standard polystyrenes manufactured by Tosoh Corporation: F-850, F-450, F-288, F-128, F-80, F-40, F-20, F-10, F-4, F-2, F-1, A-5000, A-2500, A-1000, and A-500) was used.

(2) Measurement of Acid Value

The acid value of a compound having a polymer portion and an azo skeleton structure in the present invention was determined by the following method.

The basic operation is based on JIS K-0070.

[1] First, 0.5 to 2.0 g of a sample was precisely weighed. The mass of the sample was defined as W (g).

[2] The sample was put in a 50-mL beaker, and 25 mL of a mixed liquid of tetrahydrofuran/ethanol (2/1) was added to dissolve the sample.

[3] A titration was conducted using a 0.1 mol/L KOH ethanol solution with a potentiometric titrator. (For example, an automatic titrator COM-2500 manufactured by Hiranuma Sangyo Corporation can be used.)

[4] The amount of KOH solution used at this time was defined as S (mL). A blank value was also measured, and the amount of KOH solution used at this time was defined as B (mL).

[5] The acid value was calculated by the following formula:

$$\text{Acid value [mgKOH/g]} = \frac{(S-B)\times f\times 5.61}{W}$$

where f is a factor of the KOH solution.

(3) Composition Analysis

The structure of a compound having a polymer portion and an azo skeleton structure of the present invention was determined using the following apparatuses.

$^{1}$H NMR and $^{13}$C NMR

ECA-400, manufactured by JEOL Ltd. (solvent: Deuterochloroform)

FT-NMR AVANCE-600, manufactured by Bruker Corporation (solvent: Deuterochloroform)

Example 1

Compounds having the azo skeleton were prepared by the methods described below.

<Production Example of Compound (44)>

A compound (44) having an azo skeleton was produced in accordance with the scheme below.

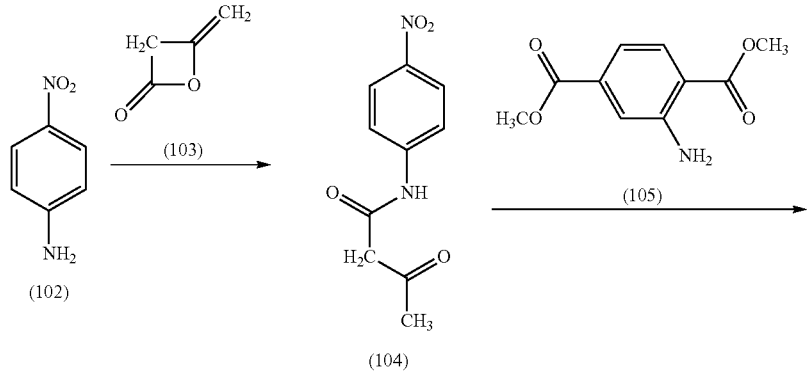

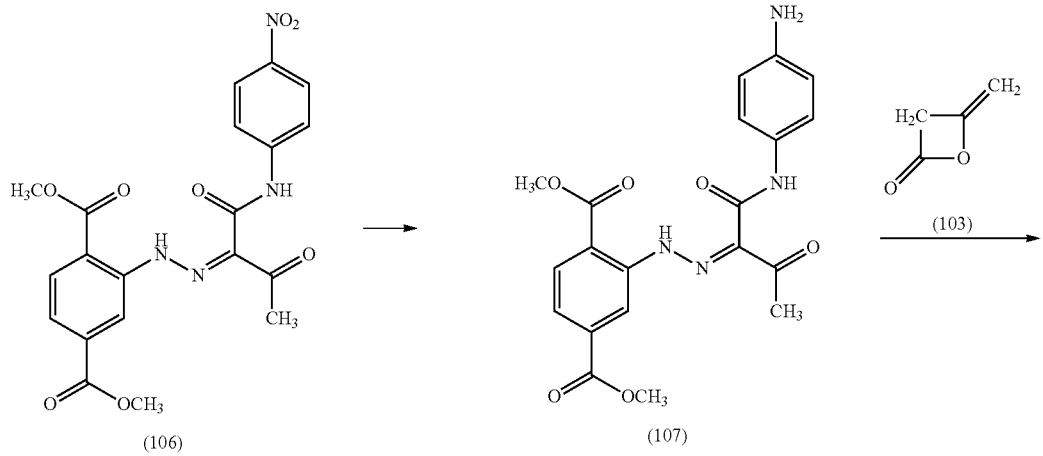

-continued
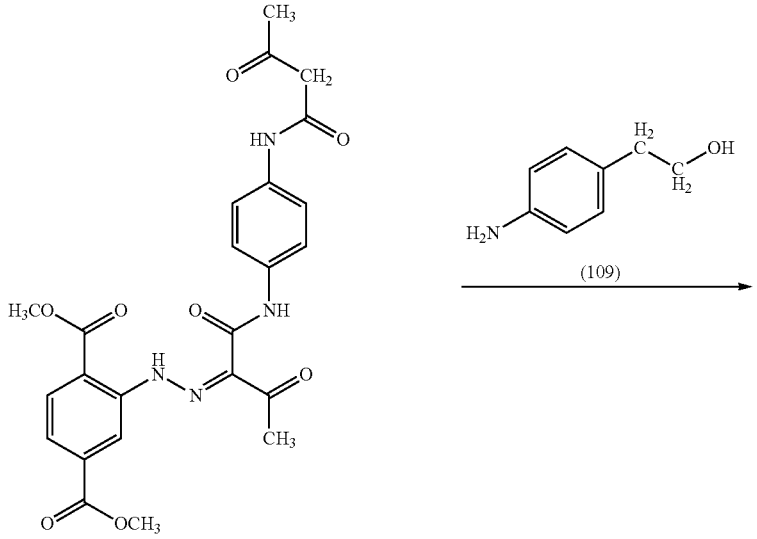
(108)
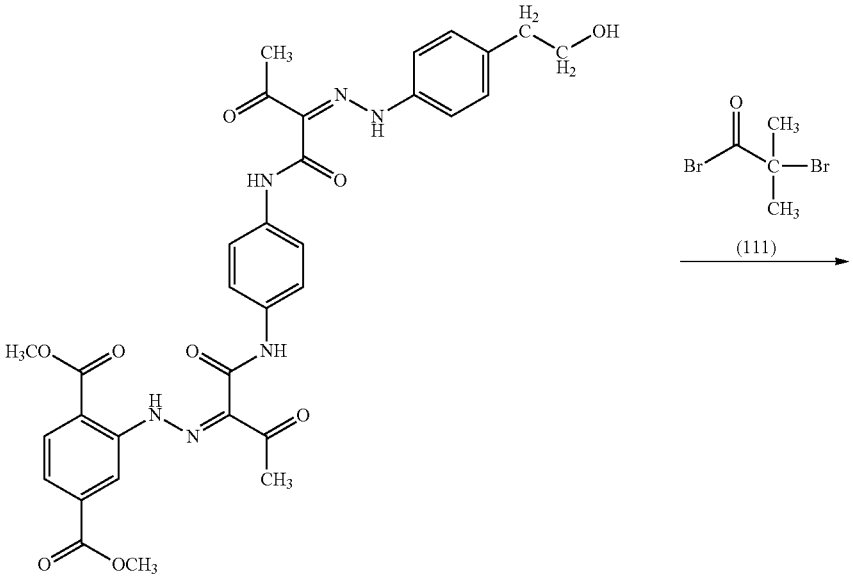
(110)

-continued

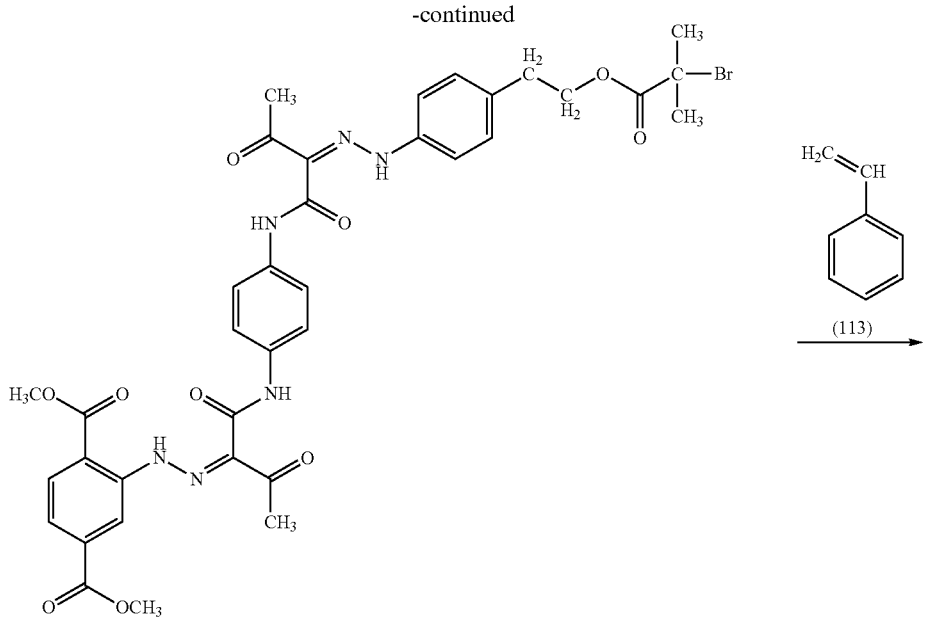

(112)

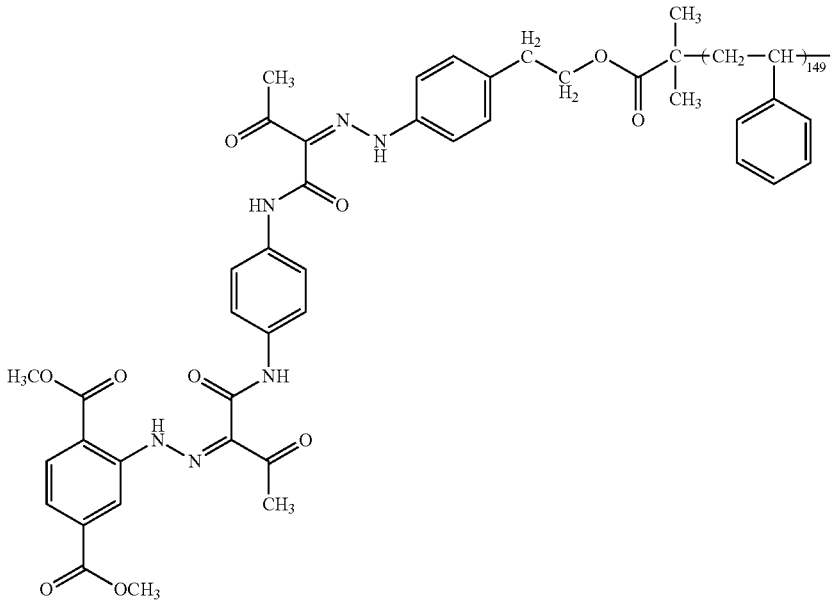

(44)

First, 3.11 parts of p-nitroaniline (102) was added to 30 parts of chloroform. The resulting solution was cooled to 10° C. or lower with ice, and 1.89 parts of diketene (103) was added thereto. The resulting solution was then stirred at 65° C. for two hours. After the completion of the reaction, the reaction product was extracted with chloroform and concentrated. Thus, 4.70 parts of a compound (104) was obtained (yield: 94.0%).

Next, 40.0 parts of methanol and 5.29 parts of concentrated hydrochloric acid were added to 4.25 parts of 2-aminodimethyl terephthalate (105), and the resulting solution was cooled to 10° C. or lower with ice. A solution prepared by dissolving 2.10 parts of sodium nitrite in 6.00 parts of water was added to the solution. The resulting solution was allowed to react at the same temperature for one hour. Next, 0.990 parts of sulfamic acid was added thereto, and the mixture was further stirred for 20 minutes (diazonium salt solution). Next, 4.51 parts of the compound (104) was added to 70.0 parts of methanol, and the resulting solution was cooled to 10° C. or lower with ice. The diazonium salt solution was added thereto. Next, a solution prepared by dissolving 5.83 parts of sodium acetate in 7.00 parts of water was added to the resulting solution, and the solution was allowed to react at 10° C. or lower for two hours. After the completion of the reaction, 300 parts of water was added thereto, and stirring was conducted for 30 minutes. Subsequently, the resulting solid was separated by filtration and purified by a recrystallization method from N,N-dimethylformamide. Thus, 8.71 parts of a compound (106) was obtained (yield: 96.8%).

Next, 8.58 parts of the compound (106) and 0.40 parts of palladium-activated carbon (palladium: 5%) were added to 150 parts of N,N-dimethylformamide, and the resulting mixture was stirred at 40° C. for three hours in a hydrogen gas atmosphere (reaction pressure: 0.1 to 0.4 MPa). After the completion of the reaction, the solution was separated by filtration and concentrated. Thus, 6.99 parts of a compound (107) was obtained (yield: 87.5%).

Next, 6.50 parts of the compound (107) was added to 30.0 parts of chloroform, and the resulting solution was cooled to 10° C. or lower with ice, and 0.95 parts of diketene (103) was added thereto. The resulting solution was then stirred at 65° C. for two hours. After the completion of the reaction, the reaction product was extracted with chloroform and concentrated. Thus, 7.01 parts of an azo compound intermediate product (108) was obtained (yield: 94.2%).

Next, 15.0 parts of methanol and 1.48 parts of concentrated hydrochloric acid were added to 1.78 parts of 2-(4-aminophenyl)ethanol (109), and the resulting solution was cooled to 10° C. or lower with ice. A solution prepared by dissolving 1.08 parts of sodium nitrite in 3.00 parts of water was added to the solution. The resulting solution was allowed to react at the same temperature for one hour. Next, 0.380 parts of sulfamic acid was added thereto, and the mixture was further stirred for 20 minutes (diazonium salt solution). Next, 6.50 parts of the compound (108) and a solution prepared by dissolving 7.18 parts of potassium carbonate in 7.00 parts of water were added to 70.0 parts of N,N-dimethylformamide and the resulting solution was cooled to 10° C. or lower with ice. The diazonium salt solution was added thereto, and the resulting solution was allowed to react at 10° C. or lower for two hours. After the completion of the reaction, 300 parts of water was added thereto, and stirring was conducted for 30 minutes. Subsequently, the resulting solid was separated by filtration and purified by a recrystallization method from N,N-dimethylformamide. Thus, 7.62 parts of a compound (110) was obtained (yield: 91.0%).

Next, 2.00 parts of the compound (110) was added to 20.0 parts of chloroform, and the resulting solution was cooled to 10° C. or lower with ice. Next, 0.855 parts of 2-bromoisobutyryl bromide (111) was added thereto. Subsequently, the resulting mixture was stirred at 65° C. for two hours. After the completion of the reaction, the reaction product was extracted with chloroform and concentrated. Thus, 2.26 parts of an intermediate product (112) was obtained (yield: 92.0%).

Next, 0.684 parts of the compound (112), 27.3 parts of styrene (113), 0.305 parts of N,N,N',N'',N''-pentamethyldiethylenetriamine, and 0.124 parts of copper (I) bromide were added to 10.0 parts of N,N-dimethylformamide. The resulting mixture was then stirred at 100° C. for 7.5 hours in a nitrogen atmosphere. After the completion of the reaction, the reaction product was extracted with chloroform and purified by reprecipitation with methanol. Thus, 8.50 parts of a compound (44) was obtained (yield: 85.0%).

The structure of the resulting compound was confirmed using the apparatuses described above. According to the results, the compound had the structure represented by the above formula. The analysis results are described below.

[Analysis Results of Compound (44) Having Azo Skeleton]

[1] Results of molecular-weight measurement (GPC): Weight-average molecular weight (Mw)=15,117, Number-average molecular weight (Mn)=12,910

[2] Result of measurement of acid value: 0 mgKOH/g

[3] Result of $^1$H NMR (400 MHz, $CDCl_3$, room temperature) (refer to FIG. 1):

δ [ppm]=15.65 (s, 1H), 14.77 (s, 1H), 11.40 (s, 1H), 11.41 (s, 1H), 8.62 (s, 1H), 8.15 (d, 1H), 7.79 (d, 1H), 7.74 (d, 2H), 7.64 (d, 2H), 7.37-6.27 (m, 738H), 4.07 (s, 3H), 3.98 (s, 3H), 3.73 (br, 2H), 2.72-2.52 (m, 9H), 2.47-1.05 (m, 458H), 1.01-0.78 (m, 6H)

<Production Example of Compound (57)>

A compound (57) having an azo skeleton was produced in accordance with the scheme below.

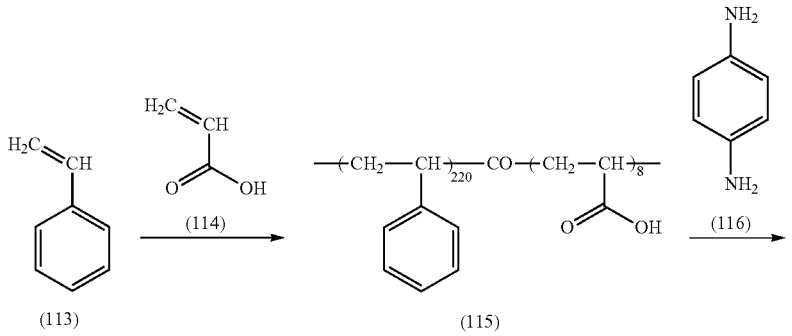

-continued

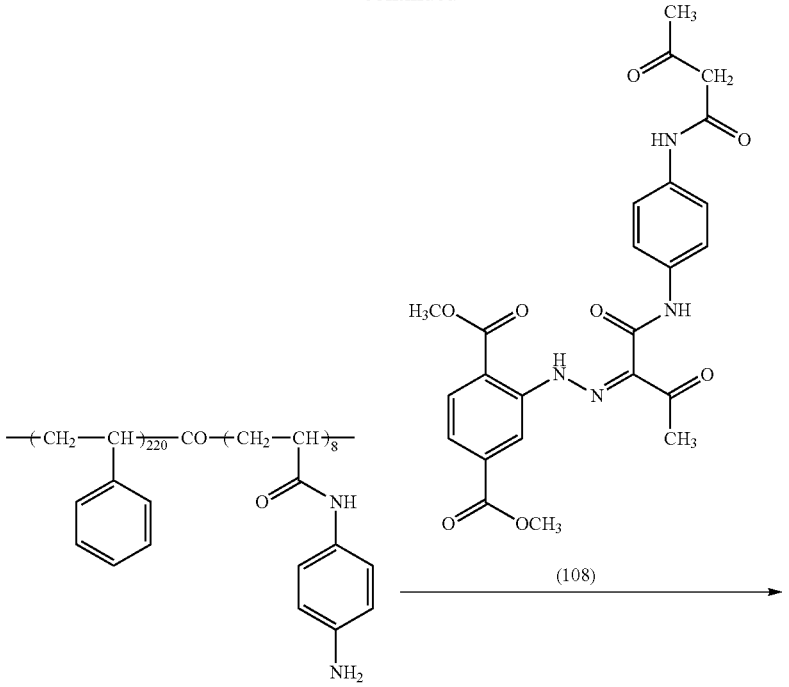

(117)

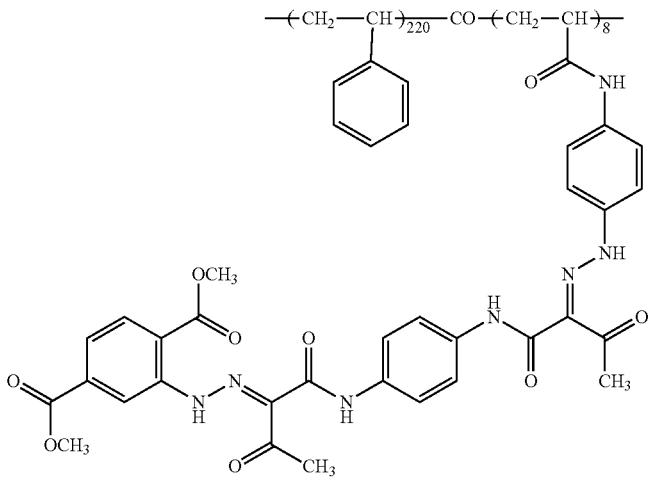

(57)

First, 100 parts of propylene glycol monomethyl ether was heated while the atmosphere was replaced with nitrogen, and refluxed at a liquid temperature of 120° C. or higher. A mixture of 190 parts of styrene (113), 10.0 parts of acrylic acid (114), and 1.00 part of tert-butylperoxybenzoate (organic peroxide polymerization initiator, trade name: Perbutyl Z, manufactured by NOF Corporation) was added dropwise thereto over a period of three hours. After the completion of the dropwise addition, the resulting solution was stirred for three hours. Subsequently, the solution was distilled at normal pressure while the liquid temperature was increased to 170° C. After the liquid temperature reached 170° C., the solution was distilled for one hour at a reduced pressure of 1 hPa to remove the solvent. Thus, a resin solid matter was obtained. The solid matter was dissolved in tetrahydrofuran, and purified by reprecipitation with n-hexane. Thus, 185 parts of a compound (115) was obtained (yield: 92.5%).

Next, 3.00 parts of the compound (115) and 184 parts of oxalyl chloride were added to 15.0 parts of chloroform, and the resulting solution was stirred at room temperature for five hours in a nitrogen gas atmosphere. A solution prepared by dissolving 0.644 parts of p-phenylenediamine (116) in 10.0 parts of chloroform and 5.00 parts of N,N-dimethylformamide was added to the resulting solution dropwise, and the solution was stirred at room temperature for two hours in a nitrogen gas atmosphere. After the completion of the reaction, the reaction liquid was separated with chloroform/water and concentrated. The reaction product was purified by reprecipitation with methanol. Thus, 2.98 parts of a compound (117) was obtained (yield: 90.3%).

Next, 10.0 parts of tetrahydrofuran and 0.252 parts of concentrated hydrochloric acid were added to 1.00 part of the compound (117), and the resulting solution was cooled to 0° C. or lower with ice. A solution prepared by dissolving 0.0900 parts of sodium nitrite in 0.270 parts of water was added to this solution. The resulting solution was allowed to react at the same temperature for one hour. Next, 0.063 parts of sulfamic acid was added thereto, and the mixture was further stirred for 20 minutes (diazonium salt solution). Next, a solution prepared by dissolving 0.446 parts of potassium carbonate in 1.50 parts of water and 0.354 parts of the compound (108) were added to 15.0 parts of N,N-dimethylformamide, and the resulting solution was cooled to 10° C. or lower with ice. The diazonium salt solution was added thereto, and the resulting solution was allowed to react at 10° C. or lower for four hours. After the completion of the reaction, 300 parts of water was added thereto, and stirring was conducted for 30 minutes. Subsequently, the resulting solid was separated by filtration, dissolved in chloroform, and then purified by reprecipitation with methanol. Thus, 0.970 parts of a compound (57) was obtained (yield: 97.0%).

The structure of the resulting compound was confirmed using the apparatuses described above. According to the results, the compound had the structure represented by the above formula. The analysis results are described below.

[Analysis Results of Compound (57) Having Azo Skeleton]

[1] Results of molecular-weight measurement (GPC): Weight-average molecular weight (Mw)=32,442, Number-average molecular weight (Mn)=18,329

[2] Result of measurement of acid value: 0 mgKOH/g

Figure 2:
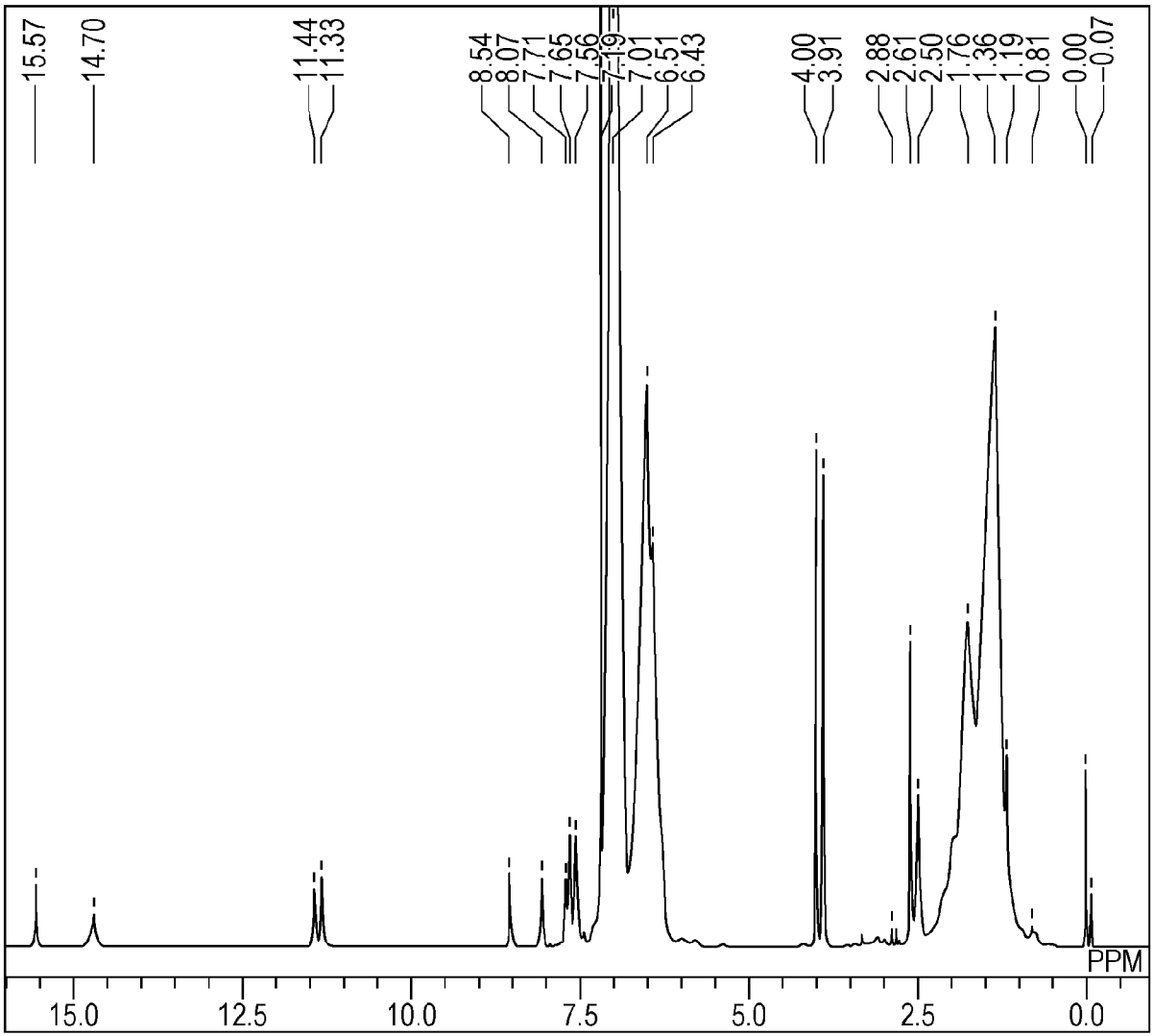
FIG. 2 is a $^1H$ NMR spectrum chart of compound (57) having an azo skeleton structure in $CDCl_3$ at room temperature at 400 MHz.

[3] Result of $^1$H NMR (400 MHz, $CDCl_3$, room temperature) (refer to FIG. 2):

δ [ppm]=15.57 (s, 1H), 14.70 (s, 1H), 11.44 (s, 1H), 11.33 (s, 1H), 8.54 (s, 1H), 8.07 (d, 1H), 7.71 (d, 1H), 7.65 (d, 2H), 7.56 (d, 2H), 7.19-6.43 (m, 136H), 4.00 (s, 3H), 3.91 (s, 3H), 2.61 (s, 3H), 2.50 (s, 3H), 1.76-0.81 (m, 97H)

<Production Example of Compound (94)>

A compound (94) having an azo skeleton, the compound (94) being represented by the structure below, was produced in accordance with the scheme below.

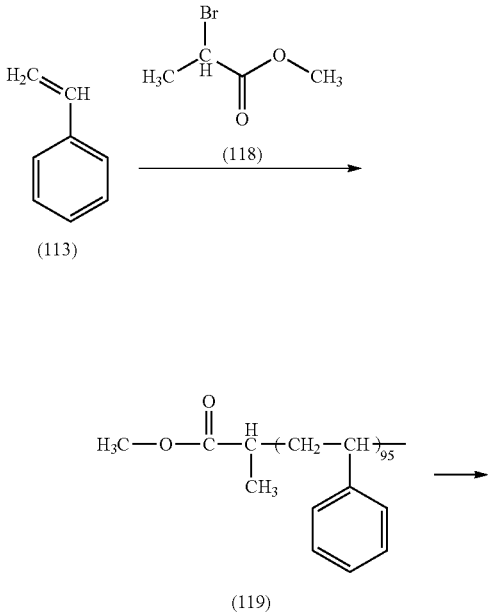

-continued

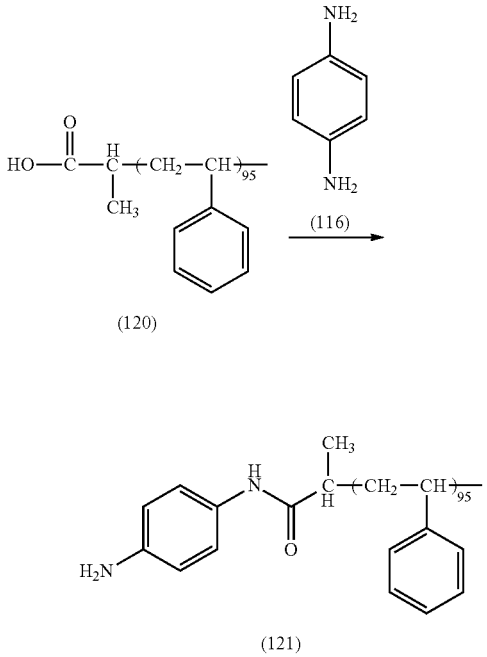

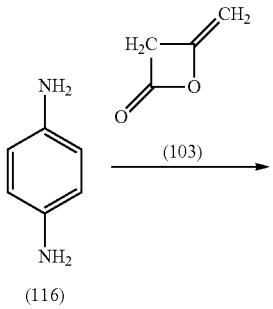

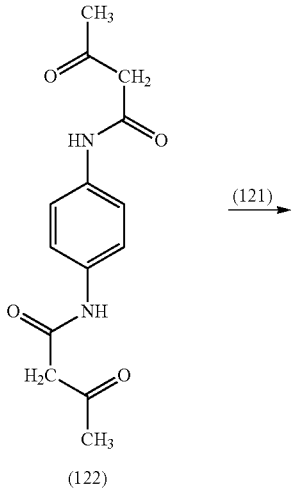

-continued

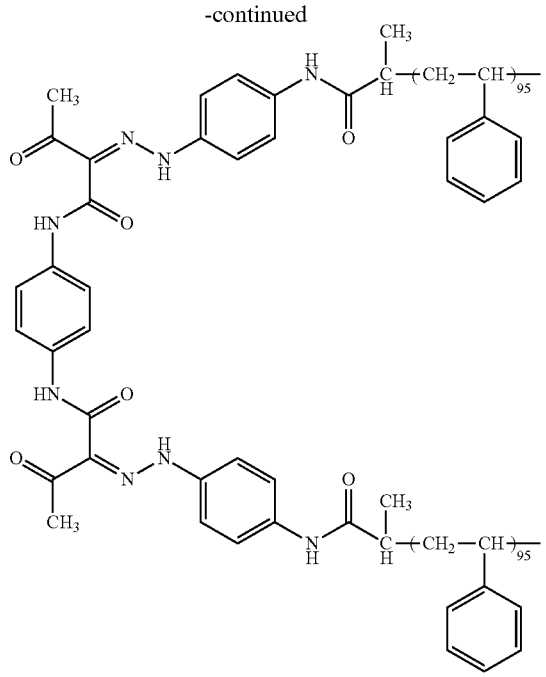

(94)

First, 60.0 parts of styrene (113), 1.47 parts of N,N,N',N'',N''-pentamethyldiethylenetriamine, and 0.493 parts of copper (I) bromide were added to 0.395 parts of methyl-2-bromo propionate (118). The resulting mixture was stirred at 100° C. for five hours in a nitrogen gas atmosphere. After the completion of the reaction, the reaction product was extracted with chloroform and purified by reprecipitation with methanol. Thus, 52.4 parts of a compound (119) was obtained (yield: 81.9%).

Next, 1.00 parts of the compound (119) was added to 150 parts of dioxane, and the solution was stirred at 110° C. A mixture of 5.00 parts of concentrated hydrochloric acid and 30 parts of dioxane was then added thereto, and the resulting solution was stirred at 110° C. for five hours in a nitrogen gas atmosphere. After the completion of the reaction, the reaction product was extracted with chloroform and purified by reprecipitation with methanol. Thus, 0.98 parts of a compound (120) was obtained (yield: 98.0%).

Next, 1.00 part of the compound (120) and 0.0160 parts of oxalyl chloride were added to 5.00 parts of chloroform, and the resulting solution was stirred at room temperature for five hours in a nitrogen gas atmosphere. A solution prepared by dissolving 0.0670 parts of p-phenylenediamine (116) in 10.0 parts of chloroform and 5.00 parts of N,N-dimethylformamide was added to the resulting solution dropwise, and the solution was stirred at 60° C. for two hours in a nitrogen gas atmosphere. After the completion of the reaction, the reaction liquid was separated with chloroform/water and concentrated. The reaction product was purified by reprecipitation with methanol. Thus, 0.970 parts of a compound (121) was obtained (yield: 97.0%).

Next, 50.0 parts of p-phenylenediamine (116) and 35.0 parts of acetone were added to 300 parts of chloroform. The mixture was cooled to 10° C. or lower with ice, and 72.0 parts of diketene (103) was added thereto. The resulting solution was then stirred at 65° C. for two hours. After the completion of the reaction, the reaction product was extracted with chloroform and concentrated. Thus, 121 parts of a compound (122) was obtained (yield: 97.4%).

Next, 40.0 parts of tetrahydrofuran (THF) and 0.127 parts of concentrated hydrochloric acid were added to 4.00 parts of the compound (121), and the resulting solution was cooled to 10° C. or lower with ice. A solution prepared by dissolving 0.005 parts of sodium nitrite in 1.70 parts of water was added to the solution. The resulting solution was allowed to react at the same temperature for one hour. Next, 0.0320 parts of sulfamic acid was added thereto, and the mixture was further stirred for 20 minutes (diazonium salt solution). Next, a solution prepared by dissolving 0.230 parts of potassium acetate in 1.00 part of water and 0.0460 parts of the compound (122) were added to 70.0 parts of methanol, and the resulting solution was cooled to 10° C. or lower with ice. The diazonium salt solution was added thereto, and the resulting solution was allowed to react at 10° C. or lower for two hours. After the completion of the reaction, 300 parts of water was added thereto, and stirring was conducted for 30 minutes. Subsequently, the resulting solid was separated by filtration and purified by reprecipitation with methanol. Thus, 3.80 parts of a compound (94) was obtained (yield: 95.0%).

The structure of the resulting compound was confirmed using the apparatuses described above. According to the results, the compound had the structure represented by the above formula. The analysis results are described below.

[Analysis Results of Compound (94) Having Azo Skeleton]

[1] Results of molecular-weight measurement (GPC): Weight-average molecular weight (Mw)=31,686, Number-average molecular weight (Mn)=22,633

[2] Result of measurement of acid value: 0 mgKOH/g

Figure 3:
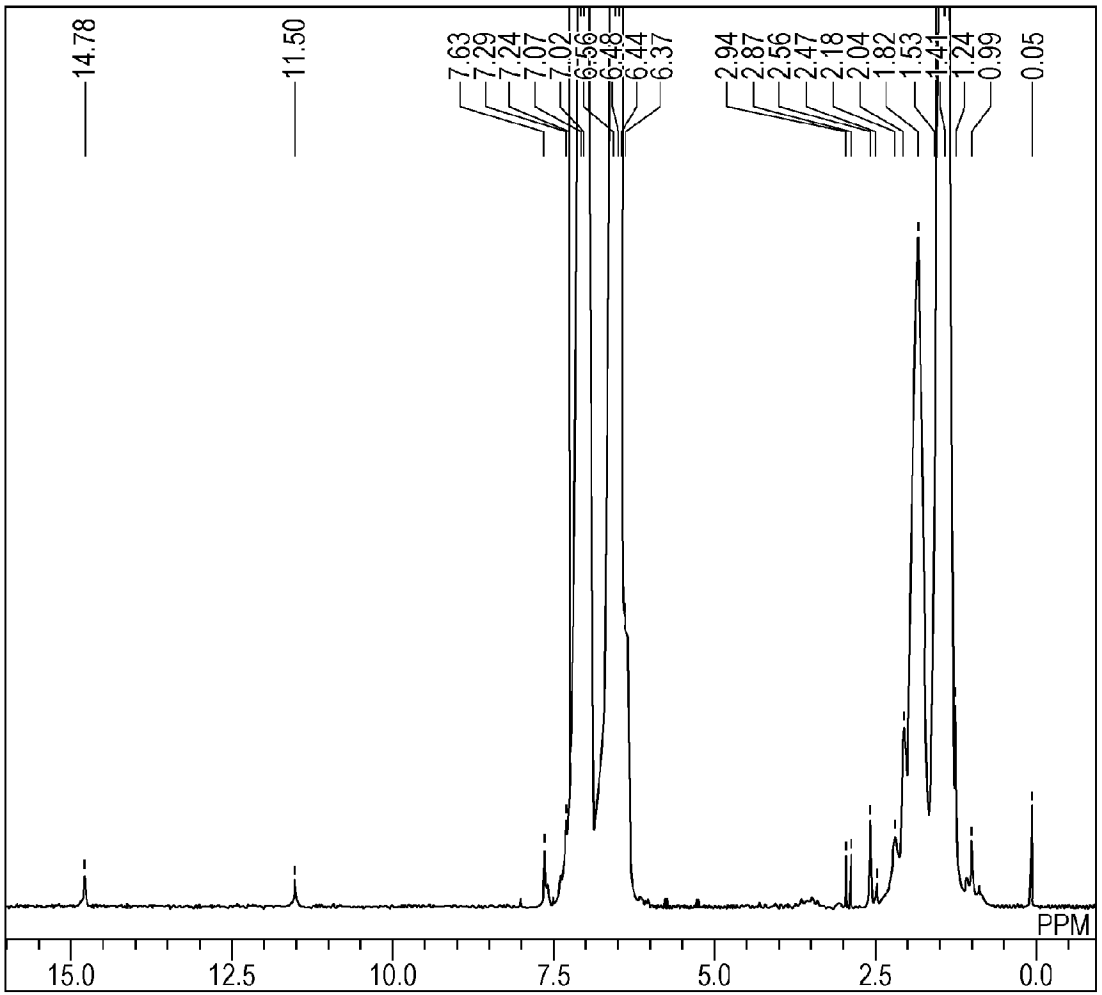
FIG. 3 is a $^1H$ NMR spectrum chart of compound (94) having an azo skeleton structure in $CDCl_3$ at room temperature at 400 MHz.

[3] Result of $^1$H NMR (400 MHz, $CDCl_3$, room temperature) (refer to FIG. 3):

δ [ppm]=14.78 (s, 2H), 11.50 (s, 2H), 7.63 (d, 4H), 7.29-6.37 (m, 1192H), 2.56 (s, 6H), 2.18-0.99 (m, 839H)

<Production Example of Compound (96)>

A compound (96) having an azo skeleton, the compound (96) being represented by the structure below, was produced in accordance with the scheme below. 77

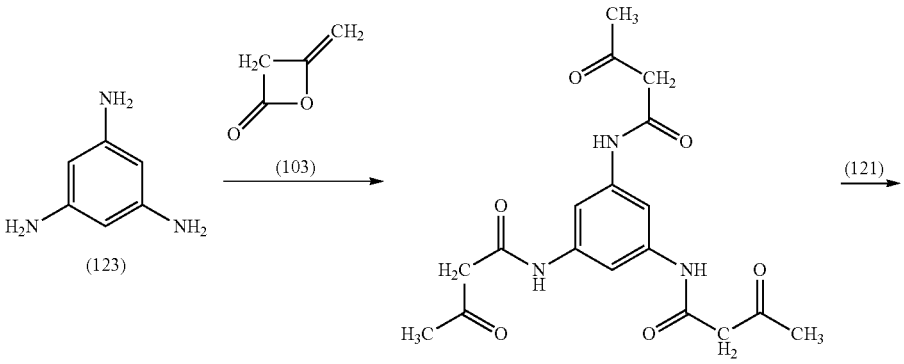

(123) (124)

-continued

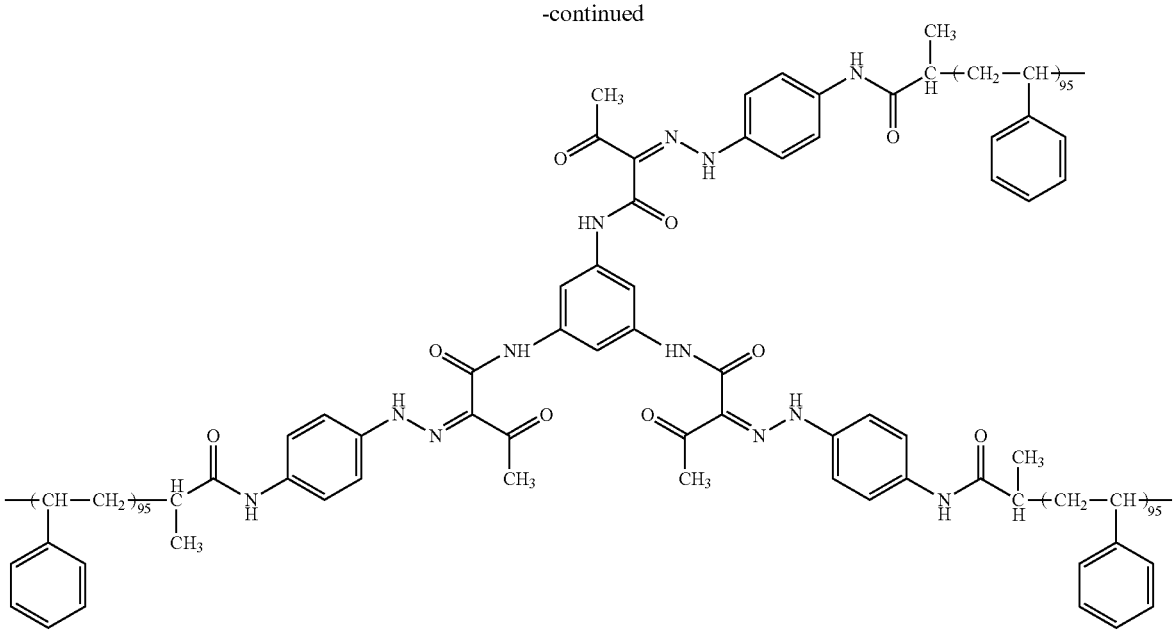

(96)

First, the compound (121) was prepared by the same procedure as that in the production example of the compound (94).

Next, 0.500 parts of 1,3,5-triaminobenzene (123) and 0.345 parts of triethylamine were added to 10.0 parts of N,N-dimethylformamide, and the mixture was stirred at room temperature. Next, 0.949 parts of diketene (103) was added thereto, and the resulting mixture was stirred at 50° C. for two hours. After the completion of the reaction, 300 parts of water was added thereto, and the mixture was stirred for 30 minutes. The resulting solid was then separated by filtration. Thus, 1.41 parts of a compound (124) was obtained (yield: 92.8%).

Next, 20 parts of N,N-dimethylformamide (DMF), 20.0 parts of THF, and 0.130 parts of concentrated hydrochloric acid were added to 4.00 parts of the compound (121), and the resulting solution was cooled to 10° C. or lower with ice. A solution prepared by dissolving 0.0450 parts of sodium nitrite in 0.136 parts of water was added to the solution. The resulting solution was allowed to react at the same temperature for one hour. Next, 0.0320 parts of sulfamic acid was added thereto, and the mixture was further stirred for 20 minutes (diazonium salt solution). Next, a solution prepared by dissolving 0.225 parts of potassium acetate in 1.00 part of water and 0.0440 parts of the compound (124) were added to 15.0 parts of DMF, and the resulting solution was cooled to 10° C. or lower with ice. The diazonium salt solution was added thereto, and the resulting solution was allowed to react at 10° C. or lower for two hours. After the completion of the reaction, 300 parts of water was added thereto, and stirring was conducted for 30 minutes. Subsequently, the resulting solid was separated by filtration and purified by a recrystallization method from N,N-dimethylformamide. Thus, 3.78 parts of a compound (96) was obtained (yield: 94.5%).

The structure of the resulting compound was confirmed using the apparatuses described above. According to the results, the compound had the structure represented by the above formula. The analysis results are described below.

[Analysis Results of Compound (96) Having Azo Skeleton]

[1] Results of molecular-weight measurement (GPC): Weight-average molecular weight (Mw)=48,989, Number-average molecular weight (Mn)=28,481

[2] Result of measurement of acid value: 0 mgKOH/g

Figure 4:
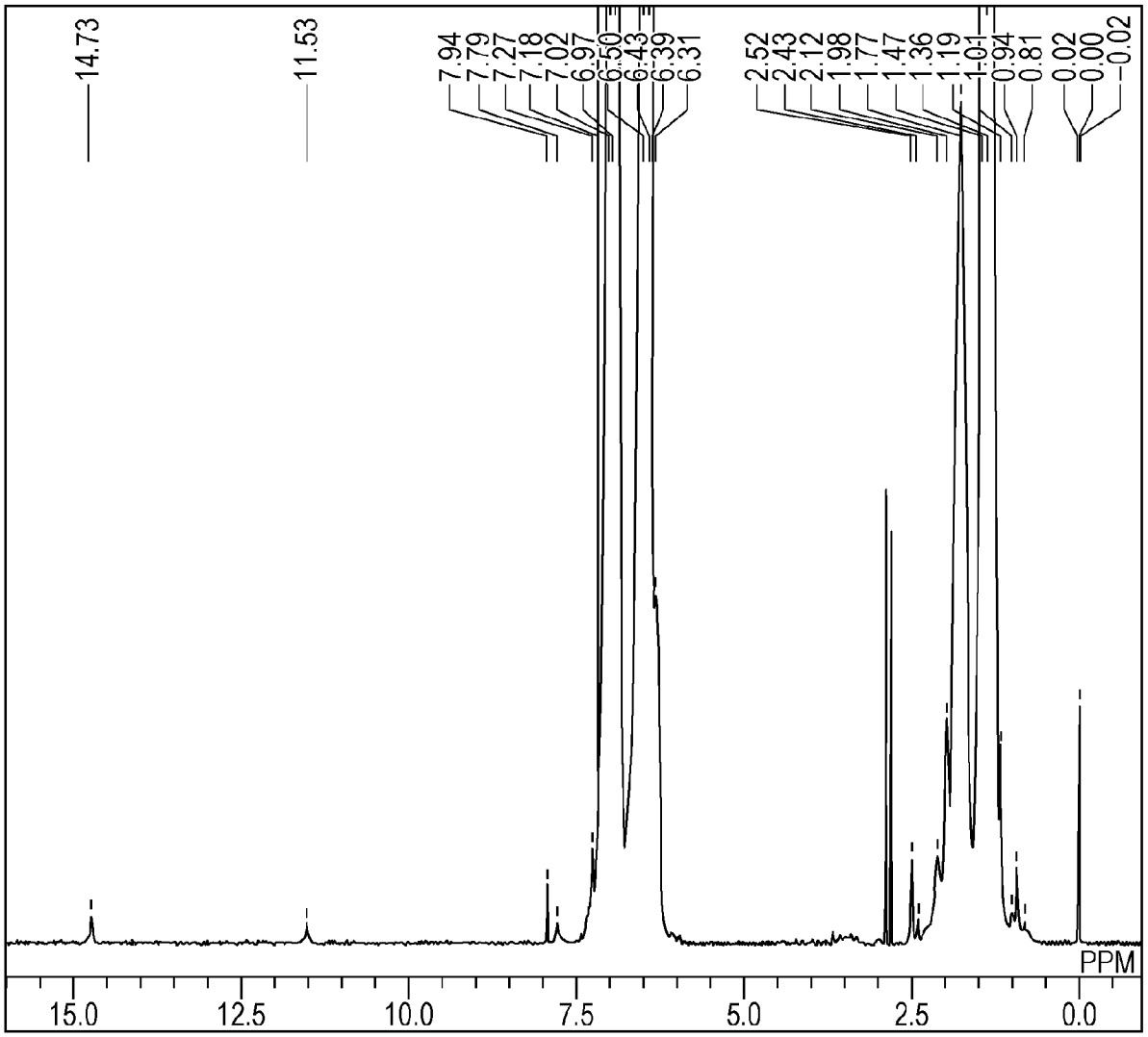
FIG. 4 is a $^1H$ NMR spectrum chart of compound (96) having an azo skeleton structure in $CDCl_3$ at room temperature at 400 MHz.

[3] Result of $^1$H NMR (400 MHz, $CDCl_3$, room temperature) (refer to FIG. 4):

δ [ppm]=14.73 (s, 3H), 11.53 (s, 3H), 7.79 (s, 3H), 7.27-6.31 (m, 2175H), 2.52 (s, 9H), 2.12-0.81 (m, 1461H)

Compounds (29) to (43), (45) to (56), (58) to (93), (95), and (97) to (99) were produced by conducting procedures similar to those in the production examples of the compounds (44), (57), (94), and (96) each having an azo skeleton.

Table 1 below shows the polymer portion, and Tables 2-1 to 2-3 show the compounds each having an azo skeleton.

TABLE 1

| Polymer portion | | | | | | | | | | | |
|---|---|---|---|---|---|---|---|---|---|---|---|
| Polymer portion | Sequential arrangement of monomer | The number of Xs | The number of $Y_1$s | The number of $Y_2$s | The number of Zs | $R_{36}$ | $R_{37}$ | $R_{38}$ | $R_{39}$ | $R_{40}$ | $R_{41}$ |
| (A) | α-W-polyX | 95 | 0 | 0 | 0 | H | — | — | — | — | — |
| (B) | α-W-polyX | 149 | 0 | 0 | 0 | H | — | — | — | — | — |
| (C) | α-W-poly$Y_1$ | 0 | 101 | 0 | 0 | — | H | COOBu (n) | — | — | — |
| (D) | α-W-poly(X-co-$Y_1$) | 71 | 18 | 0 | 0 | H | H | COOBu (n) | — | — | — |
| (E) | α-W-poly(X-co-$Y_1$) | 18 | 88 | 0 | 0 | H | H | COOBu (n) | — | — | — |
| (F) | α-W-poly(X-co-$Y_1$) | 71 | 18 | 0 | 0 | H | H | $CONH_2$ | — | — | — |

TABLE 1-continued

| Polymer portion | | | | | | | | | | | |
|---|---|---|---|---|---|---|---|---|---|---|---|
| Polymer portion | Sequential arrangement of monomer | The number of Xs | The number of $Y_1$s | The number of $Y_2$s | The number of Zs | $R_{36}$ | $R_{37}$ | $R_{38}$ | $R_{39}$ | $R_{40}$ | $R_{41}$ |
| (G) | α-W-poly(X-co-$Y_1$) | 71 | 18 | 0 | 0 | H | H | $COOCH_3$ | — | — | — |
| (H) | α-W-poly(X-co-$Y_1$) | 71 | 18 | 0 | 0 | H | H | COOBn | — | — | — |
| (I) | poly(X-co-$Y_1$-co-Z) | 141 | 30 | 0 | 11 | H | H | COOBu (n) | — | — | H |
| (J) | poly(X-co-$Y_1$-co-Z) | 15 | 11 | 0 | 7 | $CH_3$ | $CH_3$ | COOBu (n) | — | — | H |
| (K) | poly(X-co-$Y_1$-co-Z) | 220 | 4 | 0 | 4 | H | H | $COOCH_3$ | — | — | H |
| (L) | poly(X-co-$Y_1$-co-Z) | 57 | 5 | 0 | 3 | H | H | $COOCH_2CH(C_2H_5)C_4H_9$ | — | — | H |
| (M) | poly(X-co-$Y_1$-co-Z) | 49 | 4 | 0 | 2 | H | H | $COOC_{18}H_{37}$ (n) | — | — | H |
| (N) | poly(X-co-$Y_1$-co-Z) | 58 | 3 | 0 | 3 | H | H | $COOC_{22}H_{45}$ (n) | — | — | H |
| (O) | poly(X-co-$Y_1$-co-$Y_2$-co-Z) | 75 | 13 | 3 | 3 | H | H | $COOCH_3$ | H | $COOC_{22}H_{45}$ (n) | H |
| (P) | poly(X-co-$Y_1$-co-$Y_2$-co-Z) | 59 | 28 | 4 | 3 | H | H | COOBu (n) | H | $COOC_{22}H_{45}$ (n) | H |
| (Q) | poly(X-co-Z) | 220 | 0 | 0 | 8 | H | — | — | — | — | H |
| (R) | poly(X-co-Z) | 1,174 | 0 | 0 | 384 | H | — | — | — | — | H |
| (S) | poly($Y_1$-co-Z) | 0 | 90 | 0 | 10 | — | H | COOBu (n) | — | — | H |
| (T) | polyX-b-polyZ | 84 | 0 | 0 | 5 | H | — | — | — | — | H |
| (U) | poly(X-co-$Y_1$)-b-polyZ | 74 | 14 | 0 | 2 | H | H | COOBu (n) | — | — | H |

In Table 1, prefix α represents a terminal group disposed on the left of the structure, W represents a COOH group, X, $Y_2$, $Y_2$, and Z represent the structures below, "Bu" represents an unsubstituted butyl group, "Bn" represents an unsubstituted benzyl group, and (n) represents that the alkyl group is linear.

Formula (X)

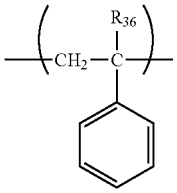

In formula (X), $R_{36}$ represents a hydrogen atom or an alkyl group.

Formula ($Y_1$)

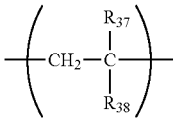

In formula ($Y_1$), $R_{37}$ represents a hydrogen atom or an alkyl group, and $R_{38}$ represents a carboxylic acid ester group or a carboxylic acid amide group.

Formula ($Y_2$)

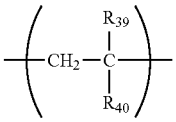

In formula ($Y_2$), $R_{39}$ represents a hydrogen atom or an alkyl group, and $R_{40}$ represents a carboxylic acid ester group or a carboxylic acid amide group.

Formula (Z)

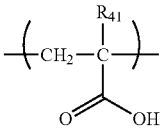

In formula (Z), $R_{41}$ represents a hydrogen atom or an alkyl group.

TABLE 2-1

| Compounds having azo skeleton unit | | | | | | | | | |
|---|---|---|---|---|---|---|---|---|---|
| Compound No. | Polymer portion | Linking site that binds to polymer portion | m | n | The number of units introduced | Substitution positions of acylacetamide groups | $R_1$ | $R_9$ | $R_{10}$ |
| (29) | (A) | W | 4 | 1 | 1 | 1,4- | 2,3,5,6-H | $CH_3$ | $CH_3$ |
| (30) | (C) | W | 4 | 1 | 1 | 1,4- | 2,3,5,6-H | $CH_3$ | $CH_3$ |
| (31) | (D) | W | 4 | 1 | 1 | 1,4- | 2,3,5,6-H | $CH_3$ | $CH_3$ |
| (32) | (E) | W | 4 | 1 | 1 | 1,4- | 2,3,5,6-H | $CH_3$ | $CH_3$ |
| (33) | (F) | W | 4 | 1 | 1 | 1,4- | 2,3,5,6-H | $CH_3$ | $CH_3$ |
| (34) | (G) | W | 4 | 1 | 1 | 1,4- | 2,3,5,6-H | $CH_3$ | $CH_3$ |
| (35) | (H) | W | 4 | 1 | 1 | 1,4- | 2,3,5,6-H | $CH_3$ | $CH_3$ |
| (36) | (A) | W | 4 | 1 | 1 | 1,4- | 2,3,5,6-H | $CH_3$ | $CH_3$ |
| (37) | (D) | W | 4 | 1 | 1 | 1,4- | 2,3,5,6-H | $CH_3$ | $CH_3$ |
| (38) | (A) | W | 4 | 1 | 1 | 1,4- | 2,3,5,6-H | $CH_3$ | $CH_3$ |
| (39) | (D) | W | 4 | 1 | 1 | 1,4- | 2,3,5,6-H | $CH_3$ | $CH_3$ |

TABLE 2-1-continued

| Compounds having azo skeleton unit | | | | | | | | | |
|---|---|---|---|---|---|---|---|---|---|
| (40) | (A) | W | 4 | 1 | 1 | 1,4- | 2,3,5,6-H | $CH_3$ | $CH_3$ |
| (41) | (D) | W | 4 | 1 | 1 | 1,4- | 2,3,5,6-H | $CH_3$ | $CH_3$ |
| (42) | (A) | W | 4 | 1 | 1 | 1,4- | 2,3,5,6-H | $CH_3$ | $CH_3$ |
| (43) | (D) | W | 4 | 1 | 1 | 1,4- | 2,3,5,6-H | $CH_3$ | $CH_3$ |
| (44) | (B) | W | 4 | 1 | 1 | 1,4- | 2,3,5,6-H | $CH_3$ | $CH_3$ |
| (45) | (D) | W | 4 | 1 | 1 | 1,4- | 2,3,5,6-H | $CH_3$ | $CH_3$ |
| (46) | (I) | Z | 4 | 1 | 1 | 1,4- | 2,3,5,6-H | $CH_3$ | $CH_3$ |
| (47) | (I) | Z | 4 | 1 | 11 | 1,4- | 2,3,5,6-H | $CH_3$ | $CH_3$ |
| (48) | (J) | Z | 4 | 1 | 2 | 1,4- | 2,3,5,6-H | $CH_3$ | $CH_3$ |
| (49) | (J) | Z | 4 | 1 | 7 | 1,4- | 2,3,5,6-H | $CH_3$ | $CH_3$ |
| (50) | (K) | Z | 4 | 1 | 4 | 1,4- | 2,3,5,6-H | $CH_3$ | $CH_3$ |
| (51) | (L) | Z | 4 | 1 | 3 | 1,4- | 2,3,5,6-H | $CH_3$ | $CH_3$ |
| (52) | (M) | Z | 4 | 1 | 2 | 1,4- | 2,3,5,6-H | $CH_3$ | $CH_3$ |

| Compound No. | $R_{11}$ | $R_{12}$ | $R_{13}$ | $R_{14}$ | $R_{15}$ | $R_{16}$ | $R_{17}$ | $R_{18}$ | $R_{19}$ | $R_{20}$ |
|---|---|---|---|---|---|---|---|---|---|---|
| (29) | $COOCH_3$ | H | H | $COOCH_3$ | H | H | H | $L_1$ | H | H |
| (30) | $COOCH_3$ | H | H | $COOCH_3$ | H | H | H | $L_1$ | H | H |
| (31) | $COOCH_3$ | H | H | $COOCH_3$ | H | H | H | $L_1$ | H | H |
| (32) | $COOCH_3$ | H | H | $COOCH_3$ | H | H | H | $L_1$ | H | H |
| (33) | $COOCH_3$ | H | H | $COOCH_3$ | H | H | H | $L_1$ | H | H |
| (34) | $COOCH_3$ | H | H | $COOCH_3$ | H | H | H | $L_1$ | H | H |
| (35) | $COOCH_3$ | H | H | $COOCH_3$ | H | H | H | $L_1$ | H | H |
| (36) | $COOCH_3$ | H | H | $COOCH_3$ | H | H | H | $L_2$ | H | H |
| (37) | $COOCH_3$ | H | H | $COOCH_3$ | H | H | H | $L_2$ | H | H |
| (38) | $COOCH_3$ | H | H | $COOCH_3$ | H | H | H | $L_3$ | H | H |
| (39) | $COOCH_3$ | H | H | $COOCH_3$ | H | H | H | $L_3$ | H | H |
| (40) | $COOCH_3$ | H | H | $COOCH_3$ | H | H | H | $L_4$ | H | H |
| (41) | $COOCH_3$ | H | H | $COOCH_3$ | H | H | H | $L_4$ | H | H |
| (42) | $COOCH_3$ | H | H | $COOCH_3$ | H | H | H | $L_5$ | H | H |
| (43) | $COOCH_3$ | H | H | $COOCH_3$ | H | H | H | $L_5$ | H | H |
| (44) | $COOCH_3$ | H | H | $COOCH_3$ | H | H | H | $L_6$ | H | H |
| (45) | $COOCH_3$ | H | H | $COOCH_3$ | H | H | H | $L_6$ | H | H |
| (46) | $COOCH_3$ | H | H | $COOCH_3$ | H | H | H | $L_7$ | H | H |
| (47) | $COOCH_3$ | H | H | $COOCH_3$ | H | H | H | $L_7$ | H | H |
| (48) | $COOCH_3$ | H | H | $COOCH_3$ | H | H | H | $L_7$ | H | H |
| (49) | $COOCH_3$ | H | H | $COOCH_3$ | H | H | H | $L_7$ | H | H |
| (50) | $COOCH_3$ | H | H | $COOCH_3$ | H | H | H | $L_7$ | H | H |
| (51) | $COOCH_3$ | H | H | $COOCH_3$ | H | H | H | $L_7$ | H | H |
| (52) | $COOCH_3$ | H | H | $COOCH_3$ | H | H | H | $L_7$ | H | H |

TABLE 2-2

| Compounds having azo skeleton unit | | | | | | | | | |
|---|---|---|---|---|---|---|---|---|---|
| Compound No. | Polymer portion | Linking site that binds to polymer portion | m | n | The number of units introduced | Substitution positions of acylacetamide groups | $R_1$ | $R_9$ | $R_{10}$ |
| (53) | (N) | Z | 4 | 1 | 3 | 1,4- | 2,3,5,6-H | $CH_3$ | $CH_3$ |
| (54) | (O) | Z | 4 | 1 | 3 | 1,4- | 2,3,5,6-H | $CH_3$ | $CH_3$ |
| (55) | (P) | Z | 4 | 1 | 3 | 1,4- | 2,3,5,6-H | $CH_3$ | $CH_3$ |
| (56) | (Q) | Z | 4 | 1 | 6 | 1,4- | 2,3,5,6-H | $CH_3$ | $CH_3$ |
| (57) | (Q) | Z | 4 | 1 | 8 | 1,4- | 2,3,5,6-H | $CH_3$ | $CH_3$ |
| (58) | (R) | Z | 4 | 1 | 197 | 1,4- | 2,3,5,6-H | $CH_3$ | $CH_3$ |
| (59) | (S) | Z | 4 | 1 | 8 | 1,4- | 2,3,5,6-H | $CH_3$ | $CH_3$ |
| (60) | (T) | Z | 4 | 1 | 5 | 1,4- | 2,3,5,6-H | $CH_3$ | $CH_3$ |
| (61) | (U) | Z | 4 | 1 | 1 | 1,4- | 2,3,5,6-H | $CH_3$ | $CH_3$ |
| (62) | (A) | W | 4 | 1 | 1 | 1,4- | 2,3,5,6-H | $CH_3$ | $CH_3$ |
| (63) | (A) | W | 4 | 1 | 1 | 1,4- | 2,3,5,6-H | $C_6H_{13}$ (n) | Ph |
| (64) | (A) | W | 4 | 1 | 1 | 1,4- | 2-OH 3,6-H 5-Cl | $CH_3$ | $CH_3$ |
| (65) | (A) | W | 4 | 1 | 1 | 1,4- | 2-$OCH_3$ 3,5,6-H | $CH_3$ | $CH_3$ |
| (66) | (A) | W | 4 | 1 | 1 | 1,4- | 2,3,5,6-H | $CH_3$ | $CH_3$ |
| (67) | (A) | W | 4 | 1 | 1 | 1,4- | 2-$CF_3$ 3,5,6-H | $CH_3$ | $CH_3$ |
| (68) | (A) | W | 4 | 1 | 1 | 1,4- | 2-CN 3,5,6-H | $CH_3$ | $CH_3$ |
| (69) | (A) | W | 4 | 1 | 1 | 1,4- | 2,3,5,6-H | $CH_3$ | $CH_3$ |
| (70) | (A) | W | 4 | 1 | 1 | 1,4- | 2,3,5,6-H | $CH_3$ | $CH_3$ |
| (71) | (A) | W | 4 | 1 | 1 | 1,4- | 2,3,5,6-H | $CH_3$ | $CH_3$ |
| (72) | (A) | W | 4 | 1 | 1 | 1,4- | 2,3,5,6-H | $CH_3$ | $CH_3$ |

TABLE 2-2-continued

| Compounds having azo skeleton unit | | | | | | | | | |
|---|---|---|---|---|---|---|---|---|---|
| (73) | (A) | W | 4 | 1 | 1 | 1,4- | 2,3,5,6-H | $CH_3$ | $CH_3$ |
| (74) | (A) | W | 4 | 1 | 1 | 1,4- | 2,3,5,6-H | $CH_3$ | $CH_3$ |
| (75) | (A) | W | 4 | 1 | 1 | 1,4- | 2,3,5,6-H | $CH_3$ | $CH_3$ |
| (76) | (A) | W | 4 | 1 | 1 | 1,4- | 2,3,5,6-H | $CH_3$ | $CH_3$ |

| Compound No. | $R_{11}$ | $R_{12}$ | $R_{13}$ | $R_{14}$ | $R_{15}$ | $R_{16}$ | $R_{17}$ | $R_{18}$ | $R_{19}$ | $R_{20}$ |
|---|---|---|---|---|---|---|---|---|---|---|
| (53) | $COOCH_3$ | H | H | $COOCH_3$ | H | H | H | $L_7$ | H | H |
| (54) | $COOCH_3$ | H | H | $COOCH_3$ | H | H | H | $L_7$ | H | H |
| (55) | $COOCH_3$ | H | H | $COOCH_3$ | H | H | H | $L_7$ | H | H |
| (56) | $COOCH_3$ | H | H | $COOCH_3$ | H | H | H | $L_7$ | H | H |
| (57) | $COOCH_3$ | H | H | $COOCH_3$ | H | H | H | $L_7$ | H | H |
| (58) | $COOCH_3$ | H | H | $COOCH_3$ | H | H | H | $L_7$ | H | H |
| (59) | $COOCH_3$ | H | H | $COOCH_3$ | H | H | H | $L_7$ | H | H |
| (60) | $COOCH_3$ | H | H | $COOCH_3$ | H | H | H | $L_7$ | H | H |
| (61) | $COOCH_3$ | H | H | $COOCH_3$ | H | H | H | $L_7$ | H | H |
| (62) | $COOCH_3$ | H | H | $COOCH_3$ | H | H | H | $L_8$ | H | H |
| (63) | $COOCH_3$ | H | H | $COOCH_3$ | H | H | H | $L_8$ | H | H |
| (64) | $COOCH_3$ | H | H | $COOCH_3$ | H | H | H | $L_8$ | H | H |
| (65) | $COOCH_3$ | H | H | $COOCH_3$ | H | H | H | $L_8$ | H | H |
| (66) | $COOCH_3$ | H | H | $COOCH_3$ | H | H | H | $L_8$ | H | H |
| (67) | $COOCH_3$ | H | H | $COOCH_3$ | H | H | H | $L_8$ | H | H |
| (68) | $COOCH_3$ | H | H | $COOCH_3$ | H | H | H | $L_8$ | H | H |
| (69) | $CH_3$ | H | Cl | H | H | H | H | $L_8$ | H | H |
| (70) | H | $CF_3$ | H | H | H | H | H | $L_8$ | H | H |
| (71) | H | H | $OCH_2CH_3$ | H | H | H | H | $L_8$ | H | H |
| (72) | H | CN | H | H | H | H | H | $L_8$ | H | H |
| (73) | COOH | H | H | COOH | H | H | H | $L_8$ | H | H |
| (74) | $COOC_2H_5$ | H | H | $COOC_2H_5$ | H | H | H | $L_8$ | H | H |
| (75) | COOPr (n) | H | H | COOPr (n) | H | H | H | $L_8$ | H | H |
| (76) | COOPr (i) | H | H | COOPr (i) | H | H | H | $L_8$ | H | H |

TABLE 2-3

| Compounds having azo skeleton unit | | | | | | | | | | |
|---|---|---|---|---|---|---|---|---|---|---|
| Compound No. | Polymer portion | Linking site that binds to polymer portion | m | n | The number of units introduced | Substitution positions of acylacetamide groups | $R_1$ | $R_9$ | $R_{10}$ | $R_{11}$ |
| (77) | (A) | W | 4 | 1 | 1 | 1,4- | 2,3,5,6-H | $CH_3$ | $CH_3$ | H |
| (78) | (A) | W | 4 | 1 | 1 | 1,4- | 2,3,5,6-H | $CH_3$ | $CH_3$ | $OCH_3$ |
| (79) | (A) | W | 4 | 1 | 1 | 1,4- | 2,3,5,6-H | $CH_3$ | $CH_3$ | H |
| (80) | (A) | W | 4 | 1 | 1 | 1,4- | 2,3,5,6-H | $CH_3$ | $CH_3$ | CONHPr (i) |
| (81) | (A) | W | 4 | 1 | 1 | 1,4- | 2,3,5,6-H | $CH_3$ | $CH_3$ | CONHPr (n) |
| (82) | (A) | W | 4 | 1 | 1 | 1,4- | 2,3,5,6-H | $CH_3$ | $CH_3$ | $CON(C_2H_5)_2$ |
| (83) | (A) | W | 4 | 1 | 1 | 1,4- | 2,3,5,6-H | $CH_3$ | $CH_3$ | $COOCH_3$ |
| (84) | (A) | W | 4 | 1 | 1 | 1,4- | 2,3,5,6-H | $CH_3$ | $CH_3$ | H |
| (85) | (A) | W | 4 | 1 | 1 | 1,4- | 2,3,5,6-H | $CH_3$ | $CH_3$ | H |
| (86) | (A) | W | 4 | 1 | 1 | 1,4- | 2,3,5,6-H | $CH_3$ | $CH_3$ | H |
| (87) | (A) | W | 4 | 1 | 1 | 1,4- | 2,3,5,6-H | $CH_3$ | $CH_3$ | H |
| (88) | (A) | W | 4 | 1 | 1 | 1,4- | 2,3,5,6-H | $CH_3$ | $CH_3$ | H |
| (89) | (A) | W | 4 | 1 | 1 | 1,3- | 2,4,5,6-H | $CH_3$ | $CH_3$ | $COOCH_3$ |
| (90) | (A) | W | 4 | 1 | 1 | 1,2- | 3,4,5,6-H | $CH_3$ | $CH_3$ | $COOCH_3$ |
| (91) | (A) | W | 4 | 1 | 1 | 1,4- | 2,3,5,6-H | $CH_3$ | $CH_3$ | $COOCH_3$ |
| (92) | (A) | W | 4 | 1 | 1 | 1,4- | 2,3,5,6-H | $CH_3$ | $CH_3$ | $COOCH_3$ |
| (93) | (A) | W | 4 | 1 | 1 | 1,4- | 2,3,5,6-H | $CH_3$ | $CH_3$ | $COOCH_3$ |
| (94) | (A) | W | 4 | 1 | 1 | 1,4- | 2,3,5,6-H | $CH_3$ | $CH_3$ | H |
| (95) | (A) | W | 4 | 1 | 1 | 1,4- | 2,3,5,6-H | $CH_3$ | $CH_3$ | H |
| (96) | (A) | W | 3 | 2 | 1 | 1,3,5- | 2,4,6-H | $CH_3$ | $CH_3$ | H |
| (97) | (A) | W | 3 | 2 | 1 | 1,2,3- | 4,5,6-H | $CH_3$ | $CH_3$ | H |
| (98) | (A) | W | 3 | 2 | 1 | 1,2,5- | 3,4,6-H | $CH_3$ | $CH_3$ | H |
| (99) | (A) | W | 3 | 2 | 1 | 1,3,5- | 2,4,6-H | $CH_3$ | $CH_3$ | H |

| Compound No. | $R_{12}$ | $R_{13}$ | $R_{14}$ | $R_{15}$ | $R_{16}$ | $R_{17}$ | $R_{18}$ | $R_{19}$ | $R_{20}$ |
|---|---|---|---|---|---|---|---|---|---|
| (77) | H | H | $CONH_2$ | H | H | H | $L_8$ | H | H |
| (78) | H | H | $CONH_2$ | H | H | H | $L_8$ | H | H |
| (79) | H | H | $NHCOCH_3$ | H | H | H | $L_8$ | H | H |
| (80) | H | H | CONHPr (i) | H | H | H | $L_8$ | H | H |
| (81) | H | H | CONHPr (n) | H | H | H | $L_8$ | H | H |
| (82) | H | H | $CON(C_2H_5)_2$ | H | H | H | $L_8$ | H | H |

TABLE 2-3-continued

| Compounds having azo skeleton unit | | | | | | | | | |
|---|---|---|---|---|---|---|---|---|---|
| (83) | H | H | H | H | H | H | $L_8$ | H | H |
| (84) | $COOCH_3$ | H | H | H | H | H | $L_8$ | H | H |
| (85) | H | $COOCH_3$ | H | H | H | H | $L_8$ | H | H |
| (86) | $COOCH_3$ | H | $COOCH_3$ | H | H | H | $L_8$ | H | H |
| (87) | $COONH_2$ | H | H | H | H | H | $L_8$ | H | H |
| (88) | H | $COONH_2$ | H | H | H | H | $L_8$ | H | H |
| (89) | H | H | $COOCH_3$ | H | H | H | $L_8$ | H | H |
| (90) | H | H | $COOCH_3$ | H | H | H | $L_8$ | H | H |
| (91) | H | H | $COOCH_3$ | H | H | $L_8$ | H | H | H |
| (92) | H | H | $COOCH_3$ | H | $L_8$ | H | H | H | H |
| (93) | H | H | $COOCH_3$ | H | H | $L_8$ | H | $L_8$ | H |
| (94) | H | $L_8$ | H | H | H | H | $L_8$ | H | H |
| (95) | $L_8$ | H | $L_8$ | H | H | $L_8$ | H | $L_8$ | H |
| (96) | H | $L_8$ | H | H | H | H | $L_8$ | H | H |
| (97) | H | $L_8$ | H | H | H | H | $L_8$ | H | H |
| (98) | H | $L_8$ | H | H | H | H | $L_8$ | H | H |
| (99) | $L_8$ | H | $L_8$ | H | H | $L_8$ | H | $L_8$ | H |

In Tables 2-1 to 2-3, m, n, $R_1$, and $R_9$ to $R_{20}$ represent m, n, $R_1$, and $R_9$ to $R_{20}$ in formula (3) below, "Pr" represents an unsubstituted propyl group, "Ph" represents an unsubstituted phenyl group, and (n) and (i) represent that the alkyl group is linear and branched, respectively. Each of compounds in which "the linking site that binds to the polymer portion" is "W" bonds to the COOH group represented by "W" in the polymer portion described in Table 1 to form a linking group L. Each of compounds in which "the linking site that binds to the polymer portion" is "Z" bonds to the COOH group in the monomer "Z" in the polymer portion described in Table 1 to form a linking group L. $L_1$ to $L_8$ in Tables 2-1 to 2-3 are each a linking group L that binds to the polymer portion, and represent the structures below.

Formula (3)

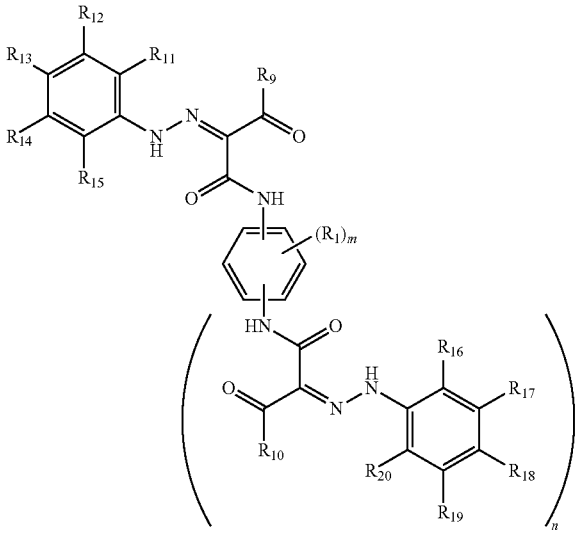

$L_1$

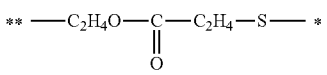

In formula ($L_2$), "*" represents a linking site that binds to the polymer portion shown in Table 1, and "**" represents a linking site in the azo skeleton structure represented by formula (1) above.

$L_2$

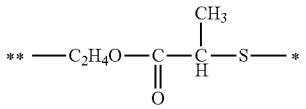

In formula ($L_2$), "*" represents a linking site that binds to the polymer portion shown in Table 1, and "**" represents a linking site in the azo skeleton structure represented by formula (1) above.

$L_3$

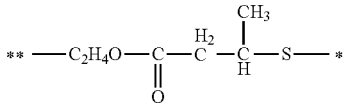

In formula ($L_3$), "*" represents a linking site that binds to the polymer portion shown in Table 1, and "**" represents a linking site in the azo skeleton structure represented by formula (1) above.

$L_4$

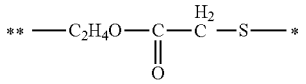

In formula ($L_4$), "*" represents a linking site that binds to the polymer portion shown in Table 1, and "**" represents a linking site in the azo skeleton structure represented by formula (1) above.

$L_5$

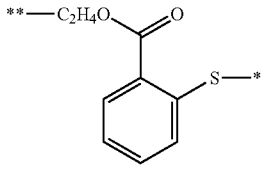

In formula ($L_5$), "*" represents a linking site that binds to the polymer portion shown in Table 1, and "**" represents a linking site in the azo skeleton structure represented by formula (1) above.

$L_6$

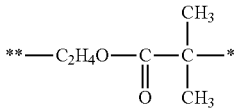

In formula ($L_6$), "*" represents a linking site that binds to the polymer portion shown in Table 1, and "**" represents a linking site in the azo skeleton structure represented by formula (1) above.

$L_7$

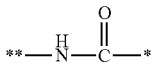

In formula ($L_7$), "*" represents a linking site that binds to the polymer portion shown in Table 1, and "**" represents a linking site in the azo skeleton structure represented by formula (1) above.

$L_8$

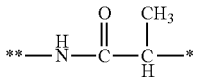

In formula ($L_8$), "*" represents a linking site that binds to the polymer portion shown in Table 1, and "**" represents a linking site in the azo skeleton structure represented by formula (1) above.

Example 2

In a process of producing a toner by a suspension polymerization method, pigment dispersion liquids each containing a phthalocyanine pigment and a compound having an azo skeleton were prepared by the methods described below.

<Preparation Example 1 of Pigment Dispersion Liquid>

First, 18.0 parts of C. I. Pigment Blue 15:3 represented by formula (28) and serving as a colorant, 1.8 parts of the compound (29) having an azo skeleton structure, 180 parts of styrene serving as a water-insoluble solvent, and 130 parts of glass bead (diameter: 1 mm) were mixed. The mixture was dispersed in an attritor (manufactured by Nippon Coke & Engineering Co., Ltd.) for three hours, and filtered with a mesh. Thus, a pigment dispersion liquid (Dis1) was prepared.

Formula (28)

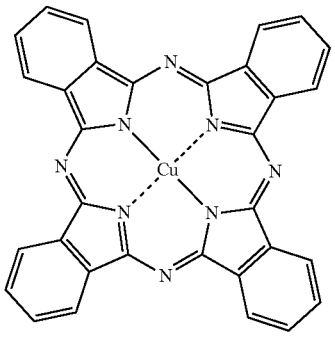

<Preparation Example 2 of Pigment Dispersion Liquid>

Pigment dispersion liquids (Dis2) to (Dis71) were prepared as in Preparation Example 1 of the pigment dispersion liquid except that the compound (29) having an azo skeleton structure was changed to each of the compounds (30) to (99) having an azo skeleton structure.

<Preparation Example 3 of Pigment Dispersion Liquid>

Pigment dispersion liquids (Dis72) to (Dis75) were prepared as in Preparation Example 1 of the pigment dispersion liquid except that C. I. Pigment Blue 15:3 represented by formula (28) was changed to each of C. I. Pigment Blue 15:4 represented by formula (28), C. I. Pigment Blue 15:6 represented by formula (28), C. I. Pigment Blue 16 represented by formula (100) below, and C. I. Pigment Blue 17:1 represented by formula (101) below.

Formula (100)

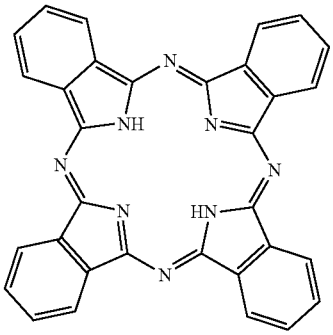

Formula (101)

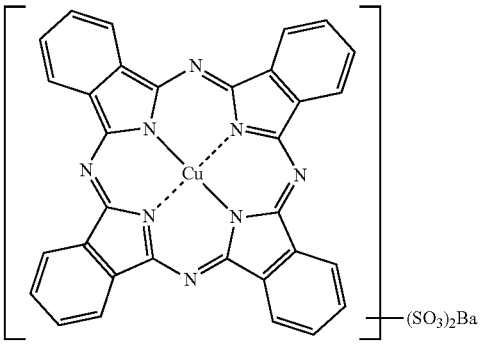

<Preparation Example 4 of Pigment Dispersion Liquid>

Pigment dispersion liquids (Dis76) to (Dis87) were prepared as in Preparation Example 3 of the pigment dispersion liquid except that the compound (29) having an azo skeleton structure was changed to each of the compounds (44), (87), and (94).

Comparative Example 1

Pigment dispersion liquids serving as reference values for evaluation and pigment dispersion liquids for comparison were prepared by the methods described below.

<Preparation Example 1 of Pigment Dispersion Liquid for Reference>

A pigment dispersion liquid (Dis88) for reference was prepared as in Preparation Example 1 of the pigment dispersion liquid in Example 2 except that the compound (29) having an azo skeleton structure was not added.

<Preparation Example 2 of Pigment Dispersion Liquid for Reference>

Pigment dispersion liquids (Dis89) to (Dis92) for reference were prepared as in Preparation Example 3 of the pigment dispersion liquid in Example 2 except that the compound (29) having an azo skeleton structure was not added.

<Preparation Example 1 of Pigment Dispersion Liquid for Comparison>

A pigment dispersion liquid (Dis93) for comparison was prepared as in Preparation Example 1 of the pigment dispersion liquid in Example 2 except that 1.8 parts of a styrene/4-vinylpyridine copolymer (styrene/4-vinylpyridine copolymerization ratio: 96/4, Mn=2,040, Mw=4,470) described in Japanese Patent Laid-Open No. 2003-277643 (Comparative compound 1) and 0.09 parts of zinc phthalocyanine (Comparative compound 2) were added instead of the compound (29) having an azo skeleton structure.

<Preparation Example 2 of Pigment Dispersion Liquid for Comparison>

A pigment dispersion liquid (Dis94) for comparison was prepared as in Preparation Example 1 of the pigment dispersion liquid in Example 2 except that 1.8 parts of a styrene/2-acrylamido-2-methylpropane sulfonic acid copolymer (Mw=12,000) described in Japanese Patent No. 4510687 (Comparative compound 3) and 0.09 parts of zinc phthalocyanine (Comparative compound 2) were added instead of the compound (29) having an azo skeleton structure.

<Preparation Example 3 of Pigment Dispersion Liquid for Comparison>

A pigment dispersion liquid (Dis95) for comparison was prepared as in Preparation Example 1 of the pigment dispersion liquid in Example 2 except that 1.8 parts of a methyl methacrylate/sodium styrenesulfonate copolymer described in Japanese Patent Laid-Open No. 03-113462 (Comparative compound 4) was added instead of the compound (29) having an azo skeleton structure.

<Preparation Example 4 of Pigment Dispersion Liquid for Comparison>

A pigment dispersion liquid (Dis96) for comparison was prepared as in Preparation Example 1 of the pigment dispersion liquid in Example 2 except that 1.8 parts of Solsperse 5000 (trade name) manufactured by The Lubrizol Corporation (Comparative compound 5) was added instead of the compound (29) having an azo skeleton structure.

Example 3

The pigment dispersion liquids prepared above were evaluated by the method described below.

The pigment dispersibility of the compounds each having an azo skeleton structure of the present invention was evaluated by a gloss test of coating films of the pigment dispersion liquids described above. Specifically, a pigment dispersion liquid was taken by a pipette, put on super art paper (SA Kinfuji, 180 kg, 80×160, manufactured by Oji Holdings Corporation) so as to form a straight line, and then uniformly applied onto the art paper using a wire bar (#10). The glossiness (reflection angle: 75°) after drying was measured with a glossmeter Gloss Meter VG2000 (manufactured by Nippon Denshoku Industries Co., Ltd.), and evaluated on the basis of the criteria below. As a phthalocyanine pigment is finely dispersed, the smoothness of the resulting coating film is improved and the glossiness is also improved.

The rate of improvement in the glossiness of each of the pigment dispersion liquids (Dis1) to (Dis71) and (Dis93) to (Dis96), all of which contained C. I. Pigment Blue 15:3 represented by formula (28) as a colorant, was determined using, as a reference value, the glossiness of the pigment dispersion liquid (Dis88) for reference.

The rate of improvement in the glossiness of each of the pigment dispersion liquids (Dis72), (Dis76), (Dis80), and (Dis84), all of which contained C. I. Pigment Blue 15:4 represented by formula (28) as a colorant, was determined using, as a reference value, the glossiness of the pigment dispersion liquid (Dis89) for reference.

The rate of improvement in the glossiness of each of the pigment dispersion liquids (Dis73), (Dis77), (Dis81), and (Dis85), all of which contained C. I. Pigment Blue 15:6 represented by formula (28) as a colorant, was determined using, as a reference value, the glossiness of the pigment dispersion liquid (Dis90) for reference.

The rate of improvement in the glossiness of each of the pigment dispersion liquids (Dis74), (Dis78), (Dis82), and (Dis86), all of which contained C. I. Pigment Blue 16 represented by formula (100) as a colorant, was determined using, as a reference value, the glossiness of the pigment dispersion liquid (Dis91) for reference.

The rate of improvement in the glossiness of each of the pigment dispersion liquids (Dis75), (Dis79), (Dis83), and (Dis87), all of which contained C. I. Pigment Blue 17:1 represented by formula (101) as a colorant, was determined using, as a reference value, the glossiness of the pigment dispersion liquid (Dis92) for reference.

The evaluation criteria of the pigment dispersion liquids are as follows.

A: The rate of improvement in the glossiness is 10% or more.

B: The rate of improvement in the glossiness is 5% or more and less than 10%.

C: The rate of improvement in the glossiness is 0% or more and less than 5%.

D: The rate of improvement in the glossiness is less than 0%.

When the rate of improvement in the glossiness was 5% or more, the pigment dispersibility was determined to be good.

Tables 3-1 and 3-2 show the evaluation results of the pigment dispersibility according to the present invention.

TABLE 3-1

Evaluation results of pigment dispersion liquids

| Pigment dispersion liquid | Azo compound | Pigment | Evaluation of dispersibility (Glossiness) |
|---|---|---|---|
| Dis1 | (29) | 15:3 | A (56) |
| Dis2 | (30) | 15:3 | A (57) |
| Dis3 | (31) | 15:3 | A (55) |
| Dis4 | (32) | 15:3 | A (56) |
| Dis5 | (33) | 15:3 | A (57) |
| Dis6 | (34) | 15:3 | A (54) |
| Dis7 | (35) | 15:3 | A (57) |
| Dis8 | (36) | 15:3 | A (55) |
| Dis9 | (37) | 15:3 | A (54) |
| Dis10 | (38) | 15:3 | A (53) |
| Dis11 | (39) | 15:3 | A (56) |
| Dis12 | (40) | 15:3 | A (57) |
| Dis13 | (41) | 15:3 | A (56) |
| Dis14 | (42) | 15:3 | A (54) |
| Dis15 | (43) | 15:3 | A (58) |
| Dis16 | (44) | 15:3 | A (56) |
| Dis17 | (45) | 15:3 | A (55) |
| Dis18 | (46) | 15:3 | A (53) |
| Dis19 | (47) | 15:3 | A (59) |
| Dis20 | (48) | 15:3 | A (54) |
| Dis21 | (49) | 15:3 | A (60) |
| Dis22 | (50) | 15:3 | A (58) |

TABLE 3-1-continued

| Evaluation results of pigment dispersion liquids | | | |
|---|---|---|---|
| Pigment dispersion liquid | Azo compound | Pigment | Evaluation of dispersibility (Glossiness) |
| Dis23 | (51) | 15:3 | A (57) |
| Dis24 | (52) | 15:3 | A (56) |
| Dis25 | (53) | 15:3 | A (56) |
| Dis26 | (54) | 15:3 | A (59) |
| Dis27 | (55) | 15:3 | A (58) |
| Dis28 | (56) | 15:3 | A (58) |
| Dis29 | (57) | 15:3 | A (58) |
| Dis30 | (58) | 15:3 | A (53) |
| Dis31 | (59) | 15:3 | A (57) |
| Dis32 | (60) | 15:3 | A (55) |
| Dis33 | (61) | 15:3 | A (58) |
| Dis34 | (62) | 15:3 | A (56) |
| Dis35 | (63) | 15:3 | A (57) |
| Dis36 | (64) | 15:3 | A (53) |
| Dis37 | (65) | 15:3 | A (54) |
| Dis38 | (66) | 15:3 | A (59) |
| Dis39 | (67) | 15:3 | A (55) |
| Dis40 | (68) | 15:3 | A (54) |
| Dis41 | (69) | 15:3 | A (53) |
| Dis42 | (70) | 15:3 | A (56) |
| Dis43 | (71) | 15:3 | A (53) |
| Dis44 | (72) | 15:3 | A (55) |
| Dis45 | (73) | 15:3 | A (58) |
| Dis46 | (74) | 15:3 | A (57) |
| Dis47 | (75) | 15:3 | A (59) |
| Dis48 | (76) | 15:3 | A (59) |
| Dis49 | (77) | 15:3 | A (60) |
| Dis50 | (78) | 15:3 | A (64) |
| Dis51 | (79) | 15:3 | A (58) |
| Dis52 | (80) | 15:3 | A (57) |
| Dis53 | (81) | 15:3 | A (57) |
| Dis54 | (82) | 15:3 | A (53) |
| Dis55 | (83) | 15:3 | A (55) |
| Dis56 | (84) | 15:3 | A (54) |
| Dis57 | (85) | 15:3 | A (55) |
| Dis58 | (86) | 15:3 | A (60) |
| Dis59 | (87) | 15:3 | A (59) |
| Dis60 | (88) | 15:3 | A (61) |
| Dis61 | (89) | 15:3 | A (59) |
| Dis62 | (90) | 15:3 | A (59) |
| Dis63 | (91) | 15:3 | A (58) |
| Dis64 | (92) | 15:3 | A (60) |
| Dis65 | (93) | 15:3 | A (60) |
| Dis66 | (94) | 15:3 | A (57) |
| Dis67 | (95) | 15:3 | A (56) |
| Dis68 | (96) | 15:3 | A (59) |
| Dis69 | (97) | 15:3 | A (56) |
| Dis70 | (98) | 15:3 | A (54) |
| Dis71 | (99) | 15:3 | A (54) |
| Dis72 | (29) | 15:4 | A (71) |
| Dis73 | (29) | 15:6 | A (77) |
| Dis74 | (29) | (100) | A (72) |
| Dis75 | (29) | (101) | A (74) |
| Dis76 | (44) | 15:4 | A (73) |
| Dis77 | (44) | 15:6 | A (78) |
| Dis78 | (44) | (100) | A (70) |
| Dis79 | (44) | (101) | A (71) |
| Dis80 | (87) | 15:4 | A (73) |
| Dis81 | (87) | 15:6 | A (77) |
| Dis82 | (87) | (100) | A (71) |
| Dis83 | (87) | (101) | A (71) |
| Dis84 | (94) | 15:4 | A (71) |
| Dis85 | (94) | 15:6 | A (78) |
| Dis86 | (94) | (100) | A (71) |

TABLE 3-2

| Evaluation results of pigment dispersion liquids | | | |
|---|---|---|---|
| Pigment dispersion liquid | Azo compound | Pigment | Evaluation of dispersibility (Glossiness) |
| Dis87 | (94) | (101) | A (73) |
| Dis88 | Not contained | 15:3 | Reference (48) |
| Dis89 | Not contained | 15:4 | Reference (64) |
| Dis90 | Not contained | 15:6 | Reference (69) |
| Dis91 | Not contained | (100) | Reference (63) |
| Dis92 | Not contained | (101) | Reference (63) |
| Dis93 | Comparative compound (1) Comparative compound (2) | 15:3 | B (51) |
| Dis94 | Comparative compound (2) Comparative compound (3) | 15:3 | B (51) |
| Dis95 | Comparative compound (4) | 15:3 | C (49) |
| Dis96 | Comparative compound (5) | 15:3 | A (72) |

In the columns of the pigment in Tables 3-1 and 3-2, 15:3 denotes C. I. Pigment Blue 15:3 represented by formula (28), 15:4 denotes C. I. Pigment Blue 15:4 represented by formula (28), and 15:6 denotes C. I. Pigment Blue 15:6 represented by formula (28).

Example 4

Toners of the present invention were produced by a suspension polymerization method described below.

<Production Example 1 of Toner>

In a 2-L four-necked flask equipped with a high-speed stirrer T. K. Homomixer (manufactured by Primix Corporation), 710 parts of ion-exchange water and 450 parts of a 0.1 mol/L $Na_3PO_4$ aqueous solution were charged. The number of revolutions of the high-speed stirrer was adjusted to 12,000 rpm, and the mixture was heated to 60° C. Next, 68 parts of a 1.0 mol/L $CaCl_2$ aqueous solution was gradually added thereto to prepare an aqueous medium containing $Ca_3(PO_4)_2$ serving as a fine, hardly water-soluble dispersion stabilizer. Next, the composition described below was heated to 60° C. and uniformly dissolved and dispersed with a high-speed stirrer T. K. Homomixer (manufactured by Primix Corporation) at 5,000 rpm.

| | |
|---|---|
| The pigment dispersion liquid (Dis1) | 132 parts |
| Styrene monomer | 46 parts |
| n-Butyl acrylate monomer | 34 parts |
| Polar resin (saturated polyester resin (terephthalic acid-propylene oxide-modified bisphenol A, acid value: 15 mgKOH/g, peak molecular weight: 6,000)) | 10 parts |
| Ester wax (the maximum endothermic peak in DSC measurement = 70° C., Mn = 704) | 25 parts |
| Aluminum salicylate compound (trade name: Bontron E-108, manufactured by Orient Chemical Industries, Co., Ltd.) | 2 parts |
| Divinylbenzene monomer | 0.1 parts |

Next, 10 parts of 2,2'-azobis(2,4-dimethylvaleronitrile) serving as a polymerization initiator was added to the composition. The resulting mixture was charged in the aqueous medium prepared above, and granulated for 15 minutes while the number of revolutions was maintained at 12,000 rpm. Subsequently, the stirrer was exchanged from the high-speed stirrer to propeller stirring blades, and polymerization was continued at a liquid temperature of 60° C. for five hours. The liquid temperature was increased to 80° C., and polymerization was continued for eight hours. After the completion of the polymerization reaction, the remaining monomers were distilled off at 80° C. under reduced pressure, and the resulting liquid was then cooled to 30° C. Thus, a polymer fine particle dispersion liquid was prepared.

The polymer fine particle dispersion liquid was transferred to a washing container, and a dilute hydrochloric acid was added to the dispersion liquid while stirring. The dispersion liquid was stirred at a pH of 1.5 for two hours to dissolve a compound of phosphoric acid and calcium, the compound containing $Ca_3(PO_4)_2$. The dispersion liquid was subjected to a solid-liquid separation by a filter. Thus, polymer fine particles were obtained. The polymer fine particles were charged in water, and the mixture was stirred to prepare a dispersion liquid again. The dispersion liquid was then subjected to a solid-liquid separation by a filter. The redispersion of the polymer fine particles in water and the solid-liquid separation were repeated until the compound of phosphoric acid and calcium, the compound containing $Ca_3(PO_4)_2$, was sufficiently removed. Subsequently, the polymer fine particles that were finally obtained by the solid-liquid separation were thoroughly dried in a dryer. Thus, toner particles were prepared.

Next, 1.0 part of a hydrophobic silica fine powder (having a number-average primary particle diameter of 7 nm) that was surface-treated with hexamethyldisilazane, 0.15 parts of a rutile-type titanium dioxide fine powder (having a number-average primary particle diameter of 45 nm), and 0.5 parts of a rutile-type titanium dioxide fine powder (having a number-average primary particle diameter of 200 nm) relative to 100 parts of the prepared toner particles were dry mixed for five minutes with a Henschel mixer (manufactured by Nippon Coke & Engineering Co., Ltd.). Thus, a toner (Tnr1) was prepared.

<Production Example 2 of Toner>

Toners (Tnr2) to (Tnr87) of the present invention were prepared as in Production Example 1 of the toner except that the pigment dispersion liquid (Dis1) in Production Example 1 of the toner was changed to each of the pigment dispersion liquids (Dis2) to (Dis87).

Comparative Example 2

Toners serving as reference values of evaluation and toners for comparison with respect to the toners of the present invention, the toners being produced in Example 4, were prepared by the methods described below.

Production Example 1 of Toner for Reference

Toners (Tnr88) to (Tnr92) for reference were prepared as in Production Example 1 of the toner except that the pigment dispersion liquid (Dis1) in Production Example 1 of the toner was changed to each of the pigment dispersion liquids (Dis88) to (Dis92).

<Production Example 1 of Toner for Comparison>

Toners (Tnr93) to (Tnr96) for comparison were prepared as in Production Example 1 of the toner except that the pigment dispersion liquid (Dis1) in Production Example 1 of the toner was changed to each of the pigment dispersion liquids (Dis93) to (Dis96).

Example 5

Toners of the present invention were produced by a suspension granulation method described below.

<Production Example 3 of Toner>

First, 180 parts of ethyl acetate, 18 parts of C. I. Pigment Blue 15:3, 1.8 parts of the compound (29) having an azo skeleton structure, and 130 parts of glass bead (diameter: 1 mm) were mixed. The mixture was dispersed in an attritor (manufactured by Nippon Coke & Engineering Co., Ltd.) for three hours, and filtered with a mesh. Thus, a pigment dispersion liquid was prepared.

The composition described below was dispersed in a ball mill for 24 hours. Thus, 200 parts of a toner composition mixed liquid was prepared.

| | |
|---|---|
| The pigment dispersion liquid prepared above | 96.0 parts |
| A polar resin (saturated polyester resin (polycondensate of a propylene oxide-modified bisphenol A and phthalic acid, Tg = 75.9° C., Mw = 11,000, Mn = 4,200, acid value = 11 mgKOH/g)) | 85.0 parts |
| Hydrocarbon wax (Fischer-Tropsch wax, the maximum endothermic peak in DSC measurement = 80° C., Mw = 750) | 9.0 parts |
| Aluminum salicylate compound (Bontron E-108, manufactured by Orient Chemical Industries, Co., Ltd.) | 2 parts |
| Ethyl acetate (solvent) | 10.0 parts |

The composition described below was dispersed in a ball mill for 24 hours to dissolve carboxymethylcellulose. Thus, an aqueous medium was prepared.

| | |
|---|---|
| Calcium carbonate (coated with an acrylic acid copolymer) | 20.0 parts |
| Carboxymethylcellulose (Cellogen BS-H, manufactured by Daiichi Kogyo Seiyaku Co., Ltd.) | 0.5 parts |
| Ion-exchange water | 99.5 parts |

Next, 1,200 parts of the aqueous medium was charged in a high-speed stirrer T. K. Homo Mixer (manufactured by Primix Corporation). Subsequently, 1,000 parts of the toner composition mixed liquid described above was charged therein while the aqueous medium was stirred by rotating blades at a peripheral speed of 20 m/sec, and the resulting mixture was stirred for one minute while the temperature was kept constant at 25° C. Thus, a suspension was prepared.

While 2,200 parts of the suspension was stirred by a Fullzone impeller (manufactured by Kobelco Eco-Solutions Co., Ltd.) at a peripheral speed of 45 m/min, the liquid temperature was kept constant at 40° C., and the gas phase above the surface of the suspension was forcibly suctioned by using a blower to start the removal of the solvent. In this step, after 15 minutes from the start of the removal of the solvent, 75 parts of an aqueous ammonia diluted to 1% as an ionic substance was added thereto. After one hour from the start of the removal of the solvent, 25 parts of the aqueous ammonia was added thereto. Subsequently, after two hours from the start of the removal of the solvent, 25 parts of the aqueous ammonia was added thereto. Lastly, after three hours from the start of the removal of the solvent, 25 parts of the aqueous ammonia was added thereto. Thus, 150 parts of aqueous ammonia was added in total. Furthermore, the resulting liquid was maintained for 17 hours from the start of the removal of the solvent while the liquid temperature was maintained at 40° C. Thus, a toner dispersion liquid in which the solvent (ethyl acetate) had been removed from suspended particles was prepared.

Next, 80 parts of 10 mol/L hydrochloric acid was added to 300 parts of the toner dispersion liquid prepared in the solvent removal step. Furthermore, the resulting mixture was neutralized with a 0.1 mol/L sodium hydroxide aqueous solution. The neutralized mixture was then washed with ion-exchange water by suction filtration, and this washing was repeated four times to prepare a toner cake. The toner cake was dried in a vacuum dryer and then screened by a sieve having an opening of 45 μm to prepare toner particles. The subsequent steps were conducted as in Production Example 1 of the toner. Thus, a toner (Tnr97) was prepared.

<Production Example 4 of Toner>

Toners (Tnr98) to (Tnr167) of the present invention were prepared as in Production Example 3 of the toner except that the compound (29) having an azo skeleton structure in Production Example 3 of the toner was changed to each of the compounds (30) to (99).

<Production Example 5 of Toner>

Toners (Tnr168) to (Tnr171) of the present invention were prepared as in Production Example 3 of the toner except that C. I. Pigment Blue 15:3 represented by formula (28) in Production Example 3 of the toner was changed to each of C. I. Pigment Blue 15:4 represented by formula (28), C. I. Pigment Blue 15:6 represented by formula (28), C. I. Pigment Blue 16 represented by formula (100), and C. I. Pigment Blue 17:1 represented by formula (101).

Production Example 6 of Toner

Toners (Tnr172) to (Tnr183) of the present invention were prepared as in Production Example 5 of the toner except that the compound (29) having an azo skeleton structure in Production Example 5 was changed to each of the compounds (44), (87), and (94).

Comparative Example 3

Toners serving as reference values for evaluation and toners for comparison with respect to the toners of the present invention, the toners being produced in Example 5, were prepared by the methods described below.

<Production Example 2 of Toner for Reference>

A toner (Tnr184) for reference was prepared as in Production Example 3 of the toner except that the compound (29) having an azo skeleton structure in Production Example 3 of the toner was not added.

<Production Example 3 of Toner for Reference>

Toners (Tnr185) to (Tnr188) for reference were prepared as in Production Example 5 of the toner except that the compound (29) having an azo skeleton structure in Production Example 5 of the toner was not added.

<Production Example 2 of Toner for Comparison>

A toner (Tnr189) for comparison was prepared as in Production Example 3 of the toner except that the compound (29) having an azo skeleton structure in Production Example 3 of the toner was changed to 1.8 parts of the Comparative compound 1 and 0.09 parts of the Comparative compound 2.

<Production Example 3 of Toner for Comparison>

A toner (Tnr190) for comparison was prepared as in Production Example 3 of the toner except that the compound (29) having an azo skeleton structure in Production Example 3 of the toner was changed to 1.8 parts of the Comparative compound 3 and 0.09 parts of the Comparative compound 2.

<Production Example 4 of Toner for Comparison>

A toner (Tnr191) for comparison was prepared as in Production Example 3 of the toner except that the compound (29) having an azo skeleton structure in Production Example 3 of the toner was changed to the Comparative compound 4.

<Production Example 5 of Toner for Comparison>

A toner (Tnr192) for comparison was prepared as in Production Example 3 of the toner except that the compound (29) having an azo skeleton structure in Production Example 3 of the toner was changed to the Comparative compound 5.

Example 6

Toners obtained in the present invention were evaluated by the following methods.

Image samples were output using the toners (Tnr1) to (Tnr87) and (Tnr97) to (Tnr183), and image properties described below were compared and evaluated. In the comparison of the image properties, a sheet-passing durability test was conducted using a modified image forming apparatus LBP-5300 (manufactured by CANON KABUSHIKI KAISHA). Regarding the modification of the apparatus, a developing blade in a process cartridge (CRG) was changed to a SUS blade having a thickness of 8 μm. Furthermore, the image forming apparatus was modified so that a blade bias of −200 V could be applied with respect to a developing bias applied to a developing roller functioning as a toner-carrying member.

A Coulter Multisizer (manufactured by Beckman Coulter, Inc.) to which an interface that output the number distribution and the volume distribution (manufactured by Nikkaki Bios Co., Ltd.) and a personal computer were connected was prepared. A 1% NaCl aqueous solution prepared using sodium chloride was used as an electrolyte solution. Alternatively, for example, ISOTON R-II (manufactured by Beckman Coulter, Inc.) may also be used. The specific measurement procedure is described in a catalogue (2002 February version) of the Coulter Multisizer published by Beckman Coulter, Inc., and in an operation manual of the measuring apparatus, but is as follows.

First, 2 to 20 mg of a measurement sample was added to 100 to 150 mL of the aqueous electrolyte solution. The electrolyte solution containing the sample suspended therein was subjected to a dispersion treatment for about one to three minutes with an ultrasonic dispersing device. The volume and the number of toner particles of having a diameter of 2.0 μm or more and 64.0 μm or less were measured using a 100-μm aperture of the Coulter Multisizer. The obtained data were distributed into 16 channels to determine the weight-average particle diameter D4, the number-average particle diameter D1, and D4/D1.

A solid image was formed on transfer paper (75 g/m$^2$ paper) in an environment of normal temperature and normal humidity [N/N (23.5° C., 60% RH)] so that the amount of toner applied was 0.5 mg/cm$^2$. The density of the solid image was measured with a reflection densitometer Spectrolino (manufactured by GretagMacbeth). The coloring power of the toner was evaluated by a rate of improvement in the density of the solid image.

The rate of improvement in the density of the solid image of each of the toners (Tnr1) to (Tnr71), all of which were produced by a suspension polymerization method using C. I. Pigment Blue 15:3 represented by formula (28) as a colorant, was determined using, as a reference value, the density of the solid image of the toner (Tnr88) for reference.

The rate of improvement in the density of the solid image of each of the toners (Tnr72), (Tnr76), (Tnr80), and (Tnr84), all of which were produced by a suspension polymerization method using C. I. Pigment Blue 15:4 represented by formula (28) as a colorant, was determined using, as a reference value, the density of the solid image of the toner (Tnr89) for reference.

The rate of improvement in the density of the solid image of each of the toners (Tnr73), (Tnr77), (Tnr81), and (Tnr85), all of which were produced by a suspension polymerization method using C. I. Pigment Blue 15:6 represented by formula (28) as a colorant, was determined using, as a reference value, the density of the solid image of the toner (Tnr90) for reference.

The rate of improvement in the density of the solid image of each of the toners (Tnr74), (Tnr78), (Tnr82), and (Tnr86), all of which were produced by a suspension polymerization method using C. I. Pigment Blue 16 represented by formula (100) as a colorant, was determined using, as a reference value, the density of the solid image of the toner (Tnr91) for reference.

The rate of improvement in the density of the solid image of each of the toners (Tnr75), (Tnr79), (Tnr83), and (Tnr87), all of which were produced by a suspension polymerization method using C. I. Pigment Blue 17:1 represented by formula (101) as a colorant, was determined using, as a reference value, the density of the solid image of the toner (Tnr92) for reference.

The rate of improvement in the density of the solid image of each of the toners (Tnr97) to (Tnr167), all of which were produced by a suspension granulation method using C. I. Pigment Blue 15:3 represented by formula (28) as a colorant, was determined using, as a reference value, the density of the solid image of the toner (Tnr184) for reference.

The rate of improvement in the density of the solid image of each of the toners (Tnr168), (Tnr172), (Tnr176), and (Tnr180), all of which were produced by a suspension granulation method using C. I. Pigment Blue 15:4 represented by formula (28) as a colorant, was determined using, as a reference value, the density of the solid image of the toner (Tnr185) for reference.

The rate of improvement in the density of the solid image of each of the toners (Tnr169), (Tnr173), (Tnr177), and (Tnr181), all of which were produced by a suspension granulation method using C. I. Pigment Blue 15:6 represented by formula (28) as a colorant, was determined using, as a reference value, the density of the solid image of the toner (Tnr186) for reference.

The rate of improvement in the density of the solid image of each of the toners (Tnr170), (Tnr174), (Tnr178), and (Tnr182), all of which were produced by a suspension granulation method using C. I. Pigment Blue 16 represented by formula (100) as a colorant, was determined using, as a reference value, the density of the solid image of the toner (Tnr187) for reference.

The rate of improvement in the density of the solid image of each of the toners (Tnr171), (Tnr175), (Tnr179), and (Tnr183), all of which were produced by a suspension granulation method using C. I. Pigment Blue 17:1 represented by formula (101) as a colorant, was determined using, as a reference value, the density of the solid image of the toner (Tnr188) for reference.

Evaluation criteria of the rate of improvement in the density of the solid image are described below.

A: The rate of improvement in the density of the solid image is 30% or more.

B: The rate of improvement in the density of the solid image is 20% or more and less than 30%.

C: The rate of improvement in the density of the solid image is 10% or more and less than 20%.

D: The rate of improvement in the density of the solid image is less than 10%.

When the rate of improvement in the density of the solid image was 10% or more, the toner was determined to have a satisfactory coloring power.

Tables 4-1 to 4-3 show the evaluation results of the color tone of the toners of the present invention produced by a suspension polymerization method. Tables 5-1 to 5-3 show the evaluation results of the color tone of the toners of the present invention produced by a suspension granulation method.

An image output test in which an image having a coverage rate of 2% was printed out on transfer paper (75 g/m$^2$ paper) up to 10,000 sheet was conducted in an environment of normal temperature and normal humidity [N/N (23.5° C., 60% RH)] and in an environment of a high temperature and a high humidity [H/H (30° C., 80% RH)]. In this test, at the end of the evaluation of durability, an image having a white background region was output. A fog density (%) (=Dr (%)−Ds (%)) was calculated from a difference between the whiteness (reflectance Ds (%)) of the white background region of the printed-out image and the whiteness (average reflectance Dr (%)) of the transfer paper, the whiteness of the white background region and the whiteness of the transfer paper being measured with a reflectometer (MODEL TC-6DS manufactured by Tokyo Denshoku Co., Ltd.). Thus, fogging at the end of the evaluation of durability was evaluated on the basis of the criteria below.

A: The fog density is less than 1.0%.

B: The fog density is 1.0% or more and less than 2.0%.

C: The fog density is 2.0% or more and less than 3.0%.

D: The fog density is 3.0% or more.

A fog density of less than 3% was determined to be a level at which no practical problem occurs.

Tables 4-1 to 4-3 show the evaluation results of fogging of the toners of the present invention produced by a suspension polymerization method. Tables 5-1 to 5-3 show the evaluation results of fogging of the toners of the present invention produced by a suspension granulation method.

An image output test in which an image having a coverage rate of 2% was printed out on transfer paper (75 g/m$^2$ paper) up to 10,000 sheets was conducted in an environment of a high temperature and a high humidity [H/H (30° C., 80% RH)]. In this test, at the end of the evaluation of durability, transfer efficiency was measured. A solid image onto which a toner was applied in an amount of 0.65 mg/cm$^2$ was developed on a drum, and then transferred to transfer paper (75 g/m$^2$ paper) to prepare an unfixed image. The transfer efficiency was determined from a change between the weight of the toner on the drum and the weight of the toner on the transfer paper. (In the case where the total amount of toner on the drum is transferred to the transfer paper, the transfer efficiency is determined to be 100%.)

A: The transfer efficiency is 90% or more.

B: The transfer efficiency is 80% or more and less than 90%.

C: The transfer efficiency is 70% or more and less than 80%.

D: The transfer efficiency is less than 70%.

A transfer efficiency of 70% or more was determined to be a satisfactory transfer efficiency.

Tables 4-1 to 4-3 show the evaluation results of the transfer efficiency of the toners of the present invention produced by a suspension polymerization method. Tables 5-1 to 5-3 show the evaluation results of the transfer efficiency of the toners of the present invention produced by a suspension granulation method.

Comparative Example 4

The color tone, fogging, and transfer efficiency of each of the toners (Tnr93) to (Tnr96) and (Tnr189) to (Tnr192) for comparison were evaluated as in Example 6.

The rate of improvement in the density of the solid image of each of the toners (Tnr93) to (Tnr96) for comparison was determined using, as a reference value, the density of the solid image of the toner (Tnr88) for reference.

The rate of improvement in the density of the solid image of each of the toners (Tnr189) to (Tnr192) for comparison was determined using, as a reference value, the density of the solid image of the toner (Tnr184) for reference.

Table 4-3 shows the evaluation results of the toners for comparison produced by a suspension polymerization method. Table 5-3 shows the evaluation results of the toners for comparison produced by a suspension granulation method.

TABLE 4-1

Evaluation results of toners of the present invention produce by a suspension polymerization method

| Toner No. | Pigment dispersion liquid No. | Azo compound No. | Pigment | Toner particles D4 [μm] | D4/D1 | Rate of improvement in density | Fogging [N/N] | Fogging [H/H] | Transfer property |
|---|---|---|---|---|---|---|---|---|---|
| Tnr1 | Dis1 | (29) | 15:3 | 6.15 | 1.12 | A | A | A | A |
| Tnr2 | Dis2 | (30) | 15:3 | 6.30 | 1.28 | A | A | A | A |
| Tnr3 | Dis3 | (31) | 15:3 | 6.38 | 1.23 | A | A | A | A |
| Tnr4 | Dis4 | (32) | 15:3 | 6.12 | 1.10 | A | A | A | A |
| Tnr5 | Dis5 | (33) | 15:3 | 6.11 | 1.12 | A | A | A | A |
| Tnr6 | Dis6 | (34) | 15:3 | 6.29 | 1.20 | A | A | A | A |
| Tnr7 | Dis7 | (35) | 15:3 | 6.40 | 1.26 | A | A | A | A |
| Tnr8 | Dis8 | (36) | 15:3 | 6.14 | 1.19 | A | A | A | A |
| Tnr9 | Dis9 | (37) | 15:3 | 6.09 | 1.15 | A | A | A | A |
| Tnr10 | Dis10 | (38) | 15:3 | 6.22 | 1.20 | A | A | A | A |
| Tnr11 | Dis11 | (39) | 15:3 | 6.28 | 1.25 | A | A | A | A |
| Tnr12 | Dis12 | (40) | 15:3 | 6.31 | 1.24 | A | A | A | A |
| Tnr13 | Dis13 | (41) | 15:3 | 6.34 | 1.30 | A | A | A | A |
| Tnr14 | Dis14 | (42) | 15:3 | 6.18 | 1.16 | A | A | A | A |
| Tnr15 | Dis15 | (43) | 15:3 | 6.33 | 1.31 | A | A | A | A |
| Tnr16 | Dis16 | (44) | 15:3 | 6.28 | 1.28 | A | A | A | A |
| Tnr17 | Dis17 | (45) | 15:3 | 6.40 | 1.33 | A | A | A | A |
| Tnr18 | Dis18 | (46) | 15:3 | 6.15 | 1.16 | A | A | A | A |
| Tnr19 | Dis19 | (47) | 15:3 | 6.23 | 1.22 | A | A | A | A |
| Tnr20 | Dis20 | (48) | 15:3 | 6.32 | 1.28 | A | A | A | A |
| Tnr21 | Dis21 | (49) | 15:3 | 6.22 | 1.24 | A | A | A | A |
| Tnr22 | Dis22 | (50) | 15:3 | 6.19 | 1.22 | A | A | A | A |
| Tnr23 | Dis23 | (51) | 15:3 | 6.24 | 1.24 | A | A | A | A |
| Tnr24 | Dis24 | (52) | 15:3 | 6.33 | 1.34 | A | A | A | A |
| Tnr25 | Dis25 | (53) | 15:3 | 6.39 | 1.35 | A | A | A | A |
| Tnr26 | Dis26 | (54) | 15:3 | 6.30 | 1.33 | A | A | A | A |
| Tnr27 | Dis27 | (55) | 15:3 | 6.40 | 1.32 | A | A | A | A |
| Tnr28 | Dis28 | (56) | 15:3 | 6.39 | 1.34 | A | A | A | A |
| Tnr29 | Dis29 | (57) | 15:3 | 6.18 | 1.22 | A | A | A | A |
| Tnr30 | Dis30 | (58) | 15:3 | 6.12 | 1.19 | A | A | A | A |
| Tnr31 | Dis31 | (59) | 15:3 | 6.22 | 1.26 | A | A | A | A |
| Tnr32 | Dis32 | (60) | 15:3 | 6.14 | 1.14 | A | A | A | A |
| Tnr33 | Dis33 | (61) | 15:3 | 6.33 | 1.28 | A | A | A | A |
| Tnr34 | Dis34 | (62) | 15:3 | 6.22 | 1.22 | A | A | A | A |
| Tnr35 | Dis35 | (63) | 15:3 | 6.15 | 1.20 | A | A | A | A |
| Tnr36 | Dis36 | (64) | 15:3 | 6.18 | 1.20 | A | A | A | A |
| Tnr37 | Dis37 | (65) | 15:3 | 6.07 | 1.11 | A | A | A | A |
| Tnr38 | Dis38 | (66) | 15:3 | 6.22 | 1.27 | A | A | A | A |
| Tnr39 | Dis39 | (67) | 15:3 | 6.26 | 1.27 | A | A | A | A |
| Tnr40 | Dis40 | (68) | 15:3 | 6.21 | 1.26 | A | A | A | A |
| Tnr41 | Dis41 | (69) | 15:3 | 6.14 | 1.15 | A | A | A | A |
| Tnr42 | Dis42 | (70) | 15:3 | 6.28 | 1.26 | A | A | A | A |

TABLE 4-2

Evaluation results of toners of the present invention produce by a suspension polymerization method

| Toner No. | Pigment dispersion liquid No. | Azo compound No. | Pigment | Toner particles D4 [μm] | D4/D1 | Rate of improvement in density | Fogging [N/N] | Fogging [H/H] | Transfer property |
|---|---|---|---|---|---|---|---|---|---|
| Tnr43 | Dis43 | (71) | 15:3 | 6.24 | 1.29 | A | A | A | A |
| Tnr44 | Dis44 | (72) | 15:3 | 6.22 | 1.14 | A | A | A | A |
| Tnr45 | Dis45 | (73) | 15:3 | 5.98 | 1.36 | A | A | A | A |
| Tnr46 | Dis46 | (74) | 15:3 | 6.31 | 1.26 | A | A | A | A |
| Tnr47 | Dis47 | (75) | 15:3 | 6.30 | 1.25 | A | A | A | A |
| Tnr48 | Dis48 | (76) | 15:3 | 6.20 | 1.22 | A | A | A | A |
| Tnr49 | Dis49 | (77) | 15:3 | 6.19 | 1.24 | A | A | A | A |
| Tnr50 | Dis50 | (78) | 15:3 | 6.33 | 1.28 | A | A | A | A |

TABLE 4-2-continued

Evaluation results of toners of the present invention produce by a suspension polymerization method

| Toner No. | Pigment dispersion liquid No. | Azo compound No. | Pigment | Toner particles D4 [μm] | D4/D1 | Rate of improvement in density | Fogging [N/N] | Fogging [H/H] | Transfer property |
|---|---|---|---|---|---|---|---|---|---|
| Tnr51 | Dis51 | (79) | 15:3 | 6.28 | 1.15 | A | A | A | A |
| Tnr52 | Dis52 | (80) | 15:3 | 6.15 | 1.13 | A | A | A | A |
| Tnr53 | Dis53 | (81) | 15:3 | 6.20 | 1.20 | A | A | A | A |
| Tnr54 | Dis54 | (82) | 15:3 | 6.19 | 1.19 | A | A | A | A |
| Tnr55 | Dis55 | (83) | 15:3 | 6.24 | 1.22 | A | A | A | A |
| Tnr56 | Dis56 | (84) | 15:3 | 6.24 | 1.21 | A | A | A | A |
| Tnr57 | Dis57 | (85) | 15:3 | 6.28 | 1.26 | A | A | A | A |
| Tnr58 | Dis58 | (86) | 15:3 | 6.33 | 1.28 | A | A | A | A |
| Tnr59 | Dis59 | (87) | 15:3 | 6.11 | 1.20 | A | A | A | A |
| Tnr60 | Dis60 | (88) | 15:3 | 6.18 | 1.22 | A | A | A | A |
| Tnr61 | Dis61 | (89) | 15:3 | 6.11 | 1.15 | A | A | A | A |
| Tnr62 | Dis62 | (90) | 15:3 | 6.27 | 1.27 | A | A | A | A |
| Tnr63 | Dis63 | (91) | 15:3 | 6.31 | 1.33 | A | A | A | A |
| Tnr64 | Dis64 | (92) | 15:3 | 6.11 | 1.24 | A | A | A | A |
| Tnr65 | Dis65 | (93) | 15:3 | 6.22 | 1.28 | A | A | A | A |
| Tnr66 | Dis66 | (94) | 15:3 | 6.16 | 1.14 | A | A | A | A |
| Tnr67 | Dis67 | (95) | 15:3 | 6.30 | 1.36 | A | A | A | A |
| Tnr68 | Dis68 | (96) | 15:3 | 6.28 | 1.30 | A | A | A | A |
| Tnr69 | Dis69 | (97) | 15:3 | 6.36 | 1.39 | A | A | A | A |
| Tnr70 | Dis70 | (98) | 15:3 | 6.42 | 1.39 | A | A | A | A |
| Tnr71 | Dis71 | (99) | 15:3 | 6.33 | 1.28 | A | A | A | A |
| Tnr72 | Dis72 | (29) | 15:4 | 6.12 | 1.20 | A | A | A | A |
| Tnr73 | Dis73 | (29) | 15:6 | 6.31 | 1.28 | A | A | A | A |
| Tnr74 | Dis74 | (29) | (100) | 6.34 | 1.27 | A | A | A | A |
| Tnr75 | Dis75 | (29) | (101) | 6.25 | 1.19 | A | A | A | A |
| Tnr76 | Dis76 | (44) | 15:4 | 6.47 | 1.29 | A | A | A | A |
| Tnr77 | Dis77 | (44) | 15:6 | 6.32 | 1.31 | A | A | A | A |
| Tnr78 | Dis78 | (44) | (100) | 6.15 | 1.22 | A | A | A | A |
| Tnr79 | Dis79 | (44) | (101) | 6.23 | 1.26 | A | A | A | A |
| Tnr80 | Dis80 | (87) | 15:4 | 6.22 | 1.28 | A | A | A | A |
| Tnr81 | Dis81 | (87) | 15:6 | 6.20 | 1.24 | A | A | A | A |
| Tnr82 | Dis82 | (87) | (100) | 6.34 | 1.30 | A | A | A | A |
| Tnr83 | Dis83 | (87) | (101) | 6.30 | 1.29 | A | A | A | A |

TABLE 4-3

Evaluation results of toners of the present invention produce by a suspension polymerization method

| Toner No. | Pigment dispersion liquid No. | Azo compound No. | Pigment | Toner particles D4 [μm] | D4/D1 | Rate of improvement in density | Fogging [N/N] | Fogging [H/H] | Transfer property |
|---|---|---|---|---|---|---|---|---|---|
| Tnr84 | Dis84 | (94) | 15:4 | 6.30 | 1.26 | A | A | A | A |
| Tnr85 | Dis85 | (94) | 15:6 | 6.25 | 1.25 | A | A | A | A |
| Tnr86 | Dis86 | (94) | (100) | 6.24 | 1.22 | A | A | A | A |
| Tnr87 | Dis87 | (94) | (101) | 6.18 | 1.20 | A | A | A | A |
| Tnr88 | Dis88 | Not contained | 15:3 | 6.17 | 1.21 | Reference | C | C | C |
| Tnr89 | Dis89 | Not contained | 15:4 | 6.19 | 1.24 | Reference | C | C | C |
| Tnr90 | Dis90 | Not contained | 15:6 | 6.13 | 1.25 | Reference | C | C | C |
| Tnr91 | Dis91 | Not contained | (100) | 6.10 | 1.25 | Reference | C | C | C |
| Tnr92 | Dis92 | Not contained | (101) | 6.12 | 1.28 | Reference | C | C | C |
| Tnr93 | Dis93 | Comparative compound (1) Comparative compound (2) | 15:3 | 6.18 | 1.26 | B | B | B | B |
| Tnr94 | Dis94 | Comparative compound (2) Comparative compound (3) | 15:3 | 6.24 | 1.21 | B | B | B | B |
| Tnr95 | Dis95 | Comparative compound (4) | 15:3 | 6.24 | 1.24 | C | D | D | D |
| Tnr96 | Dis96 | Comparative compound (5) | 15:3 | 7.57 | 1.45 | C | D | D | D |

In the columns of the pigment in Tables 4-1 to 4-3, 15:3 denotes C. I. Pigment Blue 15:3 represented by formula (28), 15:4 denotes C. I. Pigment Blue 15:4 represented by formula (28), and 15:6 denotes C. I. Pigment Blue 15:6 represented by formula (28).

TABLE 5-1

Evaluation results of toners of the present invention produce by a suspension granulation method

| Toner No. | Azo compound No. | Pigment | Toner particles D4 [μm] | D4/D1 | Rate of improvement in density | Fogging [N/N] | Fogging [H/H] | Transfer property |
|---|---|---|---|---|---|---|---|---|
| Tnr97 | (29) | 15:3 | 6.12 | 1.19 | A | A | A | A |
| Tnr98 | (30) | 15:3 | 6.22 | 1.22 | A | A | A | A |
| Tnr99 | (31) | 15:3 | 6.32 | 1.26 | A | A | A | A |
| Tnr100 | (32) | 15:3 | 6.24 | 1.27 | A | A | A | A |
| Tnr101 | (33) | 15:3 | 6.10 | 1.19 | A | A | A | A |
| Tnr102 | (34) | 15:3 | 6.29 | 1.26 | A | A | A | A |
| Tnr103 | (35) | 15:3 | 6.35 | 1.30 | A | A | A | A |
| Tnr104 | (36) | 15:3 | 6.42 | 1.29 | A | A | A | A |
| Tnr105 | (37) | 15:3 | 6.22 | 1.17 | A | A | A | A |
| Tnr106 | (38) | 15:3 | 6.28 | 1.21 | A | A | A | A |
| Tnr107 | (39) | 15:3 | 6.31 | 1.25 | A | A | A | A |
| Tnr108 | (40) | 15:3 | 6.20 | 1.17 | A | A | A | A |
| Tnr109 | (41) | 15:3 | 6.14 | 1.14 | A | A | A | A |
| Tnr110 | (42) | 15:3 | 6.08 | 1.20 | A | A | A | A |
| Tnr111 | (43) | 15:3 | 6.22 | 1.22 | A | A | A | A |
| Tnr112 | (44) | 15:3 | 6.18 | 1.16 | A | A | A | A |
| Tnr113 | (45) | 15:3 | 6.14 | 1.14 | A | A | A | A |
| Tnr114 | (46) | 15:3 | 6.23 | 1.22 | A | A | A | A |
| Tnr115 | (47) | 15:3 | 6.13 | 1.24 | A | A | A | A |
| Tnr116 | (48) | 15:3 | 6.35 | 1.30 | A | A | A | A |
| Tnr117 | (49) | 15:3 | 6.24 | 1.28 | A | A | A | A |
| Tnr118 | (50) | 15:3 | 6.18 | 1.19 | A | A | A | A |
| Tnr119 | (51) | 15:3 | 6.22 | 1.22 | A | A | A | A |
| Tnr120 | (52) | 15:3 | 6.30 | 1.26 | A | A | A | A |
| Tnr121 | (53) | 15:3 | 6.32 | 1.28 | A | A | A | A |
| Tnr122 | (54) | 15:3 | 6.29 | 1.26 | A | A | A | A |
| Tnr123 | (55) | 15:3 | 6.34 | 1.30 | A | A | A | A |
| Tnr124 | (56) | 15:3 | 6.29 | 1.28 | A | A | A | A |
| Tnr125 | (57) | 15:3 | 6.13 | 1.23 | A | A | A | A |
| Tnr126 | (58) | 15:3 | 6.22 | 1.31 | A | A | A | A |
| Tnr127 | (59) | 15:3 | 6.33 | 1.33 | A | A | A | A |
| Tnr128 | (60) | 15:3 | 6.07 | 1.24 | A | A | A | A |
| Tnr129 | (61) | 15:3 | 6.33 | 1.36 | A | A | A | A |
| Tnr130 | (62) | 15:3 | 6.26 | 1.27 | A | A | A | A |
| Tnr131 | (63) | 15:3 | 6.19 | 1.20 | A | A | A | A |
| Tnr132 | (64) | 15:3 | 6.29 | 1.26 | A | A | A | A |
| Tnr133 | (65) | 15:3 | 6.22 | 1.24 | A | A | A | A |
| Tnr134 | (66) | 15:3 | 6.18 | 1.15 | A | A | A | A |
| Tnr135 | (67) | 15:3 | 6.22 | 1.16 | A | A | A | A |
| Tnr136 | (68) | 15:3 | 6.33 | 1.31 | A | A | A | A |
| Tnr137 | (69) | 15:3 | 6.48 | 1.35 | A | A | A | A |
| Tnr138 | (70) | 15:3 | 6.26 | 1.24 | A | A | A | A |

TABLE 5-2

Evaluation results of toners of the present invention produce by a suspension granulation method

| Toner No. | Azo compound No. | Pigment | Toner particles D4 [μm] | D4/D1 | Rate of improvement in density | Fogging [N/N] | Fogging [H/H] | Transfer property |
|---|---|---|---|---|---|---|---|---|
| Tnr139 | (71) | 15:3 | 6.18 | 1.22 | A | A | A | A |
| Tnr140 | (72) | 15:3 | 6.14 | 1.15 | A | A | A | A |
| Tnr141 | (73) | 15:3 | 6.32 | 1.27 | A | A | A | A |
| Tnr142 | (74) | 15:3 | 6.37 | 1.29 | A | A | A | A |
| Tnr143 | (75) | 15:3 | 6.30 | 1.33 | A | A | A | A |
| Tnr144 | (76) | 15:3 | 6.40 | 1.34 | A | A | A | A |
| Tnr145 | (77) | 15:3 | 6.19 | 1.17 | A | A | A | A |
| Tnr146 | (78) | 15:3 | 6.33 | 1.26 | A | A | A | A |

TABLE 5-2-continued

| Evaluation results of toners of the present invention produce by a suspension granulation method | | | | | | | | |
|---|---|---|---|---|---|---|---|---|
| | | | Toner particles | | | | | |
| Toner No. | Azo compound No. | Pigment | D4 [μm] | D4/D1 | Rate of improvement in density | Fogging [N/N] | Fogging [H/H] | Transfer property |
| Tnr147 | (79) | 15:3 | 6.25 | 1.20 | A | A | A | A |
| Tnr148 | (80) | 15:3 | 6.24 | 1.24 | A | A | A | A |
| Tnr149 | (81) | 15:3 | 6.13 | 1.17 | A | A | A | A |
| Tnr150 | (82) | 15:3 | 6.22 | 1.26 | A | A | A | A |
| Tnr151 | (83) | 15:3 | 6.09 | 1.22 | A | A | A | A |
| Tnr152 | (84) | 15:3 | 6.33 | 1.33 | A | A | A | A |
| Tnr153 | (85) | 15:3 | 6.27 | 1.23 | A | A | A | A |
| Tnr154 | (86) | 15:3 | 6.30 | 1.26 | A | A | A | A |
| Tnr155 | (87) | 15:3 | 6.18 | 1.15 | A | A | A | A |
| Tnr156 | (88) | 15:3 | 6.17 | 1.12 | A | A | A | A |
| Tnr157 | (89) | 15:3 | 6.44 | 1.36 | A | A | A | A |
| Tnr158 | (90) | 15:3 | 6.26 | 1.24 | A | A | A | A |
| Tnr159 | (91) | 15:3 | 6.33 | 1.30 | A | A | A | A |
| Tnr160 | (92) | 15:3 | 6.22 | 1.25 | A | A | A | A |
| Tnr161 | (93) | 15:3 | 6.26 | 1.26 | A | A | A | A |
| Tnr162 | (94) | 15:3 | 6.30 | 1.34 | A | A | A | A |
| Tnr163 | (95) | 15:3 | 6.25 | 1.22 | A | A | A | A |
| Tnr164 | (96) | 15:3 | 6.14 | 1.15 | A | A | A | A |
| Tnr165 | (97) | 15:3 | 6.33 | 1.34 | A | A | A | A |
| Tnr166 | (98) | 15:3 | 6.24 | 1.30 | A | A | A | A |
| Tnr167 | (99) | 15:3 | 6.20 | 1.25 | A | A | A | A |
| Tnr168 | (29) | 15:4 | 6.34 | 1.24 | A | A | A | A |
| Tnr169 | (29) | 15:6 | 6.42 | 1.38 | A | A | A | A |
| Tnr170 | (29) | (100) | 6.30 | 1.27 | A | A | A | A |
| Tnr171 | (29) | (101) | 6.20 | 1.22 | A | A | A | A |
| Tnr172 | (44) | 15:4 | 6.23 | 1.26 | A | A | A | A |
| Tnr173 | (44) | 15:6 | 6.36 | 1.27 | A | A | A | A |
| Tnr174 | (44) | (100) | 6.40 | 1.36 | A | A | A | A |
| Tnr175 | (44) | (101) | 6.38 | 1.36 | A | A | A | A |
| Tnr176 | (87) | 15:4 | 6.29 | 1.22 | A | A | A | A |
| Tnr177 | (87) | 15:6 | 6.30 | 1.26 | A | A | A | A |
| Tnr178 | (87) | (100) | 6.29 | 1.24 | A | A | A | A |
| Tnr179 | (87) | (101) | 6.21 | 1.19 | A | A | A | A |

TABLE 5-3

| Evaluation results of toners of the present invention produce by a suspension granulation method | | | | | | | | |
|---|---|---|---|---|---|---|---|---|
| | | | Toner particles | | | | | |
| Toner No. | Azo compound No. | Pigment | D4 [μm] | D4/D1 | Rate of improvement in density | Fogging [N/N] | Fogging [H/H] | Transfer property |
| Tnr180 | (94) | 15:4 | 6.22 | 1.24 | A | A | A | A |
| Tnr181 | (94) | 15:6 | 6.34 | 1.29 | A | A | A | A |
| Tnr182 | (94) | (100) | 6.36 | 1.33 | A | A | A | A |
| Tnr183 | (94) | (101) | 6.19 | 1.19 | A | A | A | A |
| Tnr184 | Not contained | 15:3 | 6.21 | 1.24 | Reference | C | C | C |
| Tnr185 | Not contained | 15:4 | 6.22 | 1.24 | Reference | C | C | C |
| Tnr186 | Not contained | 15:6 | 6.22 | 1.23 | Reference | C | C | C |
| Tnr187 | Not contained | (100) | 6.27 | 1.25 | Reference | C | C | C |
| Tnr188 | Not contained | (101) | 6.29 | 1.28 | Reference | C | C | C |
| Tnr189 | Comparative compound (1) Comparative compound (2) | 15:3 | 6.17 | 1.27 | B | B | B | B |
| Tnr190 | Comparative compound (2) Comparative compound (3) | 15:3 | 6.13 | 1.21 | B | B | B | B |
| Tnr191 | Comparative compound (4) | 15:3 | 6.18 | 1.38 | C | D | D | D |
| Tnr192 | Comparative compound (5) | 15:3 | 7.41 | 1.67 | C | D | D | D |

In the columns of the pigment in Tables 5-1 to 5-3, 15:3 denotes C. I. Pigment Blue 15:3 represented by formula (28), 15:4 denotes C. I. Pigment Blue 15:4 represented by formula (28), and 15:6 denotes C. I. Pigment Blue 15:6 represented by formula (28).

As is apparent from Tables 3-1 and 3-2, it was confirmed that dispersibility of a phthalocyanine pigment to a binder resin is improved by using a compound having an azo skeleton structure.

As is apparent from Tables 4-1 to 4-3, it was confirmed that, by using a compound having an azo skeleton structure, dispersibility of a phthalocyanine pigment to a binder resin is improved and a cyan toner having a good coloring power can be provided. It was also confirmed that, by using a compound having an azo skeleton structure, fogging is suppressed and a cyan toner having a high transfer efficiency can be provided.

As is apparent from Tables 5-1 to 5-3, it was confirmed that, also in the case of the granulation method, dispersibility of a phthalocyanine pigment to a binder resin is improved and a cyan toner having a good coloring power can be provided. It was also confirmed that fogging is suppressed and a cyan toner having a high transfer efficiency can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-043077 filed Feb. 29, 2012, which is hereby incorporated by reference herein in its entirety.

What is claimed is:

1. A cyan toner comprising toner particles, each of which contains a binder resin, a compound and a phthalocyanine pigment the compound having a structure, a polymer portion of which has a monomer unit represented by formula (2) and is bound to a structure represented by formula (1);

Formula (1)

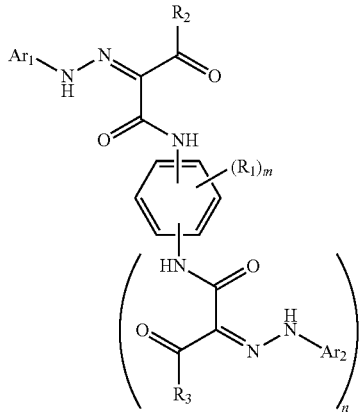

where at least one of $R_2$, $R_3$, $Ar_1$, and $Ar_2$ is bound to the polymer portion directly or through a linking group, wherein each $R_1$ independently represents a hydrogen atom, a halogen atom, an alkyl group, an alkoxy group, a trifluoromethyl group, a cyano group, or a hydroxyl group, $R_2$ and $R_3$ not bound to the polymer portion independently represent a monovalent group selected from the group consisting of an alkyl group, a phenyl group, an $OR_4$ group, and an $NR_5R_6$ group, $R_4$ to $R_6$ independently represent a hydrogen atom, an alkyl group, a phenyl group, or an aralkyl group, $Ar_1$ and $Ar_2$ not bound to the polymer portion independently represent an aryl group, wherein any one of $R_2$ and $R_3$ bound to the polymer portion independently represents a divalent group, a hydrogen atom of which is removed from the corresponding monovalent group of any one of $R_2$ and $R_3$;

any one of $Ar_1$ and $Ar_2$ bound to the polymer portion independently represents a divalent group, a hydrogen atom of which is removed from the corresponding aryl group of any one of $Ar_1$ and $Ar_2$, m represents an integer of 3 or 4, n represents an integer of 1 or 2, and n +m is 5, Formula (2)

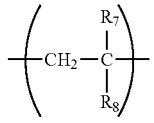

where $R_7$ represents a hydrogen atom or an alkyl group, and $R_8$ represents a phenyl group, a carboxyl group, a carboxylic acid ester group, or a carboxylic acid amide group.

2. The cyan toner according to claim 1, wherein the structure represented by formula (1) is represented by formula (3) below:

Formula (3)

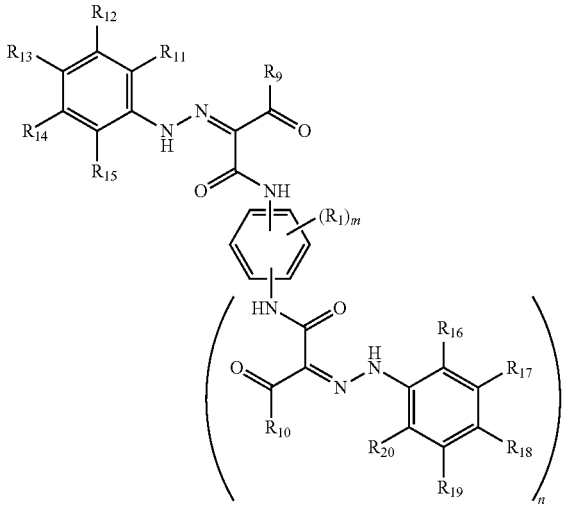

where each $R_1$ independently represents a hydrogen atom, a halogen atom, an alkyl group, an alkoxy group, a trifluoromethyl group, a cyano group, or a hydroxyl group, $R_9$ and $R_{10}$ independently represent an alkyl group, a phenyl group, an $OR_4$ group, or an $NR_5R_6$ group; $R_4$ to $R_6$ independently represent a hydrogen atom, an alkyl group, a phenyl group, or an aralkyl group, $R_{11}$ to $R_{20}$ independently represent a linking group or a monovalent group selected from the group consisting of a hydrogen atom, a $COOR_{21}$ group, a CON $R_{22}R_{23}$ group, an $NHCOR_{24}$ group, and an $OR_{25}$ group, $R_{21}$ to $R_{25}$ each independently represent a hydrogen atom, an alkyl group, an aryl group, or an aralkyl group, wherein at least one of $R_{11}$ to $R_{20}$ is the linking group that binds to the polymer portion, m represents an integer of 3 or 4, n represents an integer of 1 or 2, and n +m is 5.

3. The cyan toner according to claim 1, wherein the structure represented by formula (1) is a structure represented by formula (4) below:

Formula (4)

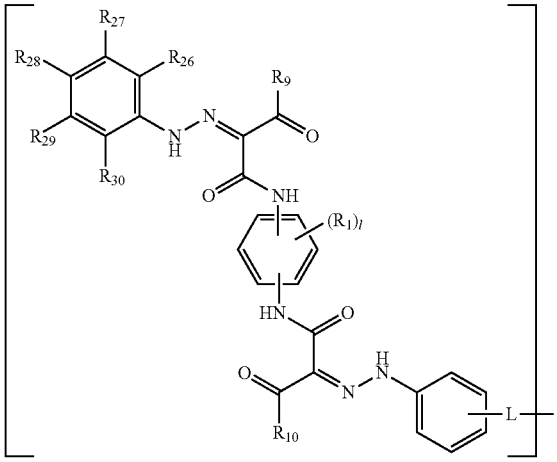

where each $R_1$ independently represents a hydrogen atom, a halogen atom, an alkyl group, an alkoxy group, a trifluoromethyl group, a cyano group, or a hydroxyl group, $R_9$ and $R_{10}$ independently represent an alkyl group, a phenyl group, an $OR_4$ group, or an $NR_5R_6$ group; $R_4$ to $R_6$ independently represent a hydrogen atom, an alkyl group, a phenyl group, or an aralkyl group, $R_{26}$ to $R_{30}$ independently represent a hydrogen atom, a $COOR_{21}$ group, a CON $R_{22}$ $R_{23}$ group, an $NHCOR_{24}$ group, or an $OR_{25}$ group, $R_{21}$ to $R_{25}$ independently represent a hydrogen atom, an alkyl group, an aryl group, or an aralkyl group, I is 4, and L represents a divalent linking group that binds to the polymer portion.

4. The cyan toner according to claim 3, wherein the structure represented by formula (1) is represented by formula (4), at least one of $R_{26}$ to $R_{30}$ in formula (4) represents a $COOR_{21}$ group or a $CONR_{22}R_{23}$ group, $R_{21}$ to $R_{23}$ independently represent a hydrogen atom, an alkyl group, an aryl group, or an aralkyl group, and each $R_1$ is a hydrogen atom.

5. The cyan toner according to claim 1, wherein the structure represented by formula (1) is a structure represented by formula (6):

Formula (6)

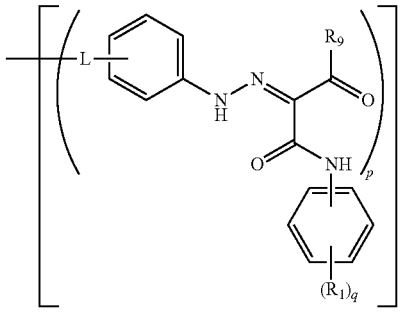

where each $R_1$ independently represents a hydrogen atom, a halogen atom, an alkyl group, an alkoxy group, a trifluoromethyl group, a cyano group, or a hydroxyl group, $R_9$ represents an alkyl group, a phenyl group, an $OR_4$ group, or an $NR_5R_6$ group;

$R_4$ to $R_6$ independently represent a hydrogen atom, an alkyl group, a phenyl group, or an aralkyl group, p represents an integer of 2 or 3, q represents an integer of 3 or 4, p +q is 6, and L represents a divalent linking group that binds to the polymer portion.

6. The cyan toner according to claim 5, wherein the structure represented by formula (1) is represented by formula (6), each $R_1$ in formula (6) is a hydrogen atom, and q is 3 or 4.

7. The cyan toner according to claim 1, wherein at least one of $R_2$, $R_3$, $Ar_1$, and $Ar_2$ in formula (1) is bound to the polymer portion through a carboxylic acid ester bond or a carboxylic acid amide bond.

8. The cyan toner according to claim 1, wherein the phthalocyanine pigment is represented by formula (8):

Formula (8)

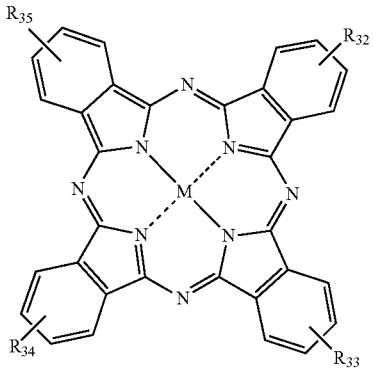

where $R_{32}$ to $R_{35}$ independently represent hydrogen, an alkyl group, or a sulfonic acid group or a salt thereof, and M represents a metal.

9. The cyan toner according to claim 8, wherein $R_{32}$ to $R_{35}$ in formula (8) are each hydrogen and M is copper(II).

10. The cyan toner according to claim 1, wherein the toner particles are produced by a suspension polymerization method or a suspension granulation method.

* * * * *